US006533382B1

(12) United States Patent
Tomida et al.

(10) Patent No.: US 6,533,382 B1
(45) Date of Patent: Mar. 18, 2003

(54) INK-JET RECORDING METHOD, INK-JET RECORDING APPARATUS, COMPUTER-READABLE MEDIUM, AND PROGRAM

(75) Inventors: Yoshinori Tomida, Atsugi (JP); Osamu Kanome, Yokohama (JP); Tsuyoshi Shibata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 09/709,703

(22) Filed: Nov. 13, 2000

(30) Foreign Application Priority Data

| | | |
|---|---|---|
| Nov. 19, 1999 | (JP) | 11-330176 |
| Nov. 19, 1999 | (JP) | 11-330181 |
| Aug. 30, 2000 | (JP) | 2000-261133 |

(51) Int. Cl.[7] ..... B41J 2/205; B41J 2/17
(52) U.S. Cl. ..... 347/15; 347/98
(58) Field of Search ..... 347/43, 21, 47, 347/40, 95, 96, 98, 15

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,630,076 A | | 12/1986 | Yoshimura | |
| 4,723,129 A | | 2/1988 | Endo et al. | |
| 4,740,796 A | | 4/1988 | Endo et al. | |
| 5,636,969 A | * | 6/1997 | Allen | 347/96 |
| 5,739,828 A | | 4/1998 | Moriyama et al. | |
| 6,095,636 A | * | 8/2000 | Shioya et al. | 347/43 |
| 6,120,141 A | * | 9/2000 | Tajika et al. | 347/96 |
| 6,244,688 B1 | * | 6/2001 | Hickman | 347/43 |

FOREIGN PATENT DOCUMENTS

| | | |
|---|---|---|
| JP | 54-56847 | 5/1979 |
| JP | 59-48164 | 3/1984 |
| JP | 59-115853 | 7/1984 |
| JP | 59-123670 | 7/1984 |
| JP | 59-138461 | 8/1984 |
| JP | 60-71260 | 4/1985 |
| JP | 63-247051 | 10/1988 |
| JP | 63-252750 | 10/1988 |
| JP | 1-212176 | 8/1989 |
| JP | 8-72236 | 3/1996 |

* cited by examiner

*Primary Examiner*—Thinh Nguyen
(74) *Attorney, Agent, or Firm*—Fitzpatrick, Cella, Harper & Scinto

(57) ABSTRACT

An ink-jet recording apparatus and recording method uses a recording head wherein nozzles with small diameter are arrayed in high density, to achieve both high quality and high speed. Accordingly, whether to record a certain area in the image with recording ink alone or with both recording ink and clear ink is determined according to the image data of the certain area, and recording is performed based on the determined results, using a recording head wherein ink discharging nozzles and clear ink nozzles are arrayed alternately.

58 Claims, 63 Drawing Sheets

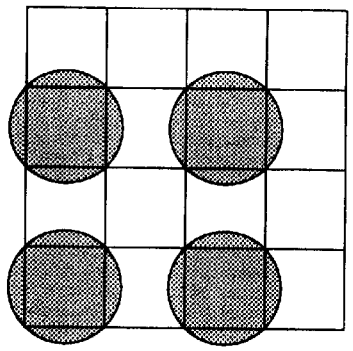
D1
FIG. 29A
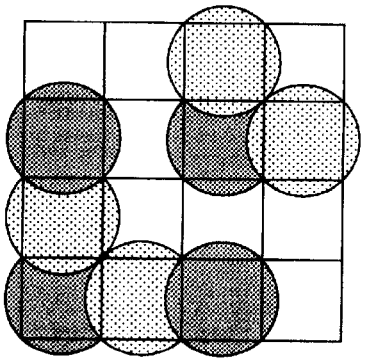
D2
FIG. 29B
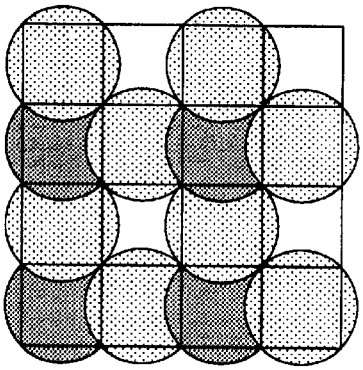
D3
FIG. 29C
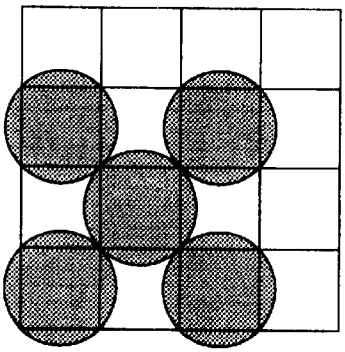
D4
FIG. 29D
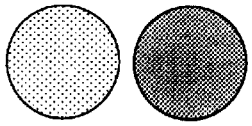

COLOR 1 DOT + CLEAR 1 DOT

SOLID m'th SCAN m+1'th SCAN

RECORDED IMAGE m'th SCAN m+1'th SCAN

RECORDED IMAGE

INK-JET RECORDING METHOD, INK-JET RECORDING APPARATUS, COMPUTER-READABLE MEDIUM, AND PROGRAM

BACKGROUND OF THE INVENTION

1. Field of the Invention

The present invention relates to an ink-jet recording apparatus and ink-jet recording method, for recording images on a recording medium using ink containing color material and a liquid essentially containing no color material.

2. Description of the Related Art

As photocopiers, word processors, computers and other information processing equipment, and communication devices come into common use, ink-jet recording apparatuses are rapidly becoming commonplace as one type of output device thereof, for performing recording of digital images using the ink-jet method. With such recording apparatuses, recording heads made up of multiple ink discharging nozzles in integrated arrays with multiple ink discharge openings and liquid channels are used to improve recording speed, and further, in recent years, arrangements containing a plurality of such recording heads are often used to deal with color which is becoming commonplace.

The ink-jet recording method performs recording of dots by forming flying droplets of ink as the recording liquid and landing these on a recording medium such as paper or the like, and has a low noise factor due to being a non-contact method. Also, high resolution and high-speed recording is enabled by the increased density of the ink discharge nozzles. Further, no special processing such as developing or fixing is necessary for recording media such as plain paper or the like, so high-quality images can be obtained at low cost. Accordingly, this method has become widespread in recent years. Particularly, on-demand type ink-jet recording apparatuses can be easily arranged to deal with color, and further the apparatus itself can be easily reduced in size and complexity, so the demand thereof in the future is expected to be great. Also, as such color becomes commonplace, even higher image quality and speed are being required.

In the present state of such high image quality being required, there are various methods being proposed regarding improving image quality. One method for improving image quality involves making the droplets of discharged ink smaller. Reducing the diameter of the nozzles is the most effective method for reducing the size of the droplets, and improved image quality is achieved by arraying the ink discharging nozzles with small nozzle diameters in high density. The reason that reducing the size of the discharged ink droplets leads to higher image quality is that the dots are not as conspicuous, and the number of gradients which can be represented without increasing the matrix size of one pixel can be increased. In other words, reducing the size of the discharged ink droplets enables the number of gradients to be increased without losing resolution. Incidentally, the higher the density of the arrayed nozzles is, the higher the output resolution is, but there is a limit to how high the density can be, due to restrictions in the manufacturing process. This is also true for reducing the size of the discharged ink droplets, and currently, due to restrictions in the manufacturing process, the limit on how little the amount discharged can be is 1 to several picoliters (several nanograms), and 20 to 40 $\mu$m recorded dot diameters on the recording medium.

Also, as another method for improving image quality, there is a method of using concentration ink which is ink of the same color in different ink concentrations. With this method, highlight portions (portions with low concentration) are recorded with low-concentration ink so as to make the grainy appearance of the recording dots less conspicuous. This also enables a great number of gradients to be represented, by using ink with low and high concentration according to the gradients. Thus, using ink with low and high concentration enables high-quality images. Also, as another method for making the grainy appearance of the recording dots less conspicuous in highlight portions, Japanese Patent Laid-Open No. 59-115853 discloses a method wherein transparent ink is recorded over the recorded dots so as to thin the concentration of the recorded dots and represent an overall light color. According to this Japanese Patent Laid-Open No. 59-115853, the number of gradients represented is not being increased, but the grainy appearance in the highlight portions is reduced, ultimately leading to high quality.

Also, as another method for improving image quality, there is a method wherein the size of the recording dots is controlled by pulse modulation, thereby increasing the number of gradients which can be represented. This is a method wherein the dot recording area is changed per unit area by changing the diameter of the dots, thereby changing the apparent concentration, and consequently representing gradients.

Also, there are methods for high quality images other than recording images with gradation (i.e., wherein the gradient level is not constant) with high quality, i.e., methods aiming to improve the quality of characters. As one method for such improvement in character quality, there is edge enhancing wherein the edge portions of characters are enhanced. For example, Japanese Patent Laid-Open No. 1-212176 discloses a method wherein image signals are subjected to secondary differentiation and computation is performed with original image signals and smoothed data, thereby enhancing the edge portions. Also, Japanese Patent Laid-Open No. 8-72236 discloses a method wherein the amount of ink discharged at the edge portions is greater than the non-edge portions, thereby raising the concentration at the edge portions. Performing such edge enhancing allows characters with clear outlines to be formed.

Though various methods are being proposed for realizing high image quality as described above, these methods have various problems, as described below.

① Reducing the size of discharged ink droplets increases the resolution, but the area covered by each ink dot is reduced. This means that the number of ink dots necessary for covering a certain area on the recording medium increases, leading to reduction in printing speed. That is to say, reducing the size of the discharged ink droplets contributes to high image quality but contradicts high speed.

② Arraying ink discharge nozzles with reduced nozzle diameters in high density allows the number of gradients to be increased without losing resolution as described above, but indiscriminately increasing the density of nozzles does not necessarily mean that high image quality can be realized. The reason is that an excessively high density array of nozzles leads to adjacent ink dots on the recording medium overlapping unnecessarily, which may cause the ink dots to blur. Such blurring causes deterioration in image quality. Also, the ink-jet method has a phenomena called ink shifting, and there is a problem in that this ink shifting becomes more pronounced as the density of the nozzles is increased and the resolution is raised. Consequently, this ink shifting leads to deterioration in image quality.

③ An arrangement may be conceived wherein adjacent nozzles do not simultaneously discharge ink such that ink is not overlapped in the same main scan of the recording head, thereby reducing image deterioration due to the blurring and ink shifting described above in problem ②. For example, in the event that there are 256 nozzles, each nozzles rests intermittently, so that 128 nozzles are driven to record the image with each scan. With such an arrangement, in the event that a solid image is recorded, the printing duty of one main scan of the recording head is 50%, so the printing concentration of one main scan of the recording head deteriorates. On the other hand, an arrangement may be conceived wherein the recording head performs two main scans to avoid deterioration of the printing concentration, but this would make the recording time longer.

④ In the event of using concentration ink, a recording head and ink cartridge are provided for each ink to be used, so the number of recording heads and the number of ink cartridges increases, meaning that the size of the recording apparatus increases, as well. For example, in the event of using ink of the seven colors of yellow, magenta, cyan, black, light magenta, light cyan, and light yellow, a head width for several colors is required. Also, an increase in the number of recording heads and carriages means an increase in weight accordingly, and the load for driving the carriages increases, so there arises the need to use a driving motor with more torque, and the need for complex mechanisms to maintain capping capabilities of the multiple caps provided according to the number of recording heads, thereby increasing costs.

⑤ Also, in the event of using concentration ink, in the event that the difference in concentration between the high concentration ink and low concentration ink is great, gradient reproduction at the switchover portion (border portion) between the high concentration ink and low concentration ink on the recorded image is not linear, which tends to cause pseudo outlines. Also, changes in the grainy characteristics and changes of tone in the recorded image occur at the above ink switchover portion, making an unnatural-looking image. In other words, the gradient becomes non-continuous due to the difference in concentration between the high concentration ink and low concentration ink. There is a method to solve this problem, which involves increasing the number of gradient concentrations, such as using a low-concentration ink, mid-concentration ink, and high-concentration ink, to perform recording, but it is clear that this would magnify the above problems regarding increased size.

⑥ With some ink-jet recording apparatuses using concentration ink, there are cases wherein the four colors of yellow, magenta, cyan, and black are used in the normal mode wherein characters, charts, etc., are recorded, and the six colors of yellow, magenta, cyan, light magenta, light cyan, and light yellow are used in the high-quality image mode wherein photographic image quality images and the like are recorded. In such cases, the black ink cartridge and the light ink cartridge are exchanged, but such cartridge exchanging is a problem in that it is troublesome for the user.

⑦ In the event of representing gradients by the dot diameter control method, the amount of ink discharge must be controlled in order to keep the dot diameter to the desired size, but it is difficult to control the amount of ink discharge with this method, and so there is the problem that this method has poor gradient reproducibility.

In this way, there are various problems such as the above-described problems ① through ⑦ regarding conventional attempts to increase the image quality. What is necessary for ink-jet recording apparatuses from now on, in addition to further improvements in image quality, is realization of increased speed, reduced costs, reduction in size of the apparatus, and so forth. In order to realize such, various problems such as the above-described problems ① through ⑦ must be solved.

Also, from the above problems ① through ⑦, it is apparent that a high-density array of ink discharging nozzles having small nozzle diameters alone has great difficulties in realizing high image quality and high speed. In order to obtain higher image quality, it is important that either the discharged ink droplets which have been reduced in size must be made to land on the recording medium with high precision, or that even in the event that there is ink shifting this must be made to be inconspicuous. Also, for high-speed recording, the printing duty for one main scan of the recording head must be raised, but in the event that the density of the nozzles is too high the ink shifting becomes distinct, which is undesirable.

Also, though the above description mainly deals with the quality of picture images with gradation (i.e., wherein the gradient level is not constant), realizing high quality must also take into consideration the quality of images such as characters, lines, charts, posters, etc., with no gradation (i.e., wherein the gradient level is constant), besides picture images. That is, an arrangement may be conceived wherein edge enhancing is applied to images of characters, lines, charts, posters, etc., so as to form a sharp and clear image. However, with the edge enhancing method disclosed in Japanese Patent Laid-Open No. 8-72236, the amount of ink discharged at the edge portion is increased, so it is conceivable that the edge portion will blur. Consequently, a sharp edge portion cannot be formed. Also, with conventional arrangements for improving the image quality with edge enhancing, recording time has not been taken into consideration. For example, in the event that the amount of ink discharged at the edge portion is increased to improve the image quality, performing the recording with one pass will result in adjacent dots blurring one another, so there is the need to record with multi-passes. This results in extra time consumed, which is unfavorable. Also, in the event of recording characters for posters and the like, the large characters of posters take time to fill in. This means that even if the edge portion could be recorded in a short time, the recording time for the overall image is long, which is unfavorable. Accordingly, thought must be given not only to the edge portion alone but also to the recording method for the non-edge portion. Thus, conventional arrangements have attempted to improve image quality by edge enhancing, but did not focus on high speeds.

From the above, an arrangement is awaited which is capable of recording picture images with high resolution and a great number of gradients, which improves image quality by recording images such as characters, lines, charts, posters, etc., with clarity, and further records picture images and images such as characters, lines, charts, posters, etc., at high speed.

SUMMARY OF THE INVENTION

The present invention has been made in light of the above objects, and accordingly, it is an object thereof to provide an ink-jet recording apparatus and recording method wherein both high image quality and high speed have been realized, using a recording head wherein nozzles with small diameter have been arrayed in high density.

Also, another object of the present invention is to provide an ink-jet recording apparatus and recording method wherein smooth gradation can be represented by increasing intermediate gradients without lowering output resolution, and also capable of reducing the grainy appearance at highlight portions.

Further, another object of the present invention is to provide an ink-jet recording apparatus and recording method wherein high quality and high speed can be realized without incurring enlarging of the apparatus or increased costs.

Further yet, another object of the present invention is to provide an ink-jet recording apparatus and recording method capable of forming images such as characters, lines, charts, posters, etc., with sharp edge portions, in a short time.

Moreover, another object of the present invention is to provide an ink-jet recording apparatus and recording method capable of recording picture areas at high resolution and with a great number of gradients, and also to reduce the grainy appearance in highlight portions.

To this end, the ink-jet recording method according to the present invention is configured as follows.

That is, an ink-jet recording method which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, comprises the steps of:

a determining step for determining whether to record at least one area of the image to be recorded with the ink alone, or to record the area with both the ink and the liquid; and a recording step for performing the recording of the above area based on the determined results of the determining step;

wherein, in the event of recording the area with both the ink and the liquid, in the recording step the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

Also, the ink-jet recording apparatus according to the present invention is configured as follows.

That is, an ink-jet recording apparatus which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, comprises:

determining means for determining whether to record at least one area of the image to be recorded with the ink alone, or to record the area with both the ink and the liquid; and recording control means for controlling the recording head such that recording is performed based on the determined results by the determining means;

wherein, in the event of recording the area with both the ink and the liquid, in recording the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

Also, the computer-readable storage medium according to the present invention is configured as follows.

That is, a computer-readable storage medium stores a program for executing the recording control step for an ink-jet recording apparatus which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, the program comprising:

a determining step for determining whether to record at least one area of the image to be recorded with the ink alone, or to record the area with both the ink and the liquid; and a generating step for generating recording data based on the determined results of the determining step;

wherein, in the event of determining recording of the area with both the ink and the liquid, the generating of the recording data in the generating step is executed such that the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

Also, the program according to the present invention is configured as follows.

That is, a program for controlling an ink-jet recording apparatus which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, comprises:

a determining step for determining whether to record at least one area of the image to be recorded with the ink alone, or to record the area with both the ink and the liquid; and a generating step for generating recording data based on the determined results of the determining step;

wherein, in the event of determining recording of the area with both the ink and the liquid, the generating of the recording data in the generating step is executed such that the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

Note that in the present specification, the term "recording ink" refers to ink which contains color material. Also, "clear ink" refers to liquid which essentially does not contain color material, e.g., a liquid consisting of the components remaining after the color material component has been removed from the above recording ink.

Also, note that in the present specification, a head with a nozzle pitch of 1/x inches is referred to as an "x dpi head". For example, in the event that the nozzle pitch is 1/1200 inches, this is a 1200 dpi head.

Further objects, features and advantages of the present invention will become apparent from the following description of the preferred embodiments with reference to the attached drawings.

BRIEF DESCRIPTION OF THE DRAWINGS

FIGS. 2A and 2B are diagrams illustrating the configuration of a recording head unit 9 with multiple recording heads 90 shown in FIG. 1 provided, wherein FIG. 2A illustrates an arrangement with the linear array recording heads shown in FIG. 1 arrayed in a straight line sideways, and FIG. 2B illustrates an arrangement with the linear array recording heads 90 shown in FIG. 1 arrayed in a straight line vertically;

FIGS. 9A through 9C are diagrams illustrating an example of a liquid channel for alternately supplying recording ink and clear ink to a nozzle array, wherein FIG. 9A is a transparent perspective view, FIG. 9B is a transparent frontal view, and FIG. 9C is a side cross-sectional view taken along section line 9C—9C of FIG. 9B;

FIGS. 10A and 10B are diagrams illustrating an example of recording based on a recording mode wherein both recording ink and clear ink are used, wherein FIG. 10A illustrates driving both a recording ink discharging nozzle and at least one adjacent clear ink discharging nozzle, and FIG. 10B illustrates the manner in which recording ink dots and clear ink dots which have landed on the recording medium mix;

FIGS. 14A and 14B are diagrams illustrating a case wherein recording is performed based on a recording mode wherein both recording ink and clear ink are used, wherein FIG. 14A illustrates driving both a recording ink discharging nozzle and at least one of the two adjacent clear ink discharging nozzles, and FIG. 14B illustrates the manner in which recording ink dots and clear ink dots which have landed on the recording medium come into contact and mix;

FIGS. 29A through 29D are dot patterns with recorded dots and clear ink dots positioned within a dot matrix;

FIGS. 46A and 46B are diagrams illustrating one dot of recording ink and one dot of clear ink caused to land on the recording medium, wherein FIG. 46A shows a case wherein the recording ink and clear ink have been caused to land at adjacent positions, and FIG. 46B shows a case wherein the recording ink and clear ink have been caused to land at the same position;

FIGS. 48A and 48B are schematic configuration diagrams of the recording head applicable to a fifth embodiment, wherein FIG. 48A is a recording head wherein recording ink discharging nozzles with a relatively small diameter and clear ink discharging nozzles with a relatively large diameter have been linearly arrayed (linear array recording head), and FIG. 48B is a recording head wherein these nozzles are arrayed in a staggered array (staggered array recording head);

FIGS. 49A and 49B are diagrams illustrating the configuration of a recording head unit 9 having multiple recording heads 90 shown in FIG. 48A, wherein FIG. 49A illustrates an arrangement wherein the linear array recording heads 90 shown in FIG. 48A are arrayed sideways in one line, and FIG. 49B illustrates an arrangement wherein the linear array recording heads 90 shown in FIG. 48A are arrayed vertically in one line;

FIGS. 51A and 51B are schematic configuration diagrams of the recording head applicable to a sixth embodiment, wherein FIG. 51A is a recording head wherein clear ink discharging nozzles with a relatively small diameter and recording ink discharging nozzles with a relatively large diameter have been linearly arrayed (linear array recording head), and FIG. 51B is a recording head wherein these nozzles are arrayed in a staggered array (staggered array recording head);

FIGS. 52A and 52B are diagrams illustrating the configuration of a recording head unit 9 having multiple recording heads 90 shown in FIG. 51A, wherein FIG. 52A illustrates an arrangement wherein the linear array recording heads 90 shown in FIG. 51A are arrayed sideways in one line, and FIG. 52B illustrates an arrangement wherein the linear array recording heads 90 shown in FIG. 51A are arrayed vertically in one line;

FIGS. 55A-1 through 55C-3 are diagrams illustrating cases of discharging clear ink at the border portion between scans;

DESCRIPTION OF THE PREFERRED EMBODIMENTS

The embodiments according to the present invention will now be described in detail, with reference to the drawings.

First Embodiment

Figure 1:
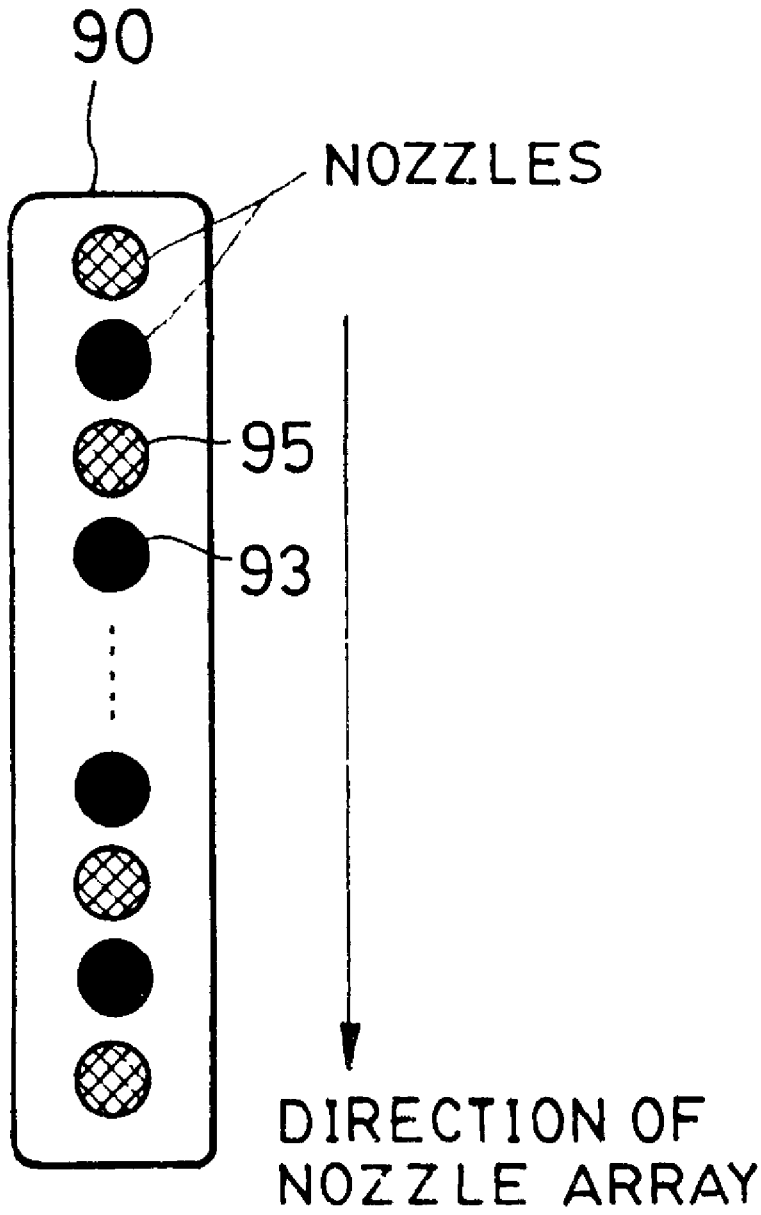
FIG. 1 is a schematic configuration diagram of a recording head mounted to an ink-jet recording apparatus applicable to the present invention, illustrating a recording head wherein the nozzles are arrayed in a straight line (linear array recording head)

FIG. 1 is a schematic configuration diagram of a recording head mounted to an ink-jet recording apparatus applicable to the present invention. Specifically, this is a schematic configuration diagram of a recording head 90 wherein the nozzles are arrayed in a straight line (linear array recording head), with recording ink discharging nozzles 93 and clear ink discharging nozzles 95 arrayed alternately in the nozzle array direction thereof. Note that with the recording head shown in FIG. 1, the end portion of the nozzle array is preferably a clear ink discharging nozzle 95. The reason is this: in the event that two clear ink dots are to be brought adjacent to one recording ink dot, this cannot be realized unless the end portion of the nozzle array is a clear ink discharging nozzle 95.

Figure 2A:
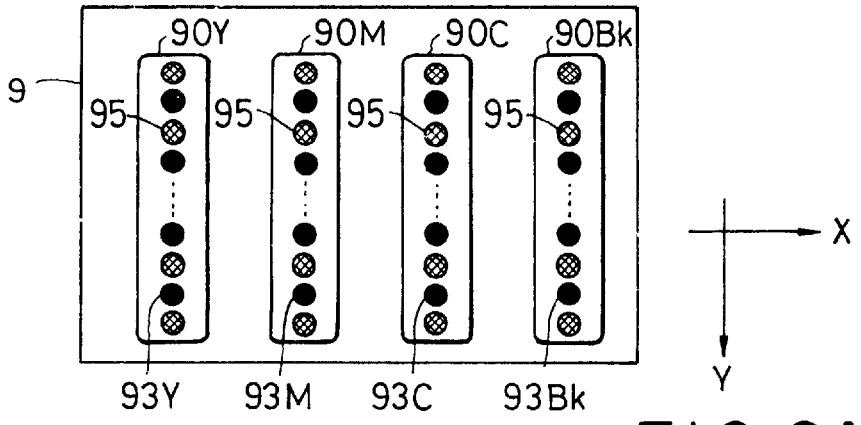
Figure 2B:
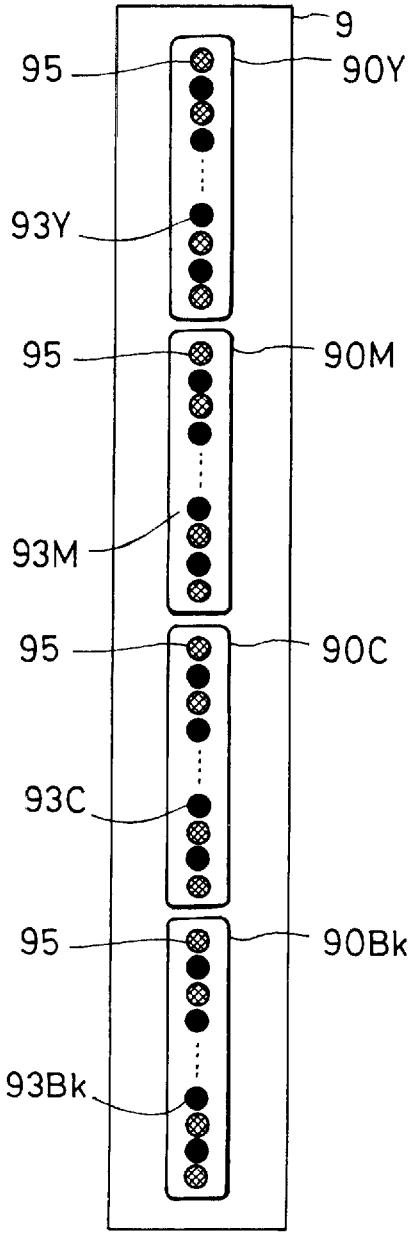

FIGS. 2A and 2B are diagrams illustrating the configuration of a recording head unit 9 with multiple recording heads 90 shown in FIG. 1 provided, wherein FIG. 2A illustrates an arrangement with the linear array recording heads 90 shown in FIG. 1 arrayed in a straight line sideways, making up a head unit 9 with heads of the four colors of yellow (Y), magenta (M), cyan (C), and black (Bk), i.e., heads 90Y, 90M, 90C, and 90Bk. Also, FIG. 2B illustrates an arrangement with the linear array recording heads 90 shown in FIG. 1 arrayed in a straight line vertically, this also having heads of the four colors of yellow (Y), magenta (M), cyan (C), and black (Bk), i.e., heads 90Y, 90M, 90C, and 90Bk, as with FIG. 2A. The heads 90 of the colors shown in FIGS. 2A and 2B may either be separated and independent, or may be formed integrally. With the present embodiment, such a recording head unit 9 is mounted to the ink-jet recording apparatus.

Figure 3:
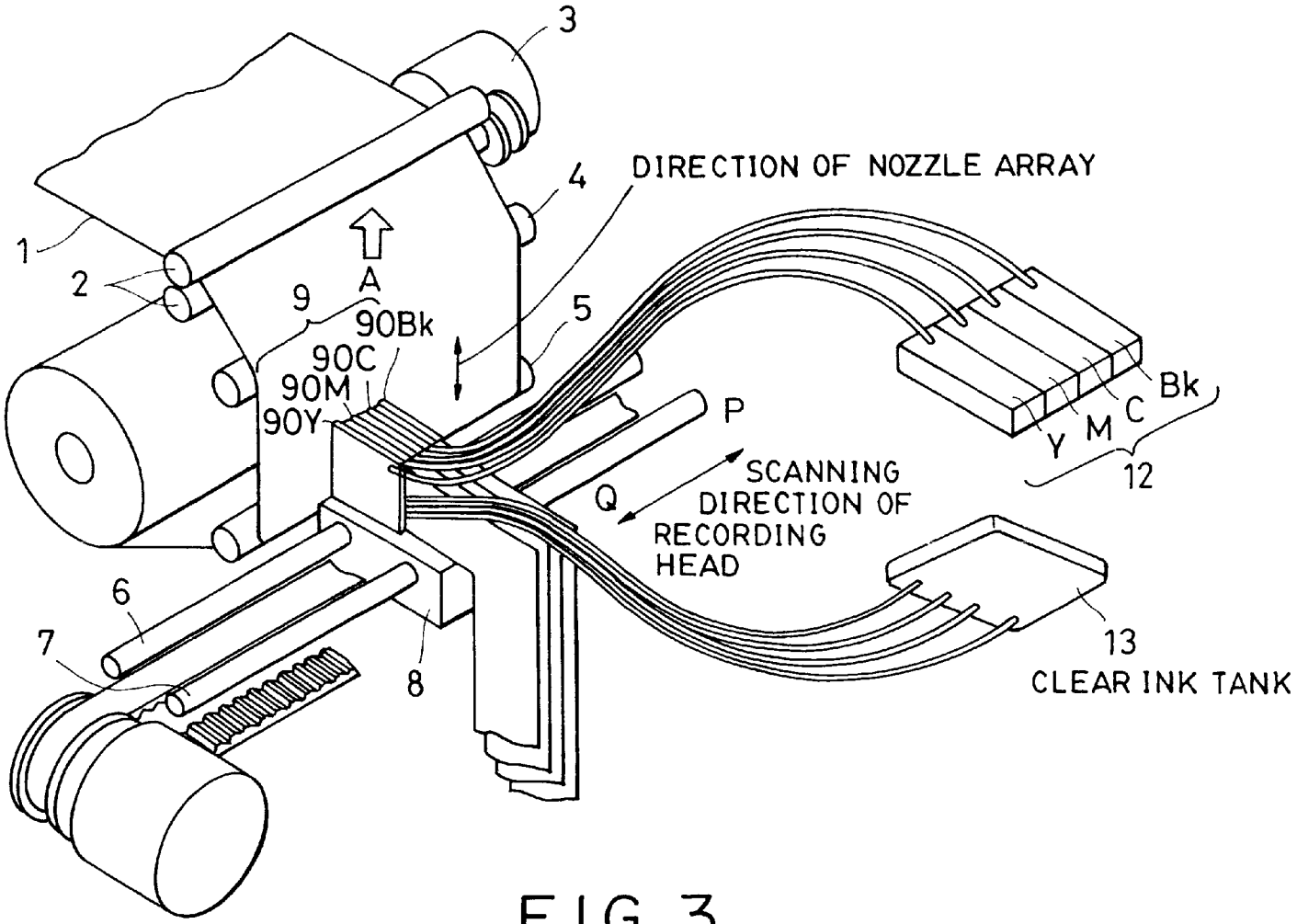
FIG. 3 is a perspective view illustrating an example of a serial type ink-jet recording apparatus applicable to the present invention.

FIG. 3 is a schematic configuration diagram of the ink-jet recording apparatus applicable to the present invention, carrying the recording head unit 9 shown in FIG. 2A. Ink of each color is supplied to the nozzles for discharging yellow, magenta, cyan, and black (hereafter abbreviated as Y, M, C, Bk) ink from corresponding ink tanks, and the nozzles for discharging clear ink have the clear ink supplied from a clear ink tank. In this arrangement, recording ink discharging nozzles and clear ink discharging nozzles are situated alternately, for each color head.

In FIG. 3, the recording medium 1 passes over transporting rollers 4 and 5 and is nipped by feeding rollers 2, and is transported in the direction of the arrow A in the figure in accordance with the driving of a sub-scanning motor 3 linked to the feeding rollers 2. Also, guide rails 6 and 7 are provided in parallel so as to intersect the recording medium 1, the carriage 8 is guided along these guide rails 6 and 7, and thus the recording head unit mounted on the carriage 8 is scanned to the left and right.

The carriage 8 has recording heads 90Y, 90M, 90C, and 90 Bk, of the four colors yellow, magenta, cyan, and black, mounted thereupon, and ink corresponding to each of the recording heads 90 is supplied from respective ink tanks 12 of the four colors. Also, clear ink is supplied to each of the recording heads 90Y, 90M, 90C, and 90 Bk from the clear ink tank 13. The recording medium 1 is intermittently fed by amounts equal to or smaller than the printing width of each recording head, and the recording head scans in the direction PQ while the recording medium 1 is stopped, so as to discharge ink droplets according to the image signals, thereby performing recording.

Figure 4:
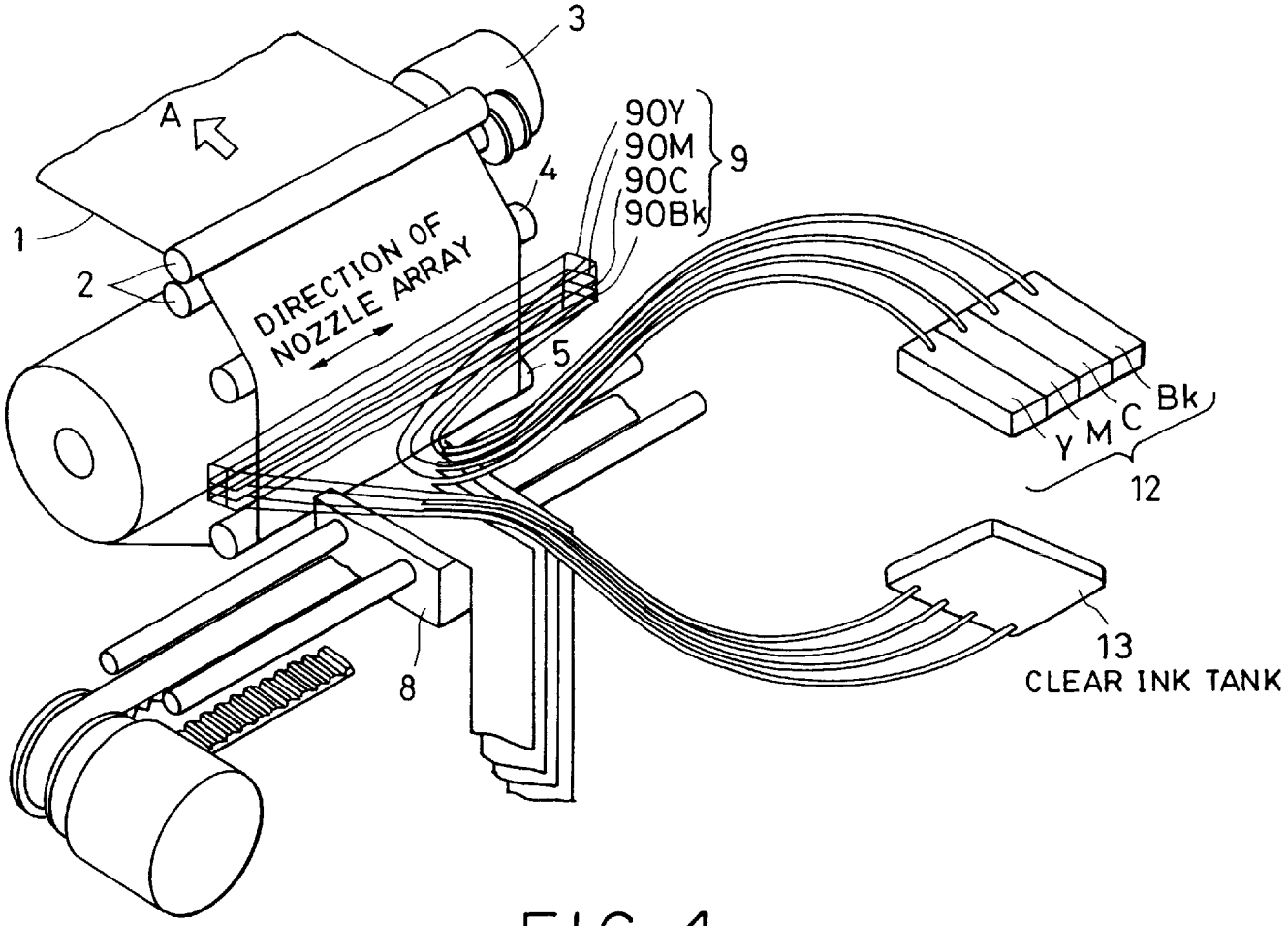
FIG. 4 is a perspective view illustrating an example of a line type ink-jet recording apparatus applicable to the present invention.

Now, there are two types of ink-jet printers: the line type printer which performs recording while sub-scanning only the recording material, and the serial type printer which performs recording while repeating main scanning of the recording head and sub-scanning of the recording medium. The above FIG. 3 is an example of a serial printer, wherein the recording head performs main scans in a direction approximately perpendicular to the nozzle array direction (the direction PQ in FIG. 3), and following completion of recording of one main scan the recording medium is sub-scanned in the direction of the nozzle array (the direction A in FIG. 3) by an amount equal to or smaller than the recording head width; these actions are then repeated, thereby performing recording. Note that the present invention is not restricted to such a serial printer, but is also applicable to a line printer such as shown in FIG. 4. That is to say, in the case of line printers, the nozzles are arrayed as shown in FIG. 4 along the recording width, the recording heads 90Y, 90M, 90C, and 90 Bk, for each of the colors, are arrayed in the direction A of the recording medium, and recording ink and clear ink are supplied to the recording heads of each color. Here, main scanning of the recording head is not performed; recording is performed by sub-scanning the recording medium in the direction perpendicular to the nozzle array direction (direction A in FIG. 4).

Figure 5A:
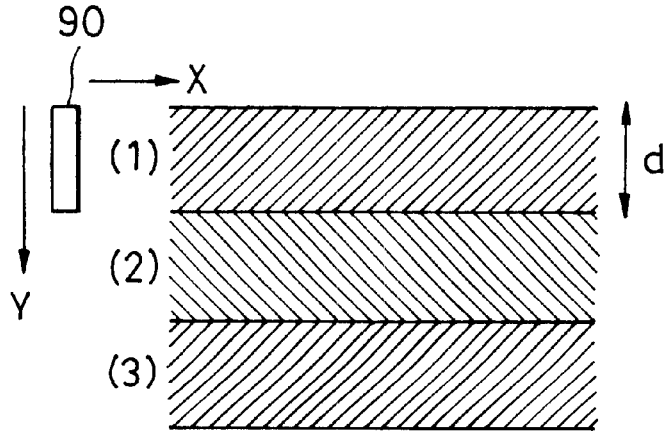
FIGS. 5A and 5B are diagrams illustrating the recording operation of a serial type ink-jet recording apparatus.
Figure 5B:
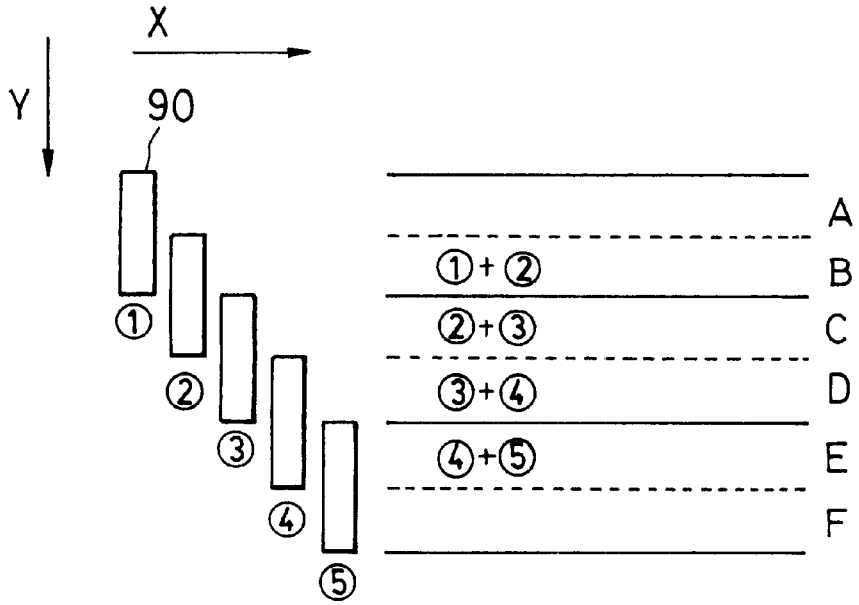

As shown in FIG. 5A, the serial type ink-jet recording apparatus such as shown in FIG. 3 performs image recording for a width d by scanning in the direction X the recording head 90 upon which are arrayed multiple nozzles, and each time that recording of one line is completed the recording medium is intermittently fed in the direction opposite to the direction Y shown in FIG. 5A by the recording width of the recording head 90. Recording is carried out by repeating this scanning in the order of (1), (2), and (3), shown in FIG. 5A. Also, as shown in FIG. 5B, image recording may be performed by the recording medium being intermittently fed in the direction opposite to the direction Y by an amount smaller than the recording width of the recording head. This means that the recording head performs main scans over the same line on the recording medium multiple times. Note that in FIG. 5B the recording medium performs sub-scans which are ½ of the recording head width, and the image is formed by the recording head performing two main scans on the same line on the recording medium. For example, the area B on the recording medium is recorded by the main scan ① and the main scan ② of the recording head, and the area C on the recording medium is recorded by the scan ② and the scan ③.

Figure 6:
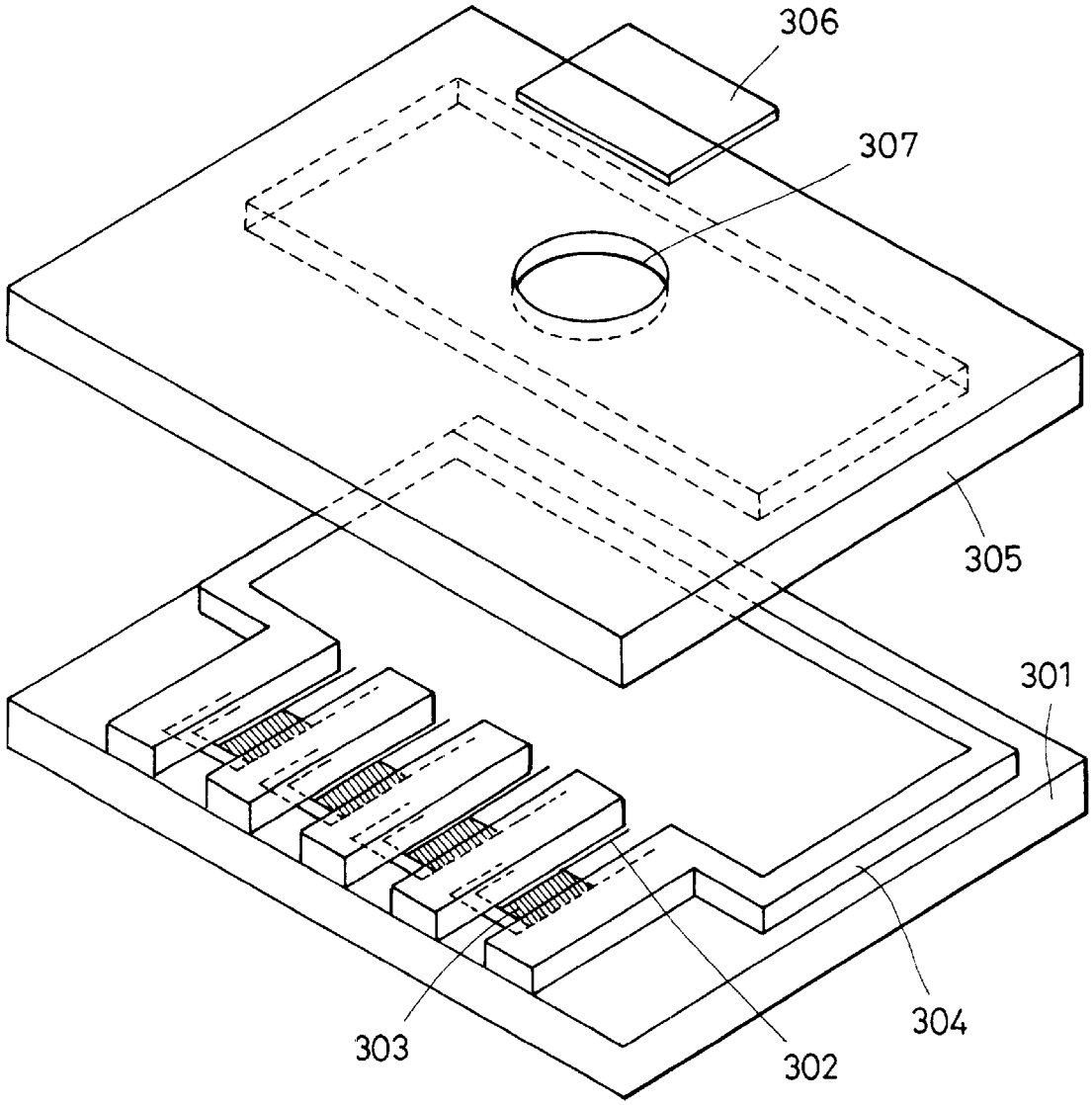
FIG. 6 is a diagram illustrating the discharge element configuration of a bubble-jet head.
Figure 7:
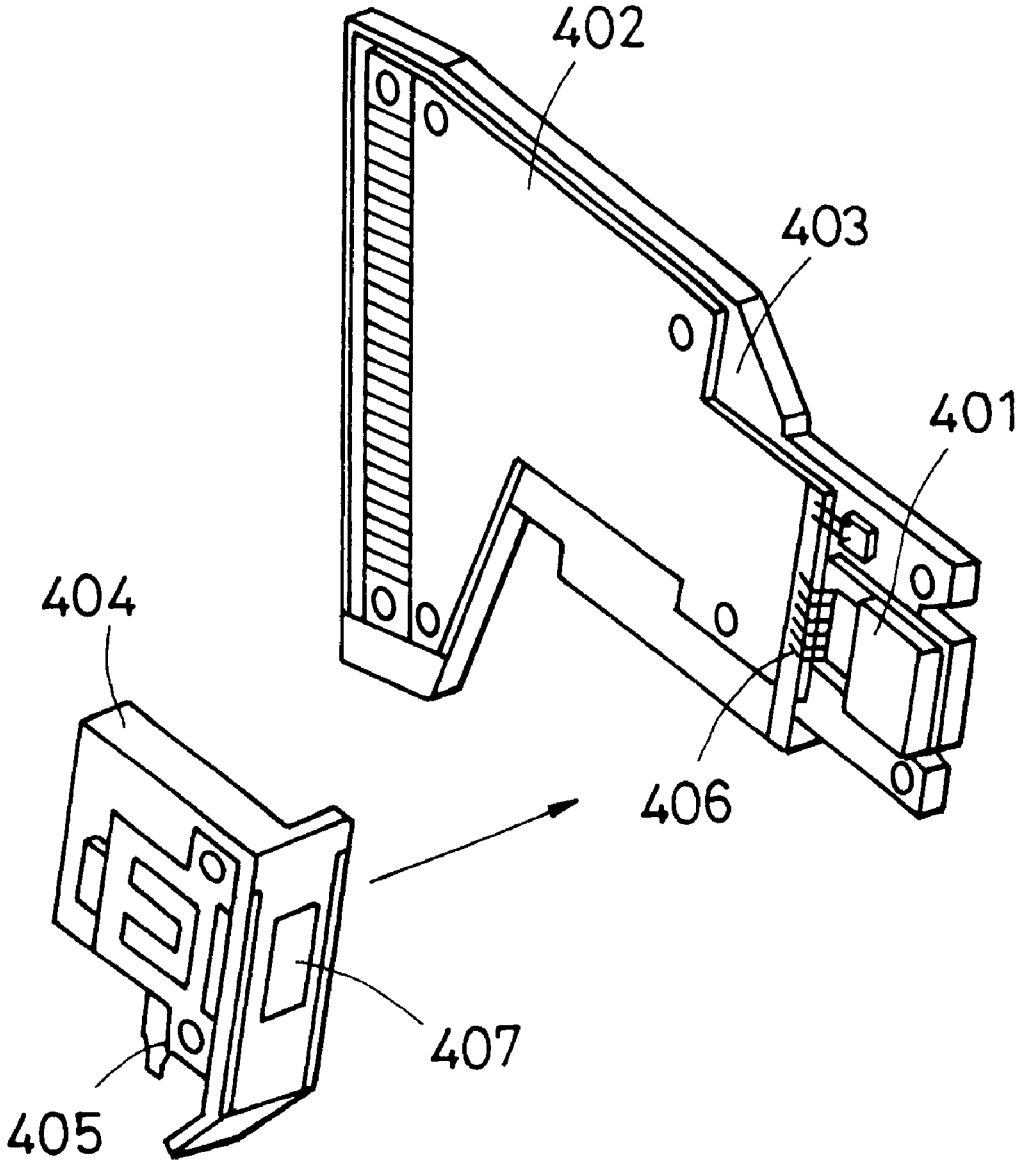
FIG. 7 is a schematic diagram illustrating the configuration of a bubble-jet head.
Figure 8:
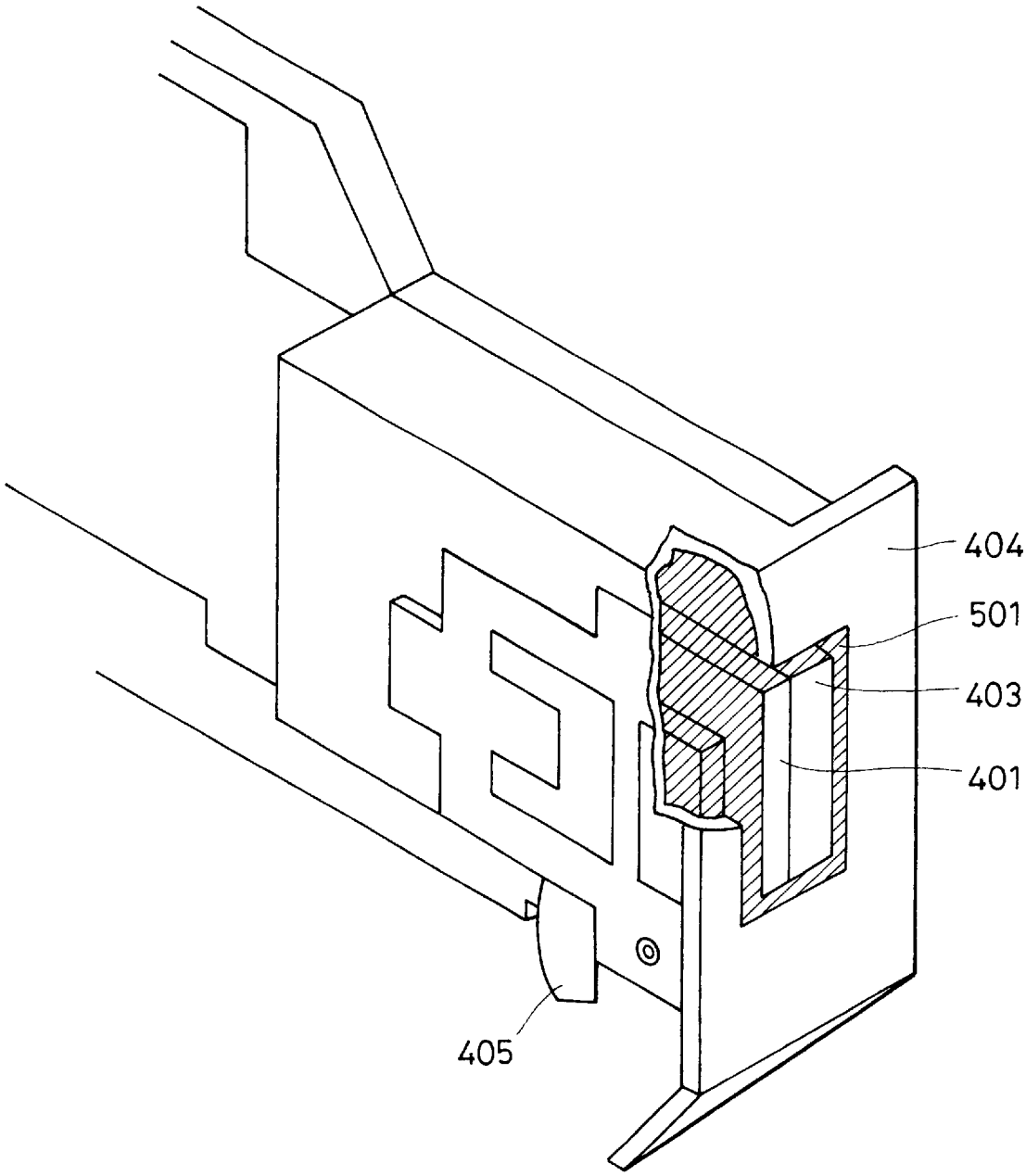
FIG. 8 is a schematic diagram illustrating the configuration of a bubble-jet head.

Now, an ink-jet head applicable to the present invention will be described in detail. With the present invention, a bubble-jet head comprising a heat-generating resistor element is optimal. The bubble-jet head used with the present embodiment may be manufactured using the processes of conventional manufacturing methods. A method for manufacturing the bubble-jet head will be described now. A known method for manufacturing the bubble-jet head involves forming a heat-generating element and lines for the heat-generating element on a silicon substrate for example using thin-film technology, and further, the groove walls of the ink channels and common ink chamber walls are formed with a photosensitive resin, using a photo-lithography process or the like, following which a covering of a plate of glass or the like is joined thereto, thus forming the discharge element, which is the principal portion of the so-called bubble-jet head. This discharge element has a filter applied to the inlet portion of the common ink chamber, and is fixed on a base plate along with a PCB (printed circuit board). Electrical connection between the discharge element and the PCB is performed by a method such as wire-bonding. Finally, a front cover and ink intake member are fixed thereto, and a sealing agent such as silicone resin or the like is filled in for the purpose of making the article liquid-tight and air-tight. FIGS. 6 through 8 illustrate the configuration of the above bubble-jet head.

FIG. 6 represents the configuration of a discharge element for discharging recording ink of one color. A heat-generating element 303 and lines 302 for the heat-generating element are formed on a silicone substrate 301 using thin-film technology, and further, groove walls of the ink channels and common ink chamber walls 304 are formed with a type of resin such as photosensitive resin. Further, a glass plate 305 with a common ink intake portion 307 is adhered thereupon, and also the common ink intake portion provided to the glass substrate 305 is covered with the filter 306 adhered to the glass plate.

FIG. 7 is a schematic diagram illustrating the configuration of a bubble-jet head. The discharge element 401 and PCB 402 are adhered and fixed onto a base plate 403 serving as a supporting member supporting the discharge element, and these are electrically connected by wire-bonding 406. The front cover 404 to which are attached the ink intake member 405 and the discharge window 407 is joined thereto, and silicone resin 501 is filled in for the purpose of making the article liquid-tight and air-tight, thus yielding the bubble-jet head shown in FIG. 8. Also, as another method for forming the ink-jet head, a method may be used wherein grooves are formed by forming plastic resin which has ink withstanding properties, and joining this with a lid plate to form ink channels. Also, as a separate conventional method for forming the ink channels, a method such as described in Japanese Patent Publication No. 2-42669 may be used, wherein the hardened film of photosensitive resin is used to form grooves for forming liquid channels, following which the lid plate is adhered or pressed thereto, thus forming ink channels.

Figure 9A:
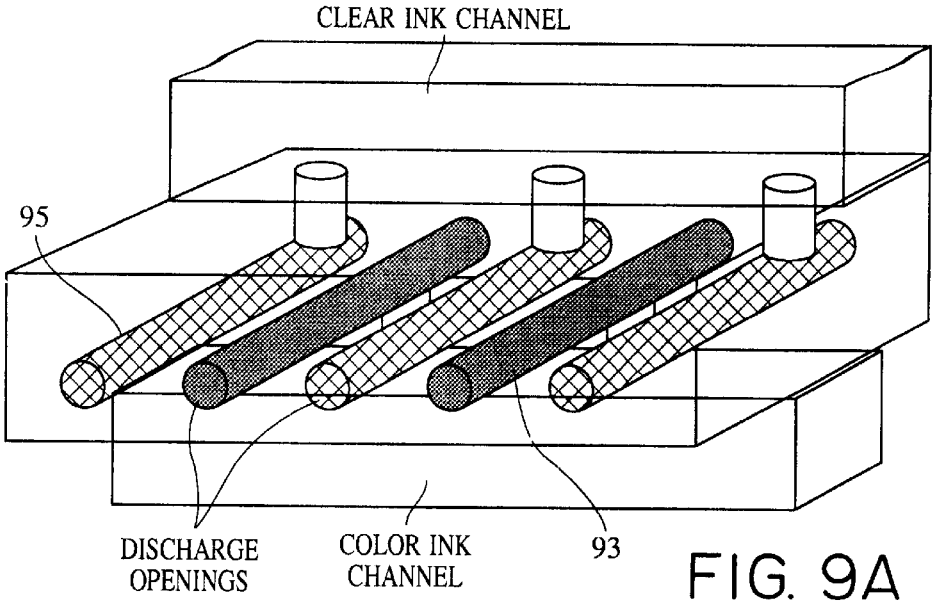
Figure 9B:
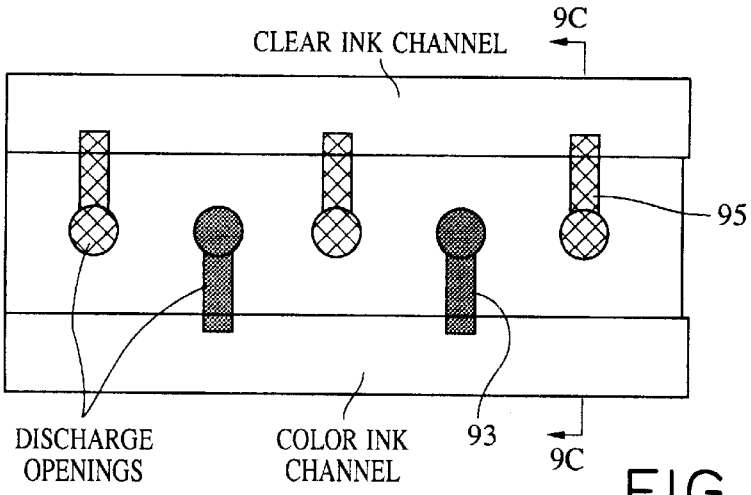
Figure 9C:
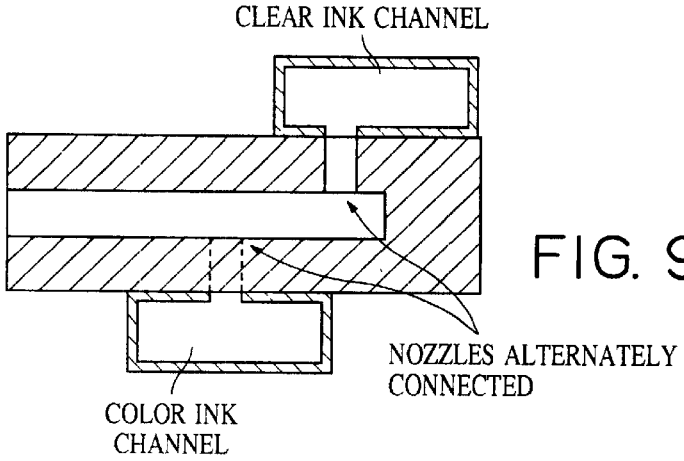

The bubble-jet head applicable to the present invention is manufactured using a conventional head manufacturing method such as described, above, but as shown in FIG. 6, conventional bubble-jet heads assume a head for discharging one color recording ink, so as a matter of course, ink of a single color fills the channel and common liquid chamber. However, the present invention involves discharging both recording ink and clear ink from a nozzle array on one recording head, so the present invention cannot be realized with an ink channel configuration such as that shown in FIG. 6. Accordingly, with the present invention, the ink channels are configured as shown in FIGS. 9A through 9C. That is, recording ink and clear ink are alternately supplied to a nozzle array configured of multiple nozzles. In this way, the present invention uses an ink-jet head having a nozzle array wherein recording ink discharging nozzles for discharging recording ink and clear ink discharging nozzles for discharging clear ink are alternately arrayed. Now, FIGS. 9A through 9C are diagrams illustrating an example of a liquid channel for alternately supplying recording ink and clear ink to a nozzle array, wherein FIG. 9A is a transparent perspective view, FIG. 9B is a transparent frontal view, and FIG. 9C is a side cross-sectional view taken along section line 9C—9C of FIG. 9B. In this way, as shown in FIGS. 1 and 9A through 9C, the ink-jet head applicable to the present invention is a head which has a nozzle array with every other nozzle being a recording ink discharging nozzle, and the nozzles adjacent to the recording ink discharging nozzles are clear ink discharging nozzles.

Figure 10B:
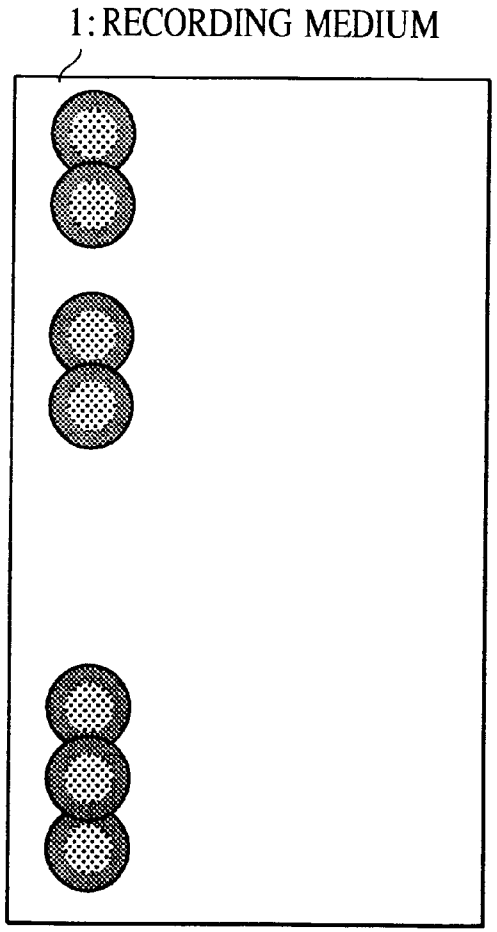
Figure 10A:
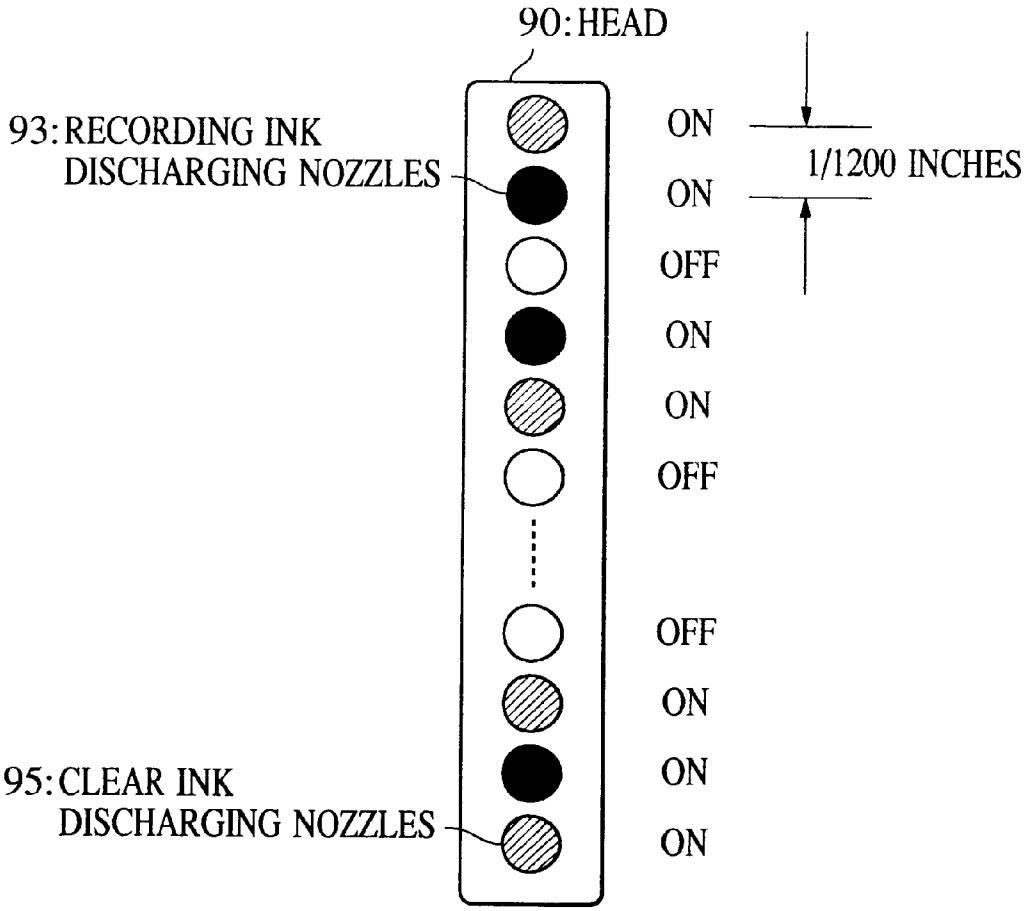
Figure 14A:
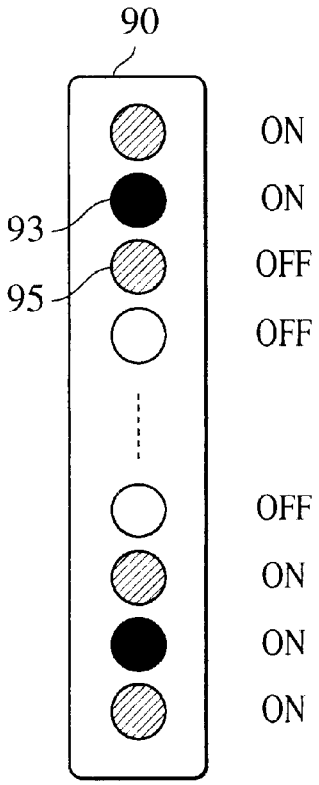
Figure 14B:
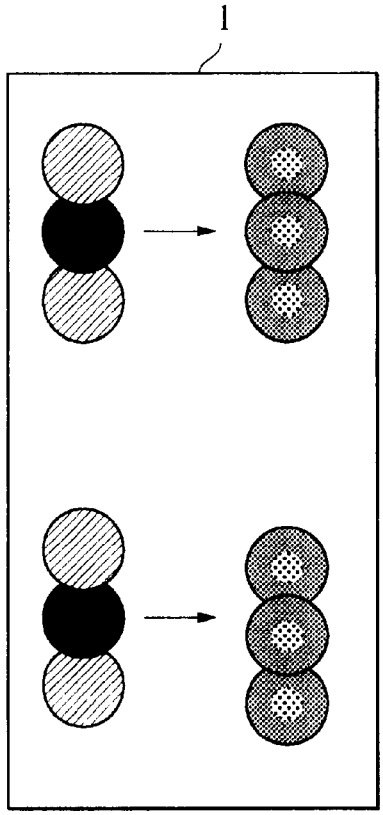

Regarding the recording of an image on a recording medium using such an ink-jet head, the present invention has two manners of recording which are respectively used depending on the image to be recorded, these being a case wherein only the recording ink discharging nozzles are driven and only recording ink is recorded onto the recording medium, and a case wherein both the recording ink discharging nozzles and the clear ink discharging nozzles are driven and both recording ink and clear ink are recorded onto the recording medium. Then, in the event of recording both recording ink and clear ink, recording ink discharging nozzles and at least one clear ink discharging nozzle adjacent to each recording ink discharging nozzle are both driven on the same main scan of the recording head, as shown in FIG. 10A. Discharging both recording ink and clear ink in the same main scan of the recording head from adjacent nozzles allows the recording ink and clear ink to be brought into contact (i.e., mixed) in a precise manner on the recording medium, and also the area covered by the recorded dots can be expanded, as shown in FIG. 10B. It should be fully understood that though FIG. 10B and the later-described FIG. 14B show the center portion of the landed dot being lighter than the perimeter, this is only a representation in drawing to facilitate ease of describing the manner in which the recording ink and the clear ink mix, and in reality the center portion of the landed dot is not lighter. Incidentally, a 1200 dpi head is used in FIGS. 10A and 10B.

Figure 11B:
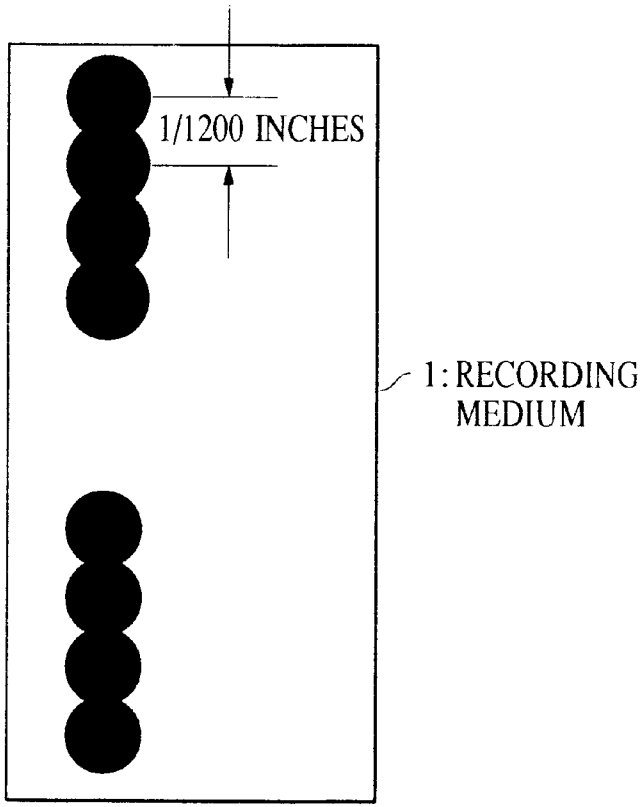
FIGS. 11A and 11B are diagrams of a 1200 dpi head, showing that recording ink is supplied to all nozzles.
Figure 11A:
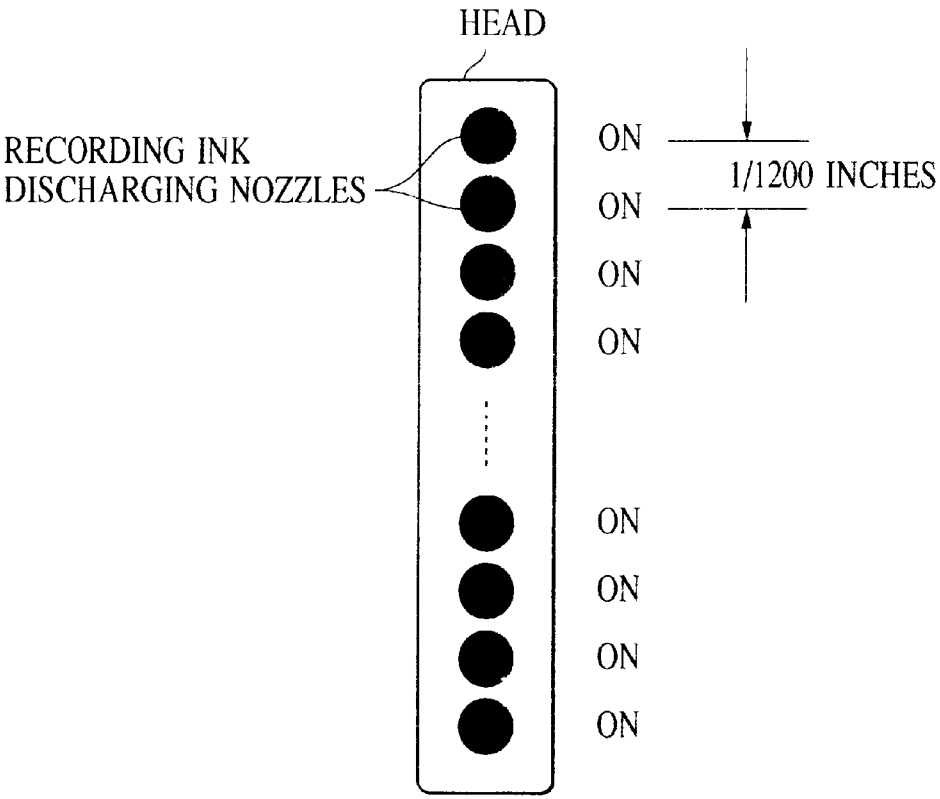

As can be understood from the above (i.e., that recording ink and clear ink discharged from adjacent nozzles in the same main scan are mixed on the recording medium), nozzles are arrayed in high density in the ink-jet head used with the present invention. Normally, recording using such a high-density head has various advantages but also has several disadvantages. These disadvantages will be briefly described using a 1200 dpi head such as shown in FIG. 11A. FIG. 11A shows a 1200 dpi head, capable of discharging recording ink from all nozzles. In the event that recording ink is discharged from adjacent nozzles with the head shown in FIG. 11A, the recorded dots coming into contact overlap on the recording medium, as shown in FIG. 11B. Simple overlapping of adjacent dots in itself is no problem, but in the event that the adjacent dots are overlapped in the same main scan, the recording dots are both in a liquid state and will mix. In the event that the adjacent dots are in a liquid state and mix, the dots may blur, which would cause deterioration of image quality. Particularly, with characters or fine lines or the like wherein high resolution is required, this blurring affects the image quality all the more. Accordingly, in order to deal with this problem with the above-described conventional recording method, an arrangement has been used wherein adjacent dots are not recorded within the same scan so as to buy time to let the ink discharged first to seep into the recording medium, following which the adjacent dots are recorded thereupon in the subsequent scan, thereby reducing the blurring due to overlapping of the dots. That is to say, recording has been performed using the multi-pass method wherein the same area is scanned multiple times. Using the multi-pass method for recording does reduce blurring, so image quality improves, but in exchange for this advantage the number of scans increases, which makes the recording time longer, consequently leading to deterioration in recording speed.

Also, the head shown in FIG. 11A has nozzles arrayed in high density, so there is the disadvantage that shifting of the discharged ink tends to be conspicuous and affects the image quality greatly. The reason why the higher the arrayed density of the nozzle is, the more conspicuous the shifting of the discharged ink tends to be, will be described by comparing a case wherein recording is performed using a 1200 dpi head and a 600 dpi head. For example, in the event that the recording density is 1200 dpi, the distance between the centers of adjacent dots is approximately 21 $\mu$m, and in the event that the recording density is 600 dpi, the distance between the centers of adjacent dots is approximately 42 $\mu$m. In the event that the dot diameter is approximately 20 $\mu$m, the image is formed with the adjacent dots being positioned so as to be in contact with one another if the recording density is 1200 dpi, but if the recording density is 600 dpi an image is formed wherein the adjacent dots do not touch each other. In the event of recording under the above conditions, in the event that the dot landing position shifts due to dot shifting of the discharged ink, with the 1200 dpi head, change in the percentage of the portion not covered by dots (i.e., the background percentage) is great. In other words, even the slightest shifting in the position of the dots landing causes the adjacent dots to overlap excessively, which may cause the background to appear. Conversely, with the 600 dpi head, the adjacent dots do not overlap anyway, so slight shifting in the landing position does not change the background percentage very much. That is to say, slight shifting in the landing position does not cause the adjacent dots to overlap, so there is seldom new background appearing. Thus, it can be understood that the higher the density of the nozzle array is, the more conspicuous the deterioration of image quality due to discharged ink shifting becomes.

Figure 12B:
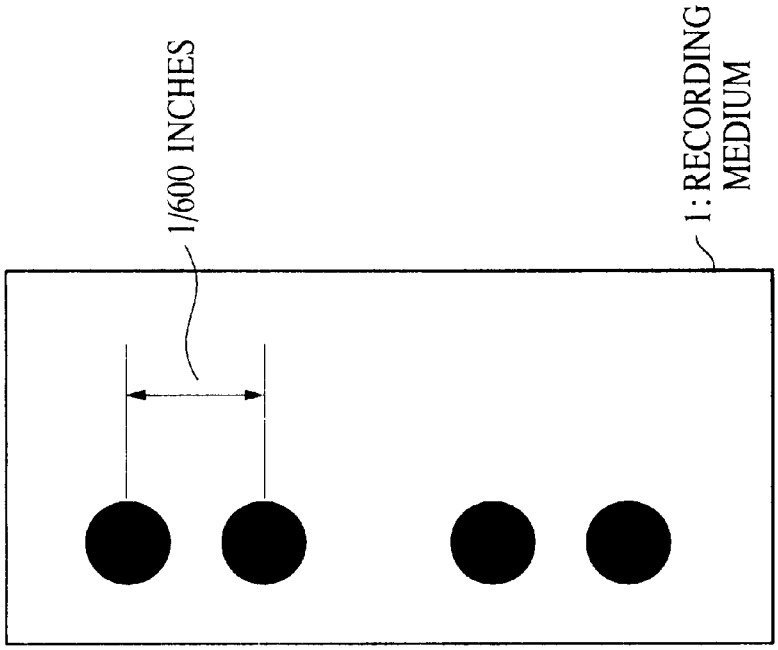
FIGS. 12A and 12B are diagrams of a 1200 dpi head, showing that recording ink is supplied to alternating nozzles.
Figure 12A:
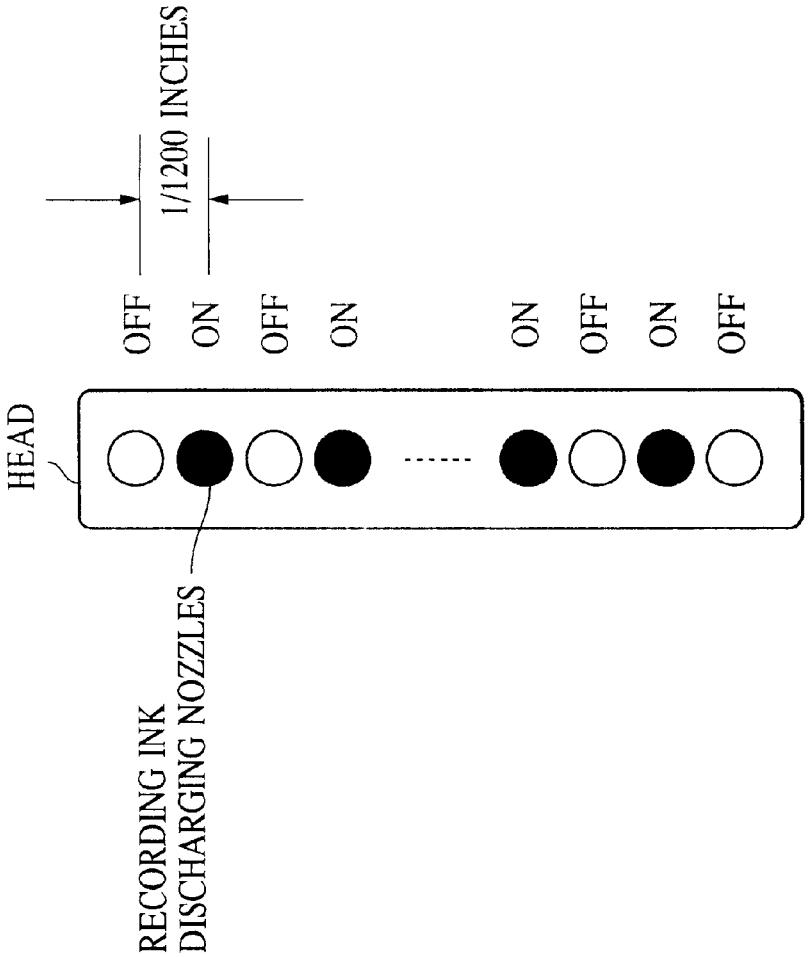

From the above, it can be understood that the higher the density of the nozzle array is, the more conspicuous the deterioration of image quality due to blurring and ink shifting becomes, so measures must be taken in order to reduce the deterioration of image quality due to such blurring and ink shifting in the event that recording is to be performed with such a high-density head. To this end, with the present invention, recording ink is not discharged from all nozzles in the nozzle array, rather, recording ink is discharged from every other nozzle. In other words, the configuration is such that recording ink is not discharged from nozzles adjacent to recording ink discharging nozzles, and as shown in FIG. 1, recording ink discharging nozzles are provided alternately. Performing recording using such a head allows the above disadvantages such as blurring of dots and shifting to be reduced. The reason is that positioning the recording ink discharging nozzles intermittently means that even in the event that all recording ink discharging nozzles in the 1200 dpi head are driven as shown in FIGS. 12A and 12B, the recorded adjacent dots do not come into contact, so none of the disadvantages according to the high-density nozzles described above are manifested.

Thus, according to the present invention, high-resolution images can be recorded by using a head with a high-density array of nozzles with small nozzle diameters, and also the recording ink discharge nozzles are arrayed alternately, thereby avoiding the above disadvantages of high-density heads. Now, in the above example, a 1200 dpi head is used and recording ink is discharged from every other nozzle, so consequently recording is performed at a 600 dpi recording density. Accordingly, the resolution deteriorates as compared to recording at a 1200 dpi recording density, but deterioration of image quality due to blurring of dots and shifting can be reduced, so this is more preferable even if it does involve lowering of resolution. Also, generally, resolution of 600 dpi is a sufficient resolution from the perspective if obtaining a high-quality image, and thus can be called a high-resolution image.

With the present invention, an inline type recording head which has a nozzle array wherein recording ink discharging nozzles and clear ink discharging nozzles are alternately arrayed as shown in FIG. 1 is used, thereby discharging recording ink and clear ink from the same head. The reason is that inline heads have higher precision in the landing position of the droplets. This is because a single head is not affected by difference in thermal expansion occurring due to the heads being different heads. Specifically, in the event that the recording ink discharging nozzles and clear ink discharging nozzles are on different heads, there are cases wherein the relative positional relation of the nozzles may become offset due to thermal expansion of the heads according to environment temperatures. In such an event, there are cases wherein the clear ink dots cannot be made to land precisely between the recording ink dots. On the other hand, with the inline type head wherein the recording ink discharging nozzles and clear ink discharging nozzles are arrayed inline, even in the event that there is thermal expansion there is no change in the relative positional relation of the nozzles, so the clear ink dots can be made to land precisely between the recording ink dots. Accordingly, with the present invention, an inline type head, which is not affected by difference in thermal expansion occurring due to the heads being different heads, is preferably used.

Figure 46A:
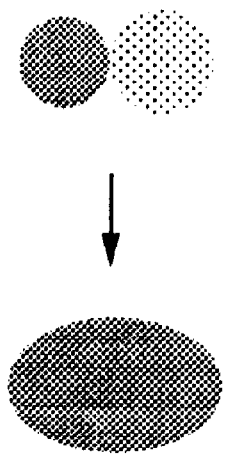
Figure 46B:
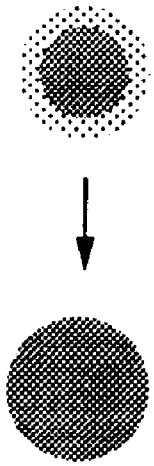

Also, as described later, with the present invention, clear ink is caused to land at positions adjacent to the recording ink dots. This is because causing the clear ink to land at positions adjacent to the recording ink dots makes the covered area of the dots greater as compared with landing at the same position, which is particularly advantageous in the case of solid printing wherein sufficient covering rate is necessary. On the other hand, causing the clear ink to land at the same position may result in the covering rate being insufficient and gaps being formed, so this is not advantageous for solid printing. This will now be described using FIGS. 46A through 47B. FIGS. 46A and 46B are diagrams illustrating one dot of recording ink and one dot of clear ink caused to land on the recording medium, wherein FIG. 46A shows a case wherein the recording ink and clear ink have been caused to land at adjacent positions, and FIG. 46B shows a case wherein the recording ink and clear ink have been caused to land at the same position. From this, it is clearly understood that causing the clear ink to land at positions adjacent to the recording ink dots makes the covered area of the dots greater as compared with landing at the same position. This is due to ink dispersing. That is, the recording ink and clear ink landing at adjacent positions quickly become homogenous and seep in the X-Y direction on the recording medium surface, so the ink dot area at this time is somewhat greater than the sum of the dot areas of the recording ink dot and clear ink dot. On the other hand causing the recording ink and clear ink to land at the same position increases the amount of dispersing in the Z direction (i.e., the thickness direction of the recording medium), so the dot area is smaller than in the event of the clear ink landing at positions adjacent to the recording ink dots.

Figure 47A:
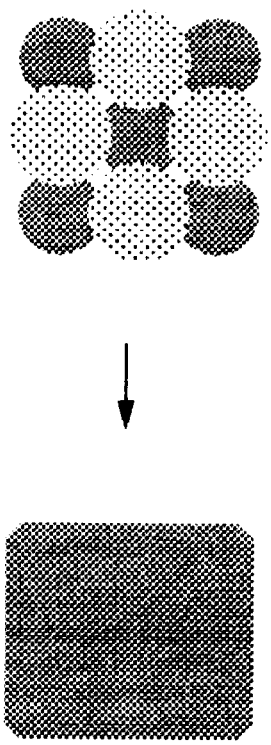
FIGS. 47A and 47B are diagrams illustrating solid printing using both recording ink and clear ink.
Figure 47B:
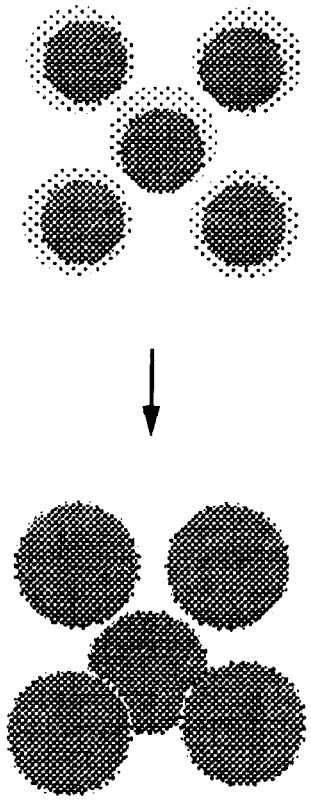

FIGS. 47A and 47B illustrate solid printing performed using both recording ink and clear ink, and the dots are rendered two-dimensionally as shown in the Figures. In the event that the recording ink and clear ink are caused to land at the same position, depending on the correlation of the dispersing onto the recording medium and the dot diameter, gaps may appear between the dots as shown in FIG. 47B. Accordingly, with the present invention wherein solid printing is performed using both recording ink dots and clear ink dots, the recording ink and the clear ink are preferably caused to land at positions adjacent one to another.

Now, as described above in the problems ① through ③, high resolution image recording can be realized by recording with smaller ink droplets, but in cases of recording solid images on the recording medium, the recording time becomes longer, consequently deteriorating the recording speed. Thus, with the present embodiment, image recording is performed only with the recording ink in the event that an image which requires high resolution is to be recorded, and image recording is performed with both the recording ink and clear ink in the event that a solid image which does not require high resolution is to be recorded.

Figure 13B:
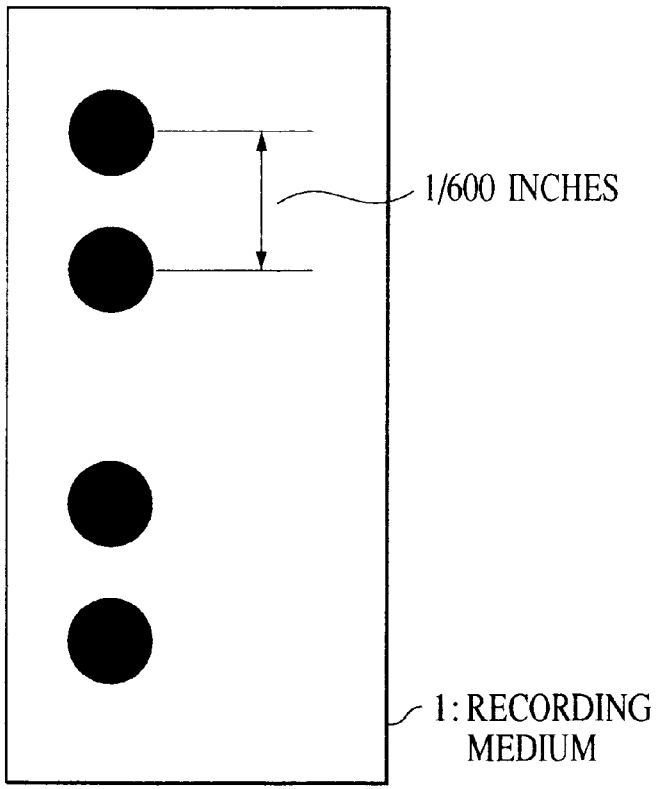
FIGS. 13A and 13B are diagrams illustrating a recording head wherein ink discharging nozzles and clear ink discharging nozzles are situated alternately, showing that only the ink discharging nozzles are being driven.
Figure 13A:
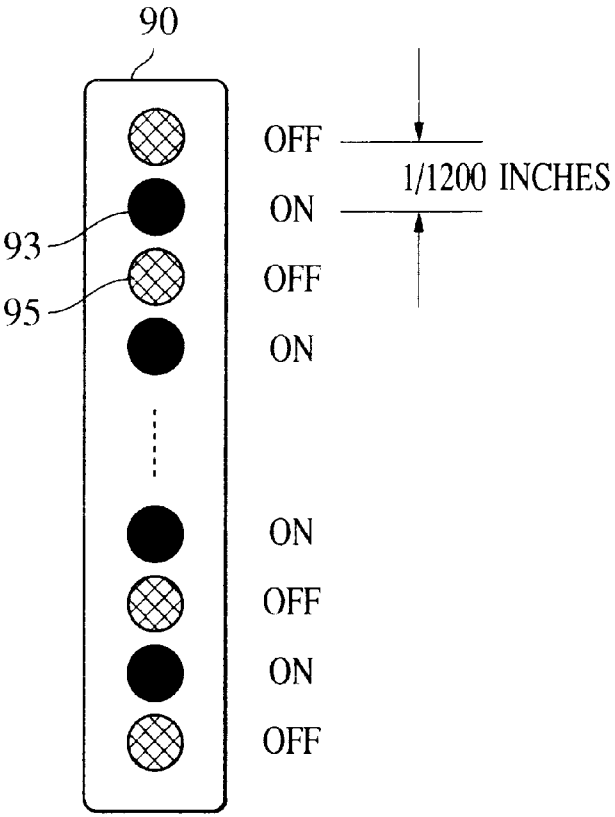

First, the first recording mode which uses only recording ink will be described with reference to FIGS. 13A and 13B. This first recording mode is applied in the event that an image which requires high resolution, such as characters or fine lines or the like, is to be recorded. This is realized by driving only the recording ink discharging nozzles and not driving the clear ink discharging nozzles. Thus, recording dots alone are formed on the recording medium, as shown in FIG. 13B. This image formed of recording dots alone has little probability of the adjacent dots overlapping, so there is little effect of dot blurring or shifting, and further the resolution is high, so this can be called a high-quality image. Also, using this first recording mode for the edge portions such as characters and fine lines wherein high resolution is required is advantageous, since the dots exist in an independent state and the edge is emphasized.

Next, the second recording mode which uses both recording ink and clear ink will be described with reference to FIGS. 10A and 10B, and FIGS. 14A and 14B. FIGS. 10A and 10B are diagrams illustrating an example of recording based on the recording mode wherein both recording ink and clear ink are used, wherein FIG. 10A illustrates driving both the recording ink discharging nozzles and at least one adjacent clear ink discharging nozzle, and FIG. 10B illustrates the manner in which the recording ink dots and clear ink dots which have landed on the recording medium come into contact and mix. FIGS. 14A and 14B also are diagrams illustrating a case wherein recording is performed based on a recording mode wherein both recording ink and clear ink are used, wherein FIG. 14A illustrates driving both a recording ink discharging nozzle and the two adjacent clear ink discharging nozzles, and FIG. 10B illustrates the manner in which recording ink dots and clear ink dots which have landed on the recording medium come into contact and mix. This second recording mode is particularly advantageous in the event of recording solid images wherein high resolution is not necessary. Recording a solid image with the above second recording mode is realized by driving all nozzles of the head shown in FIG. 10A and FIG. 14A.

Then, in order to allow the discharged recording ink and clear ink to mix in a liquid state, the recording ink and clear ink are preferably discharged in the same scan of the recording head. Thus, by the ink discharged from a particular ink discharging nozzle and liquid discharged from a liquid discharging nozzle adjacent to the particular ink discharging nozzle landing on different positions on the recording medium and the recording ink and the liquid coming in contact upon the recording medium, the recording ink and the clear ink mix in a liquid state on the recording medium, so the recording ink dot is spread by the clear ink, and the covering area of the recording ink dot becomes greater. Hence, a solid image can be recorded in a short time.

Now, the reason why it is advantageous to allow the recording ink and the clear ink to mix in the event of recording a solid image will be described. Firstly, this is because the recording time can be reduced. As described above, the adjacent recording ink dots themselves do not overlap with the present invention, so covering up a particular area completely with recording ink dots on the recording medium cannot be performed with one recording head scan alone. That is, only one main scan (one pass) will leave gaps between the recording ink dots, so a solid image cannot be recorded. In the event that the head according to the present invention is used and a solid image is to be recorded using only the recording dots, a multi-pass method must be used for recording, meaning a longer recording time. Now, mixing the recording ink and the clear ink so as to allow the covering area of the recording ink to expand permits the solid image to be recorded with a single main scan of the recording head. Secondly, this is advantageous since the recording concentration can be improved. In the event that the head according to the present invention is used and a solid image is to be recorded using only the recording ink dots, only one scan of the recording head will leave gaps between the adjacent dots, resulting in a lower recording concentration. Thus, mixing the recording ink and the clear ink so as to allow the covering area of the recording ink to expand realizes higher recording concentration. As described above, the present invention involves mixing of recording ink and clear ink, in order to record solid images with sufficient recording concentration and in a short time.

In the above description, the statement is made that the recording concentration rises in the event that the recording ink and clear ink are mixed, and this will be described now in detail. In the event that the recording ink and clear ink mix, the color material of the recording ink is dispersed by the clear ink, thereby thinning the recording ink dots. It might be thought that the thinning of the recording ink dots would lower the optical concentration of the recording ink dots, but the area of the recording ink dots increases due to the recording ink dots thus being spread, so simply thinning does not mean that the optical concentration drops. That is to say, the optical concentration of the recording ink dots is not determined only by the absolute amount of color material per unit area, but in reality is greatly affected by the covering area of the recorded dots on the recording medium.

Figure 15:
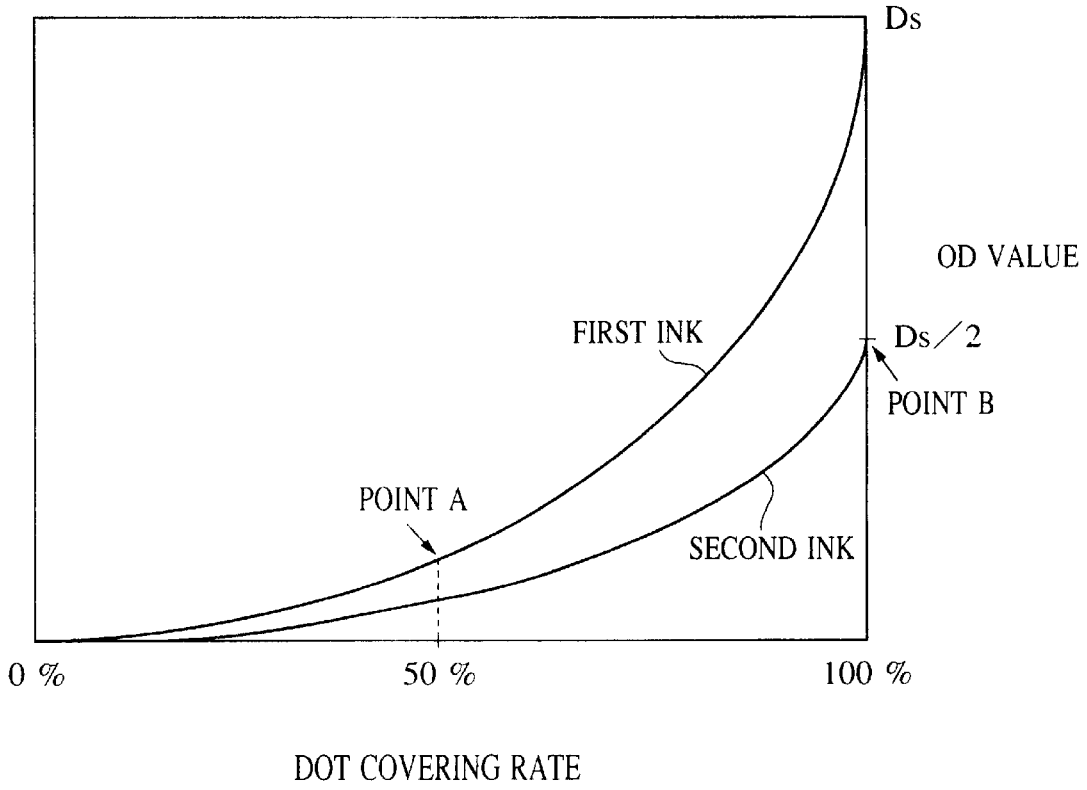
FIG. 15 is a diagram illustrating the relation between the dot covering rate and optical reflection density (OD value) with two types of ink, i.e., a first ink with solid density of Ds and a second ink with solid density of Ds/2.

For example, this can be understood from FIG. 15. FIG. 15 is a diagram illustrating the relation between the dot covering rate and optical reflection density (OD value) with two types of ink, i.e., a first ink with solid optical density of Ds and a second ink with solid optical density of Ds/2. The horizontal axis represents the covering percentage, and the vertical axis is the OD value. As can be understood from FIG. 15, it can be understood that the OD value is higher with the second ink which realizes 100% covering, as compared to the first ink which realizes 50% covering (this is clear since the OD value at point B is higher than the OD value at point A). In other words, FIG. 15 demonstrates that an arrangement wherein two area units of recording ink dots with ½ concentration has a higher OD value than an arrangement wherein one area unit of recording ink dots with full concentration. From the above, it can be understood that the optical reflection density does not depend only the concentration of the ink itself, but the covered area is also a great factor.

The present invention uses this principle to increase the optical reflection density. In the event that one recording ink dot and one clear ink dot are mixed, the ink concentration following mixing is on the average approximately ½ of the recording ink concentration, and the area covered by ink following mixing is on the average approximately twice that of the area covered by the recording ink dot alone. In this case, as can be clearly understood from the following Yule-Nielsen expression (wherein D represents optical reflection density, n is a constant, a represents the dot covering percentage, and Ds represents the solid optical reflection density), increased dot covering percentage increases the optical reflection density, giving an appearance of being darker. The present invention discharges clear ink dots between the recording ink dots so as to blur the recording ink dots, thereby raising the dot covering percentage, and consequently enabling an image to be recorded which has a higher optical reflection density than the optical reflection density of an image recorded with recording ink dots alone.

Yule-Nielsen Expression $$D = n \log \frac{1}{1 - a(1 - 10^{-Ds/n})}$$

The above first recording mode gives priority to recording speed in particular and this enables one-pass recording, but there are cases wherein one-pass recording creates gaps within dots since the adjacent dots are not in contact, and the image quality appears lower due to the gaps. Thus, in the event that an image with higher quality is desired, a recording method wherein multi-passing method is applied to the first recording mode can be used. Specifically, first, as with the first recording mode, an image is formed wherein the recording dots are not in contact, by discharging recording ink alone for the first pass. Next, after the recording medium has been transported in the sub-scanning direction, recording ink alone is discharged in the second pass in a manner filling in between the dots recorded in the first pass. Thus, a high-resolution image with few gaps between the dots can be recorded, and a higher image than recording with the first recording mode can be achieved. This recording method using the multi-pass method will be referred to as the third recording mode. Now, using this third recording mode enables higher quality images than with the first recording mode, but also leads to lower recording speed. For example, using two passes more than doubles the recording time, and using three passes more than triples the recording time. As described above, the first recording mode and the third recording mode each have advantages, so an arrangement should be made wherein this is taken into consideration and the modes are used according to whether recording speed is to be given priority or recording quality is to be given priority. Also, a recording method wherein the multi-pass method is applied to the second recording mode will be referred to as the fourth recording mode. The fourth recording mode is used along with the third recording mode. This is because both modes are multi-pass methods, and thus the number of passes can be matched. Note that even in the event that recording is performed in the fourth recording mode, the recording ink and clear ink discharged from adjacent nozzles are discharged in the same main scan of the recording head.

Thus, with the present embodiment, recording can be made with the first recording mode, the second recording mode, the third recording mode, and the fourth recording mode, and which recording mode to use is preferably determined by the image to be recorded or selection made by the user, or so forth. With the first embodiment according to the present invention, the first recording mode is used for non-solid areas for which high resolution is required, and the second recording mode is used for solid areas in the image regarding which high resolution is not required. This will be described below with reference to FIGS. 16 through 19.

Figure 16:
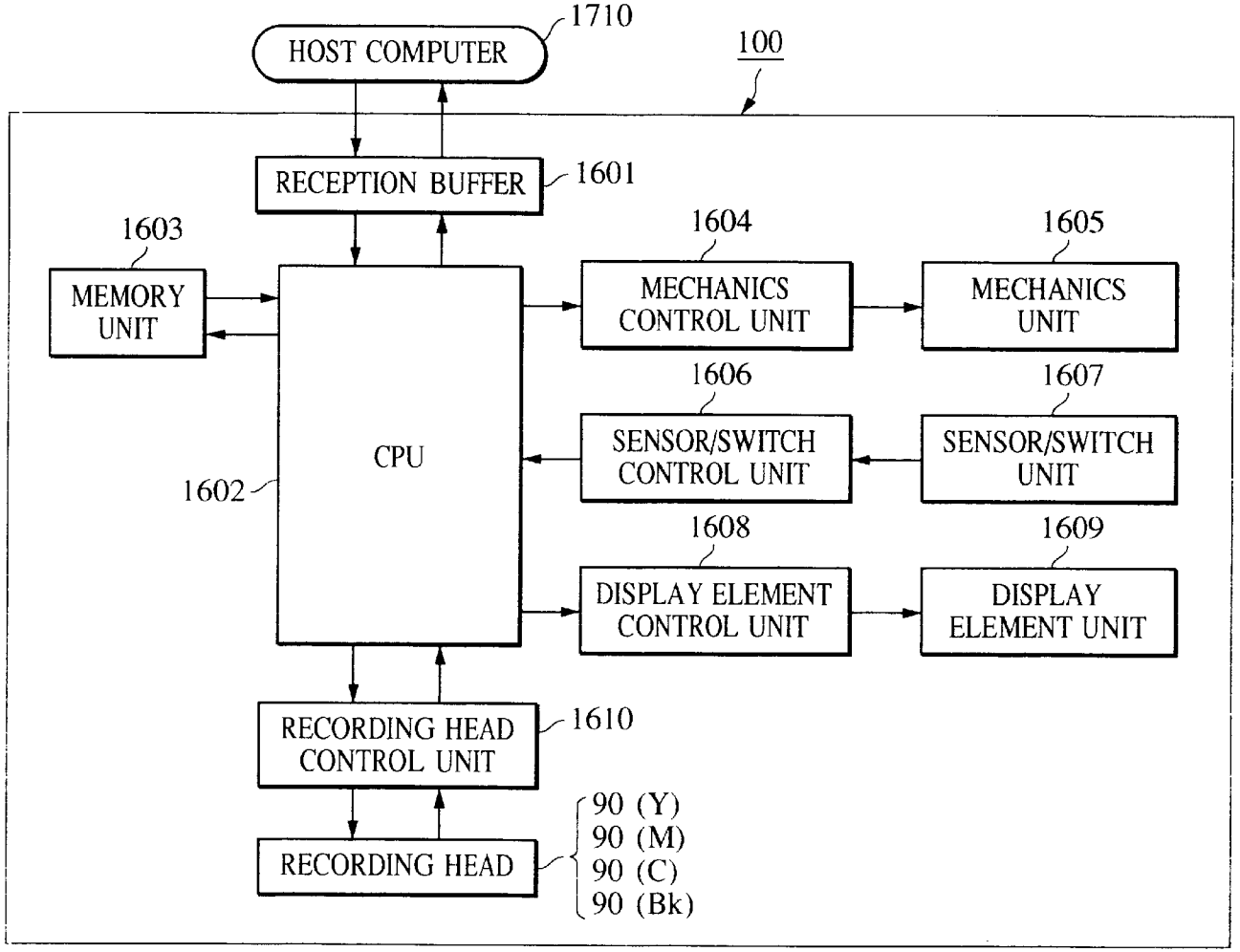
FIG. 16 is a block diagram of the ink-jet recording apparatus shown in FIG. 3.

FIG. 16 is a block diagram of the ink-jet recording apparatus 100 shown in FIG. 3. Image data such as characters, line art, photographic images, etc., to be recorded are input from the host computer 1710 to the reception buffer 1601 of the recording apparatus 100. Also, data for confirming that the data is being transferred properly, and data notifying the operating state of the recording apparatus 100, are transmitted from the recording apparatus 100 to the host computer 1710. The data in the reception buffer 1601 is transferred to the memory unit 1603 under the management of the CPU 1602, and is temporarily stored in the RAM (Random Access Memory) of the memory unit 1603. The mechanics control unit 1604 controls the driving of the mechanics 1605 such as the carriage motor and line feed motor, under instructions from the CPU 1602. The sensor/switch control unit 1606 sends signals from the sensor/switch unit 1607 made up of various sensors and switches, to the CPU 1602. The display element control unit 1608 controls the display element unit 1609 made up of LEDs or liquid crystal devices or the like on the display panel group, under instructions from the CPU 1602. The recording head control unit 1610 controls the recording heads 90Y, 90M, 90C, and 90Bk, under instructions from the CPU 1602. For example, control is made between cases for driving only the recording ink discharging nozzles of the heads and cases for driving both the recording ink discharging nozzles and the clear ink discharging nozzles thereof, according to image data or user selection, thereby selectively driving the nozzles for image formation. Also, the recording head control unit 1610 detects temperature information and the like indicating the state of the recording heads, and notifies the CPU 1602 of this.

Figure 17:
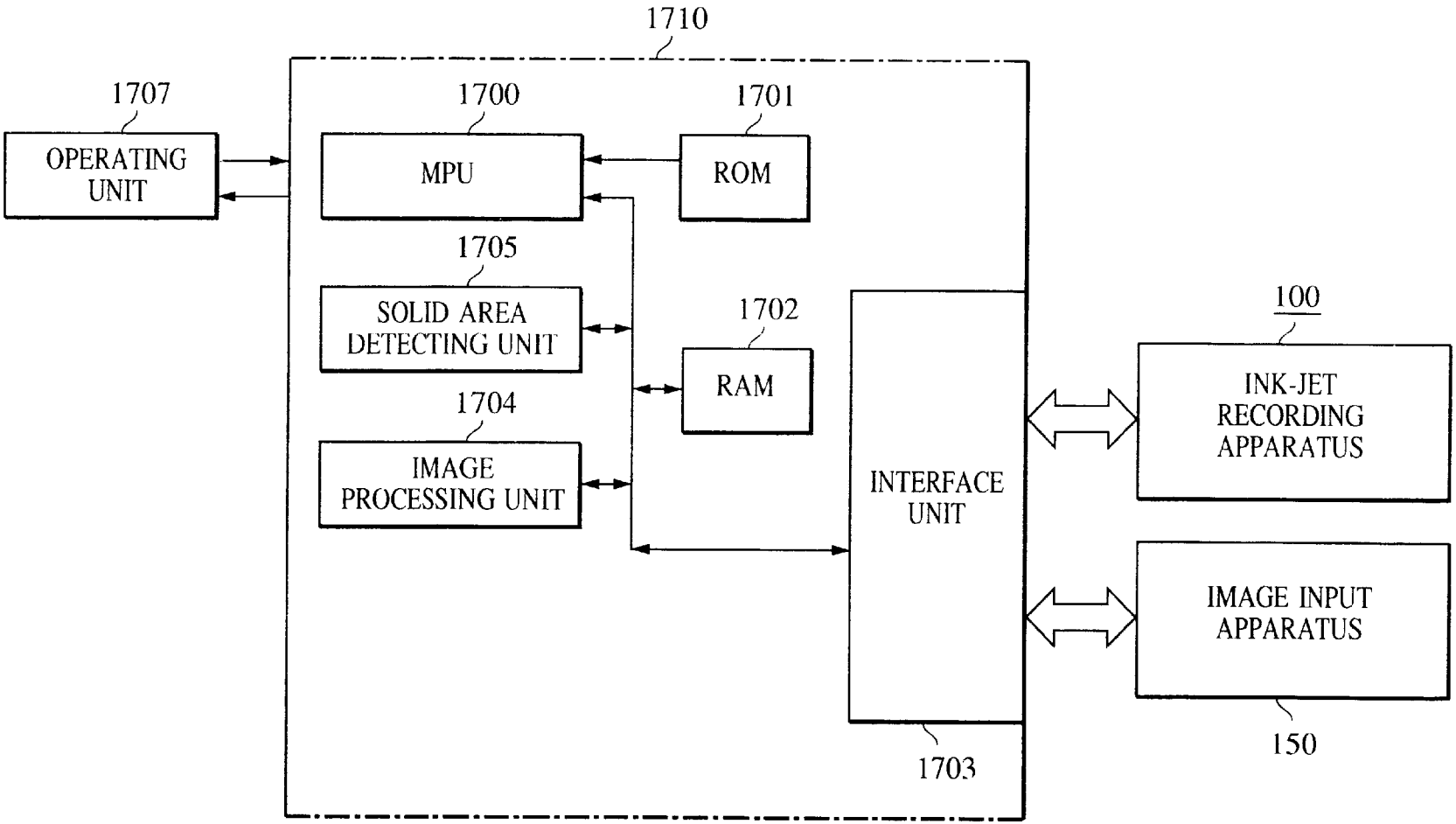
FIG. 17 is a block diagram illustrating the configuration of the control system of the host computer 1710.

FIG. 17 is a block diagram illustrating the configuration of the control system of the host computer 1710. In FIG. 17, the host computer 1710 is a PC for example, and reference numeral 1700 denotes an MPU for controlling each unit, reference numeral 1701 denotes a ROM storing various operating programs, and reference numeral 1702 denotes a RAM to which data can be written and read from. Reference numeral 1704 denotes an image processing unit for performing overall image processing, reference numeral 1705 denotes a solid area detecting unit for detecting solid areas in images, and reference numeral 1707 denotes an operating unit for performing various types of key input and message display and the like. The host computer 1710 is controlled by the MPU 1700 which operates based on the programs stored in the ROM 1701. The ROM 1701 stores application programs for controlling document processing programs and the like, printer drivers for driving the printer, graphics sub-systems for intermediating between the application programs and printer drivers, etc., and also stores the programs for executing the processing shown in the flowchart of FIG. 19 for the present embodiment. Also, connected to the host computer 1710 are the ink-jet recording apparatus 100, and image input apparatuses 150, such as scanners and digital cameras etc., via the interface unit 1703.

Figure 18:
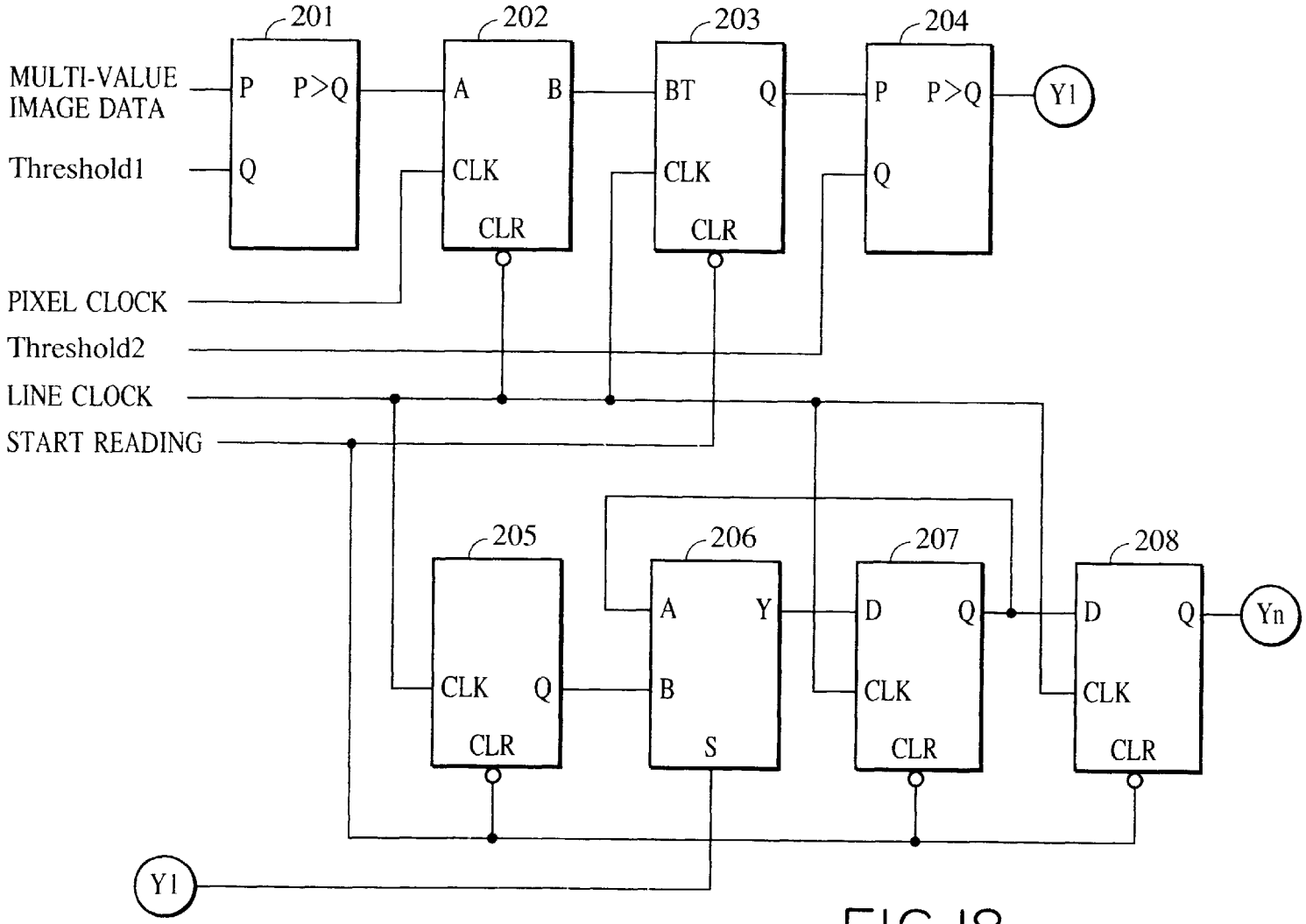
FIG. 18 is a block diagram illustrating the configuration of the solid portion detecting unit 1705.

FIG. 18 is a block diagram illustrating the configuration of the solid area detecting unit 1705. With the present embodiment, the solid area detecting unit 1705 is provided independently as shown in FIG. 17, but an arrangement may be made wherein the solid area detecting unit 1705 is provided within the image processing unit 1704, or wherein solid area detection is made after the read data is binarized. The following is a description of the solid area detection method. This description particularly relates to a case wherein an original image is read with a scanner, and the black solid area in the original image is detected.

Detection of the black solid area is based on to what extent black pixels continue. Specifically, the number of black pixels within one line of the original image is counted, and in the event that the number there is equal to or greater than a predetermined threshold value, the line becomes a candidate for the solid area, and in the event that a predetermined number of candidate lines continue, the area from the starting line to the ending line is recognized as a black solid area.

FIG. 18 is a block diagram of an arrangement wherein the solid area detecting unit 1705 is configured using the above detecting method, and is made up of a comparator 201, a DF/F (D-type flip-flop) 202, an enable counter 203, a comparator 204, a line counter 205, a selector 206, a DF/F 207, and a DF/F 208. With the solid area detecting unit 1705, first, the multi-value image data input from the image input apparatus such as a scanner or digital camera is compared with the Threshold 1 (threshold value) at the comparator 201, and is binarized for a translation processing image. The DF/F 202 inputs the binarized data, and in the event that a predetermined number of black pixels continue, outputs a High signal from the output B. The enable counter 203 counts the number of times of this High output, and outputs the number of black pixels per line based on the line clock. The comparator 204 compares the number of black pixels per line with the Threshold 2 (threshold value), and in the event that this is equal to the Threshold 2 value or greater, the Y-coordinate at that time is latched by the DF/F 207. At this time, the value at which the Threshold 2 was first exceeded is stored as Y1. Subsequently, the Y coordinate values are updated by the line counter 205, selector 206, DF/F 207, and DF/F 208, until Y1 becomes Low, thereby obtaining Yn. That is to say, the area between Y1 through Yn is the black solid area. Incidentally, though the above has been a description of a method for detecting the black solid area, the present invention is not restricted to this, and solid area detection for other colors (C, M, Y, etc.) may be made as well. For example, in the event of detecting a C solid area with C ink, this can be detected by focusing on the C pixels.

Figure 19:
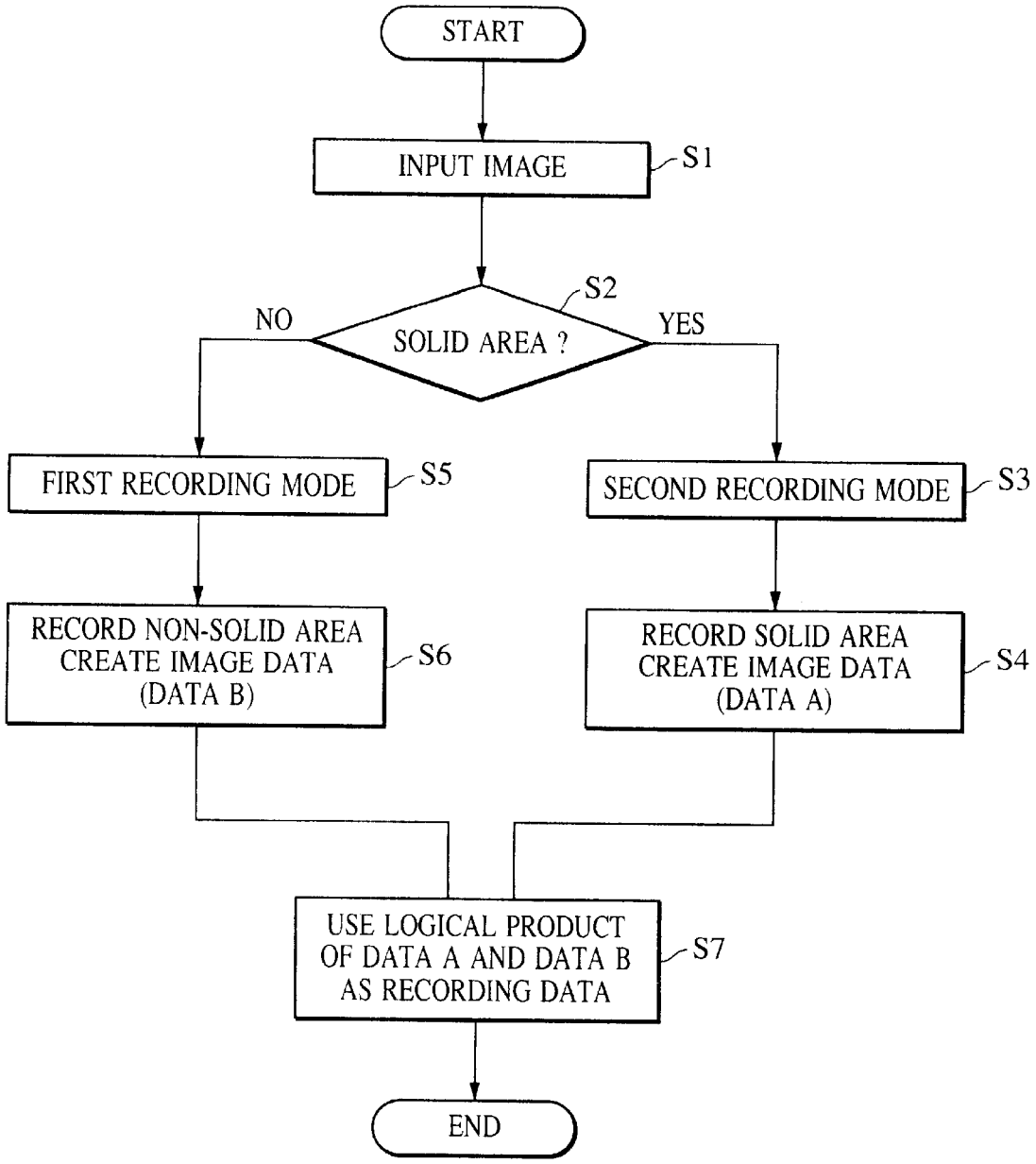
FIG. 19 is a flowchart illustrating the processing procedures relating to a first embodiment.

The operations of the first embodiment which is realized using the above configuration will be described using the flowchart shown in FIG. 19. FIG. 19 illustrates a case wherein recording ink alone is used (first recording mode) and a case wherein both recording ink and clear ink are used (second recording mode), according to the image data. This processing is realized by the MPU 1700 controlling the units 1701 through 1705. First, in step S1, the image input apparatus (scanner) 150 reads the original, and inputs the image. Next, in step S2, the solid area detecting unit 1705 detects solid areas within the read image data. In the event that there is a solid area the flow proceeds to step S3, and setting is made so as to record that solid area with the above second recording mode. That is to say, the area that has been judged as a solid area is recorded using both recording ink and clear ink. After the second recording mode has been set in step S3, recording image data for recording the solid area is created in step S4. The data obtained here will be referred to as Data A. Subsequently, the flow proceeds to step S7.

On the other hand, in the event that this is a non-solid area with no solid areas, the flow proceeds to step S5, and the no-solid area is set so as to be recorded with the above first recording mode. That is to say, the area that has been judged to be a non-solid area is recorded using only recording ink. Once the first recording mode is set in step S5, recorded image data for recording the non-solid area is created in step S6. The data obtained here will be referred to as Data B. Subsequently, the flow proceeds to step S7.

In step S7, the solid area data and the non-solid area data are joined. Specifically, the logical product of the data A obtained for recording solid areas and the data B obtained for recording non-solid areas is obtained, and this is used as recording data.

The recording data thus obtained is transferred to the ink-jet recording apparatus 100 via the interface unit 1703, and recording is performed by the ink-jet recording apparatus. According to the above, the non-solid areas are recorded with recording ink alone, and the solid areas are recorded with both recording ink and clear ink, thereby forming a recorded image.

Now, the above solid area detection has been described as being for image data input from an image input apparatus 150 such as a scanner or digital camera, but solid area detection is performed in the same manner as above in the event of recording character and photograph images and the like displayed on the monitor which is the display unit of the host computer 1710. In this case, the multi-value image data is converted into binary data, and subsequently subjected to solid area detection with a method like the above.

Also, the solid area detecting method is not limited to that described above; rather, various known methods may be used. For example, a method may be used wherein the solid area detection is performed by outline tracing. This method will be described with reference to FIGS. 20 and 21.

First, raster scanning is performed of the image data in the RAM where the image data to be recorded is stored, and the pixel for starting tracing is searched. Next, in the event that the outline is to the outside of that tracing start pixel, the tracing is performed in counter-clockwise fashion, and in the event that the outline is to the inside of that tracing start pixel, the tracing is performed in clockwise fashion. Then, returning to the tracing start pixel again completes the tracing of the outline of one pixel group. The above scanning is repeatedly executed until there are no more untraced outline pixels left.

Figure 20:
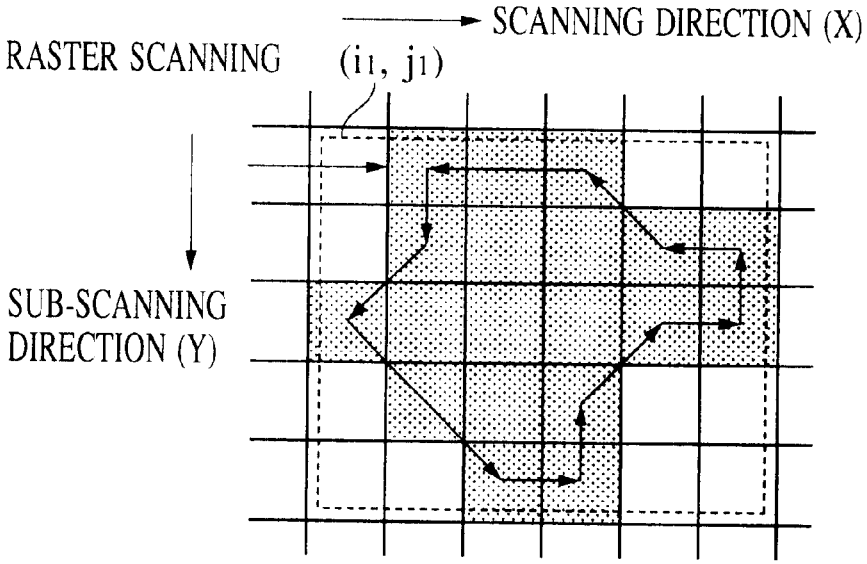
FIG. 20 is a diagram illustrating an example of tracing the outline of one pixel group.
Figure 21:
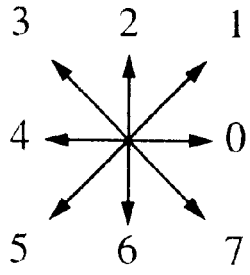
FIG. 21 is a diagram illustrating the direction of the outline.

FIG. 20 shows an example of tracing the outline of one pixel group, and the directions of the outline are the directions "0" through "7", as shown in FIG. 21. First, raster scanning such as shown by the dotted line in FIG. 20 is started, and in the event that the tracing start pixel is found at the position (i1, j1) for example, judgement is made that the previous pixel in the raster scanning is a white pixel and thus this is an outside outline, so tracing is started in counter-clockwise fashion from this position. Next, tracing is started in counter-clockwise fashion from the direction "4" in FIG. 21. Nearby pixels are checked counter-clockwise from the direction "4", and the direction of the first pixel found is used as the direction of the outline. Next, the tracing center pixel is shifted to that pixel, nearby pixels are checked counter-clockwise from the previous outline direction (the direction "2"), and this is repeated until reaching the tracing start pixel. Performing such processing yields an outline such as illustrated in FIG. 20 by the arrow group.

The outline data thus obtained is stored in the RAM, and subsequently judgement is made regarding whether this outline data is a solid area or not. The judging method for this is carried out by counting the number of pixels within the outline. Specifically, first, the number of pixels continuing in the X direction are counted. This counting is performed for jN lines. For example, in FIG. 20, counting is performed by saying there are three pixels in line No. j1, there are five pixels in line No. j2, and so forth. Next, the total of the counted pixel numbers is compared with a predetermined threshold value, and in the event that the total number exceeds the threshold value the area within the outline area is judged to be a solid area. On the other hand, in the event that the total number is smaller than the threshold value the area within the outline area is judged to be a non-solid area. That is, with this solid area detection, judgement is made regarding whether the area within the outline is greater than a predetermined threshold value or not. Then, in the same manner as above, in the event that the area is judged to be a solid area, the second recording mode is set, and in the event that the area is judged to be a non-solid area, the first recording mode is set.

Also, though this first embodiment states that the processing such as detecting the solid areas and setting the recording modes, etc., is performed at the side of the host computer 1710, an arrangement may be made wherein programs for executing these various types of processing are stored in the memory unit of the printer, thereby executing the processing on the printer side. Further, though this first embodiment states that this processing is performed based on software using programs, by the MPU 1700 stored in the ROM 1701 shown in FIG. 17, dedicated circuits for performing this processing may be provided at the printer side and carried out by hardware.

According to the present embodiment as described above, at the time of recording an image using a high-density head wherein recording ink discharging nozzles and clear ink discharging nozzles are alternately arrayed, solid areas which do not require high resolution are recorded with both recording ink and clear ink, and non-solid areas which do require high resolution are recorded with recording ink alone, thereby forming solid areas with sufficient printing concentration without losing recording speed, and also forming non-solid areas with high resolution. Accordingly, the present embodiment is capable of high-resolution image recording in a short period of time. Further, owing to the configuration of the head, the recording ink dots discharged in the same main scan are not adjacent, thereby allowing blurring of the recording ink dots to be reduced, and further the resolution is not excessively high, so shifting of discharged ink dots can also be made to be inconspicuous.

Second Embodiment

Next, the second embodiment of the present invention will be described. With this second embodiment, character areas are recorded with a first recording mode, and picture areas (non-character areas) are recorded with a second recording mode. Particularly, a case of recording an image wherein character areas and picture areas both exist in a mixed manner will be described here. This description of the present embodiment will be made with reference to FIGS. 17, 18, and 22.

Figure 22:
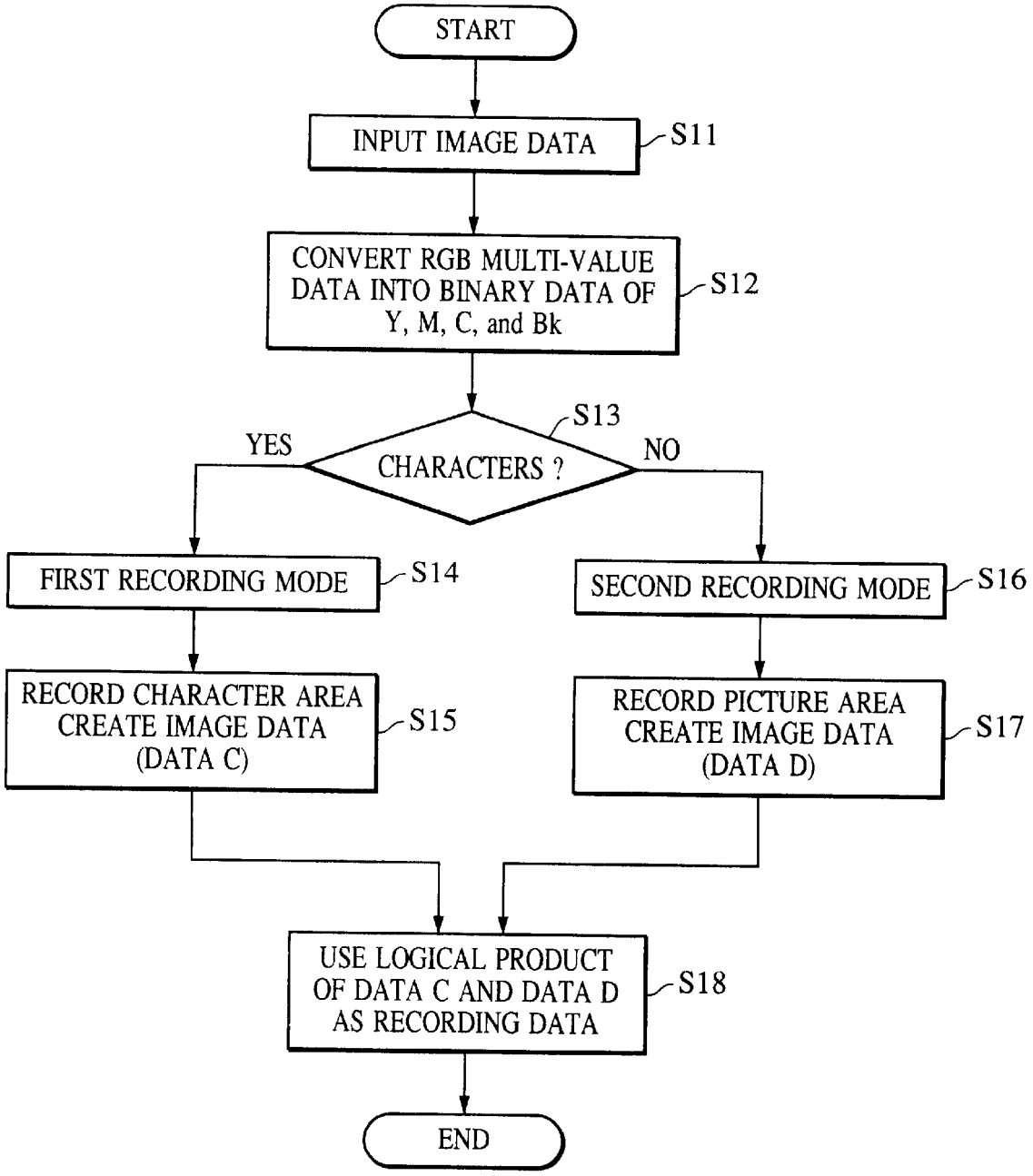
FIG. 22 is a flowchart illustrating the processing procedures relating to a second embodiment.

FIG. 22 is a flowchart illustrating the processing procedures of the second embodiment, and programs for executing this processing are stored in the ROM 1701 shown in FIG. 17. Also, the flowchart shown in FIG. 22 is executed by the MPU 1710.

First, in step S1, the image input apparatus 150 reads the original, and inputs the image. The original is a full-color image having many colors wherein character areas and picture areas are mixed, such as a photogravure magazine image for example. The full-color image read by the image input apparatus 150 is converted into digital data, and is input to the host computer 1710 as multi-value RGB image data via the interface unit 1703. Next, in step S12, the input multi-value RGB image data is converted into binary Y, M, C, and Bk data by the image processing unit 1704, which can be output by the ink-jet recording apparatus 100. Subsequently, in step S13, the character judgement is performed for each of the binarized Y, M, C, and Bk data, whether or not the data is character data.

In the event the area is a character area with characters, the flow proceeds to step S14, and settings are made so as to record the character area with the first recording mode. That is to say, the area judged as being a character area is recorded only with recording ink. Following setting the first recording mode in step S14, the recording image data for recording the character area is created in step S15. The data obtained here will be referred to as Data C. Subsequently, the flow proceeds to step S18.

On the other hand, in the event the area is a picture area without characters, the flow proceeds to step S16, and settings are made so as to record the picture area with the second recording mode. That is to say, the area judged as being a picture area is recorded with both recording ink and clear ink. Following setting the second recording mode in step S16, the recording image data for recording the picture area is created in step S17. The data obtained here will be referred to as Data D. Subsequently, the flow proceeds to step S18.

In step S18, the character area data and the picture area data are joined. Specifically, the logical product of the data C obtained for recording character areas and the data D obtained for recording picture areas is obtained, and this is used as recording data.

The recording data thus obtained is transferred to the ink-jet recording apparatus 100 via the interface unit 1703, and recording is performed at the ink-jet recording apparatus. According to the above, the character areas are recorded with recording ink alone, and the picture areas are recorded with both recording ink and clear ink, thereby forming a recorded image.

Figure 23:
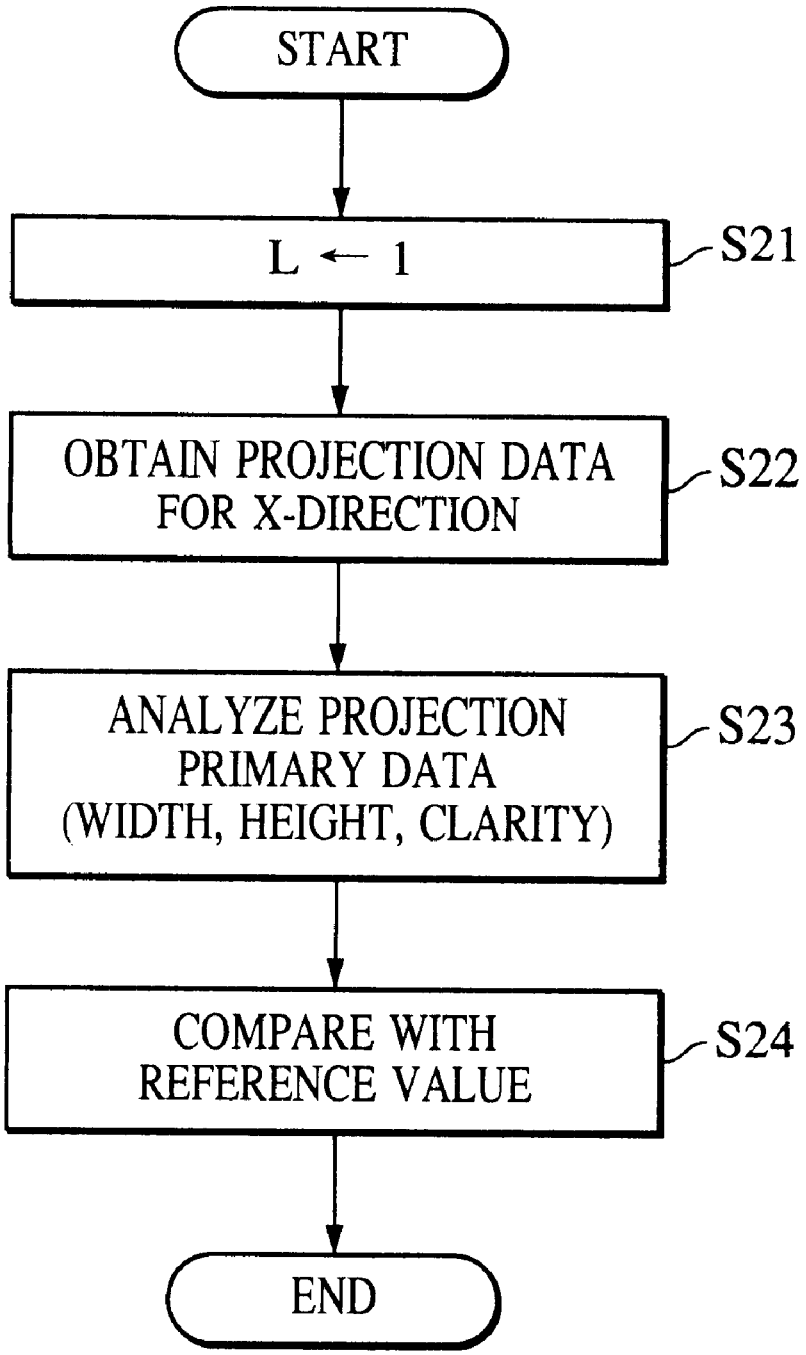
FIG. 23 is a flowchart illustrating the processing procedures of character judging in FIG. 22.
Figure 24:
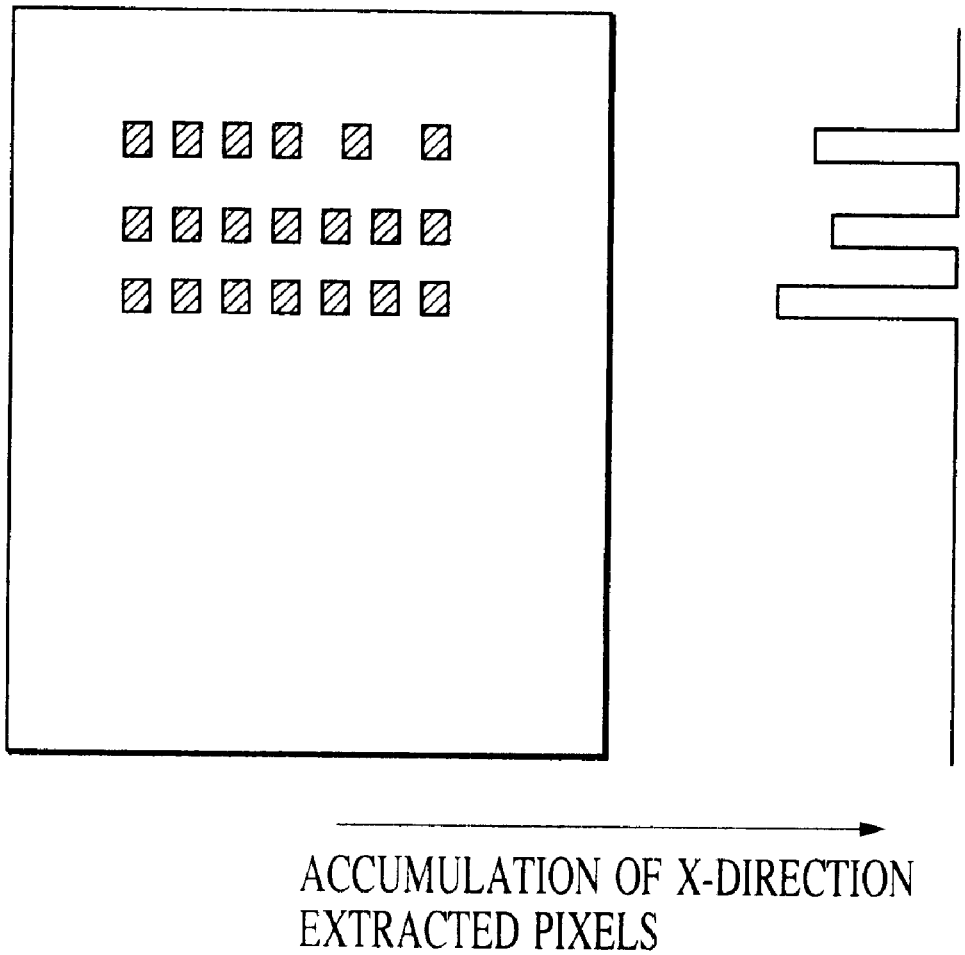
FIG. 24 is a diagram conceptually illustrating projected one-dimensional data in the X-direction.
Figure 25:
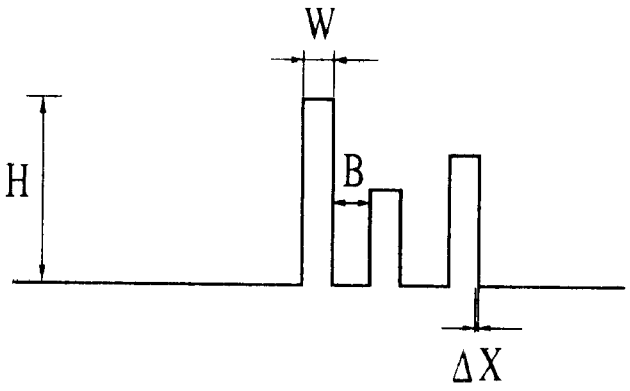
FIG. 25 is a diagram conceptually illustrating the characteristics amount gathered from the projection data.

Now, the character judging in step S13 shown in FIG. 22 will be described. Specifically, this is executed according to the processing procedures shown in the flowchart in FIG. 23. First, in step S21, the value of the counter L is set to "1". Next, in step S22, the projected one-dimensional data in the X-direction is obtained for the binary data of the color of interest, as shown in FIG. 24. Then, in step S23, the data form (width W, breadth B, height H, sharpness H/dx) of the projected one-dimensional data is measured, as shown in FIG. 25.

Figure 26:
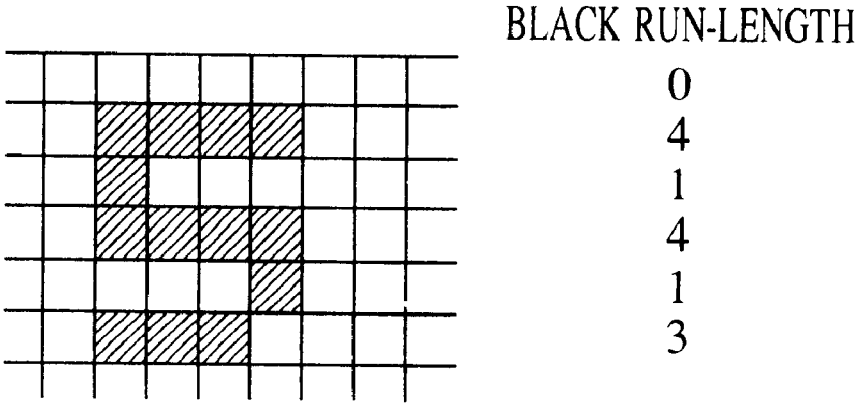
FIG. 26 is a diagram for describing another method for performing character determination.
Figure 27:
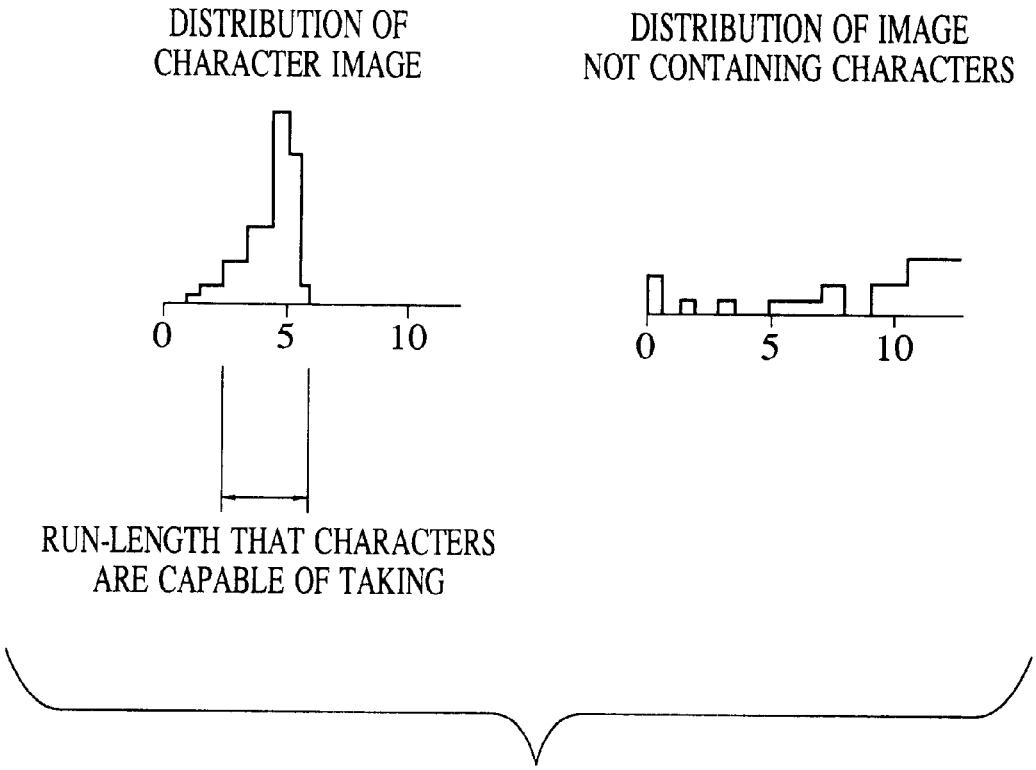
FIG. 27 is a diagram for describing another method for performing character determination.

In step S24, the width W, spacing B, height H, and sharpness H/dx, which are the results of form measurement, are compared with preset reference values, thereby judging whether the data is characters or not. For example, characters are almost always printed in lines, so characters can be judged from the width W and height T of the projected data in the X-direction. That is, in the event that the width W and height H data are approximately the same, that area is judged as a character area. Thus, character judging is carried out. Also, the steps for performing character judging, i.e., steps S22, S23, and S24 may be carried out with other methods, e.g., the run-length frequency distribution (FIG. 27) shown in FIG. 26 may be analyzed to this end.

Now, the reason why the picture area is recorded with both recording ink and clear ink and the character area is recorded with recording ink alone, will be described. This is due to the fact that there is gradation in picture areas, and on the other hand there is no gradation in character areas. Generally, there is gradation in picture areas such as photographic images or the like, and the picture area is formed by recording multi-gradient data of different gradient levels. Accordingly, in the event of recording picture areas, gradation representation is required. Particularly, in order to obtain images of even higher quality, the number of gradients which can be represented should be great. Accordingly, since the present embodiment is suitable for making high-gradation representations, both recording ink and clear ink are used for recording the picture areas. On the other hand, characters are recorded with a constant gradient level, and do not require representations in gradation. Accordingly, recording ink alone is used for recording the character areas which do not require gradation representations. Clearer characters can be formed by recording using recording ink alone.

As described above, according to the present embodiment, the number of gradients which can be represented is increased using both recording ink and clear ink, thus forming high-quality picture areas. Now, the reason why the number of gradients which can be represented increases by using both recording ink and clear ink, in comparison with using only recording ink, will be described with reference to FIGS. 28A through 33.

Figures 28A, 28B, 28C:
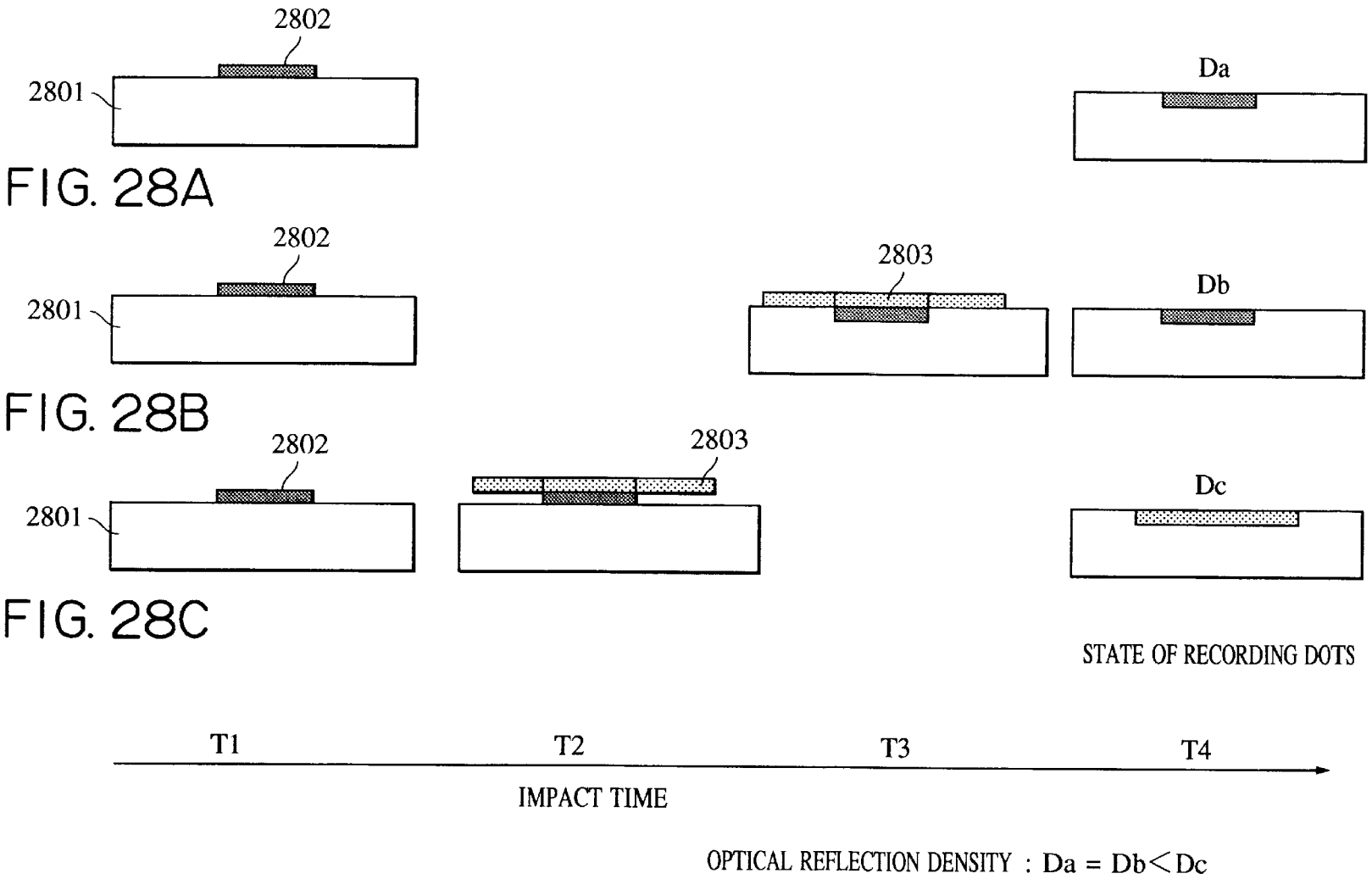
FIGS. 28A through 28C are diagrams illustrating the manner in which the recording dot covering state changes by bringing clear ink and a recorded dot into contact.

FIGS. 28A through 28C are diagrams illustrating the manner in which the recording dot covering state changes by bringing clear ink and a recorded dot formed of recording ink into contact. In FIGS. 28A through 28C, reference numeral 2801 denotes a cross-section of the recording medium, reference numeral 2802 denotes a recording dot which has landed on the recording medium, and reference numeral 2803 denotes clear ink which has been provided so as to come into contact with the recording dot. Also, FIG. 28A represents a case wherein only a recording dot has been recorded on the recording medium, FIG. 28B represents a case wherein clear ink is recorded over the recording dot after a sufficient amount of time (T3) has elapsed following the recording dot landing on the recording medium, and FIG. 28C represents a case wherein clear ink is recorded over the recording dot immediately after (T2) the recording dot landing on the recording medium. Also, Da, Db, and Dc represent the optical reflection density of the recording dots according to the recording conditions shown in FIGS. 28A through 28C. Note that Da, Db, and Dc are measured at a time T4 following a sufficient amount of time having elapsed from the time T1 at which the recording dot has landed and the times T2 and T3 at which the clear ink has landed. In other words, measurements are made after the change in the covering state of the recording dot due to the clear ink has finished.

With the case of FIG. 28B, clear ink is recorded over the recording dot after a sufficient amount of time has elapsed following the recording dot landing on the recording medium, so there is hardly any change in the covering state of the recording dot. Accordingly, the covering state of the recording dot is almost the same as the case shown in FIG. 28A wherein only a recording dot has landed. On the other hand, with the case shown in FIG. 28C, the clear ink is discharged before the ink completely seeps into the recording medium, so the recording dot spreads according to the clear ink. In this case, the optical reflection density is such that Da=Db<Dc holds. The present invention takes advantage of the fact that Da=Db<Dc holds for the optical reflection density. That is, this arrangement takes advantage of the fact that the optical reflection density increases in accordance with an increase in the area covered by the recording dot.

In this way, the present embodiment increases the covering area of the recording dot with the clear ink, and the present embodiment increases the number of gradients which can be represented by using this and thus allows a smoother gradation to be represented. This will be described with reference to FIGS. 29A through 29D.

FIGS. 29A through 29D are dot patterns wherein recording dots and clear ink dots are positioned within a dot matrix. The optical reflection density in the event that four recording dots are printed within a 4×4 matrix as shown in FIG. 29A is D1, the optical reflection density in the event that four clear ink dots are printed near four recording dots as shown in FIG. 29B is D2, and the optical reflection density in the event that eight clear ink dots are printed near four recording dots as shown in FIG. 29C is D3. These are in a relation wherein D1<D2<D3 holds. It is though that the relation between the size of the recording dots that have landed on (adhered to) the recording medium, the form thereof, the area covered thereby, and the mechanism of seeping into the recording medium and the like, affect this process. Particularly, it is thought that a phenomena occurs wherein the covering effect of the recording dots increases by the dot form spreading sideways on the surface of the recording medium and the dot diameter increasing, thus increasing the "bulk" of optical reflection density.

Generally, with an arrangement such as shown in FIG. 29A wherein four recording dots are printed within a dot matrix, in the event that one desires to represent a gradient value with concentration one step higher than this, five recording dots are situated within the dot matrix as shown in FIG. 29D. With the optical reflection density of this FIG. 29D as D4, the relation of the optical reflection density is such that D1<D4 holds, as a matter of course. Conventionally, the gradients between D1 and D4 could not be represented with ink of a single concentration, but according to the present embodiment, the fact that the above D2 and D3 are intermediate between D1 and D4, i.e., the fact that D1<D2<D3<D4 holds for the relation of the optical reflection density, is used to represent the gradients from D1 to D4. Thus the number of gradients which can be represented is increased. However, note that simplistic addition of clear ink does not automatically yield the intermediates having optical reflection density between D1 and D4. As can be understood from the relation between D2 and D3, the optical reflection density changes according to the number of clear ink dots caused to land, so the amount of clear ink with which the recording dots are brought into contact, i.e., the number of clear ink dots, must be controlled in order to represent such intermediate tones. Changing the number of clear ink dots landing on the recording medium allows the desired number of gradients to be obtained.

Observing the state of the recording dots having color material upon the recording medium shows that a recording dot which has landed on the surface of the recording medium is hardly ever a perfect circle. Normally, on plain paper (PPC paper), the color material may seep in following the shape of fibers in the paper, or may have parts wherein the color material seeps in deeply at one place and other parts wherein the color material bleeds at the surface; i.e., the shape is usually very complex. That is, the recorded dot has a complex shape on the surface of the recording medium. Bringing the clear ink on the surface of the recording medium into positional contact with a recording dot having such a complex shape changes the form of the recording dot on the surface of the paper. Specifically, enlargement of the diameter of the dot can be observed by more of the color material seeping long the fibers of the paper. Also, the dot border portion blurs, which serves to reduce the grainy appearance of the recorded dots in highlight portions.

Figure 30A:
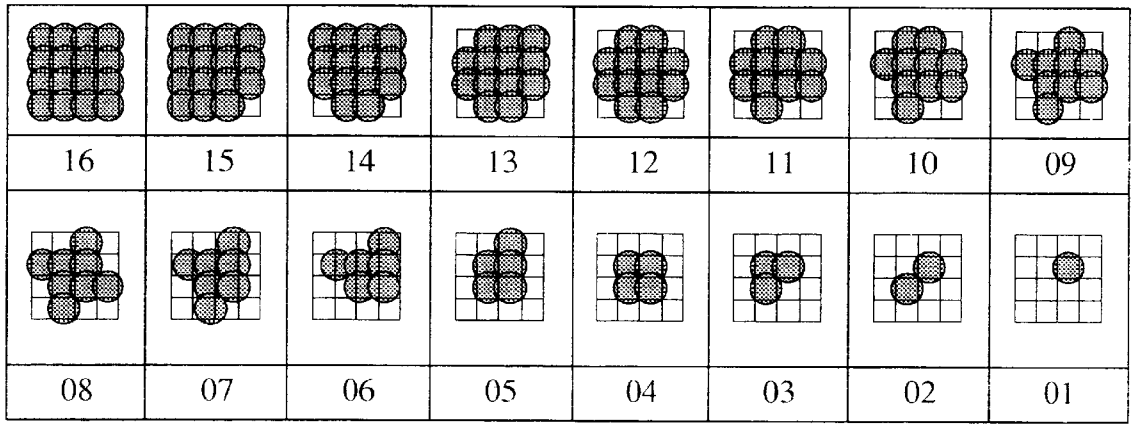
FIGS. 30A and 30B are diagrams illustrating examples of dot patterns representing gradients.
Figure 30B:
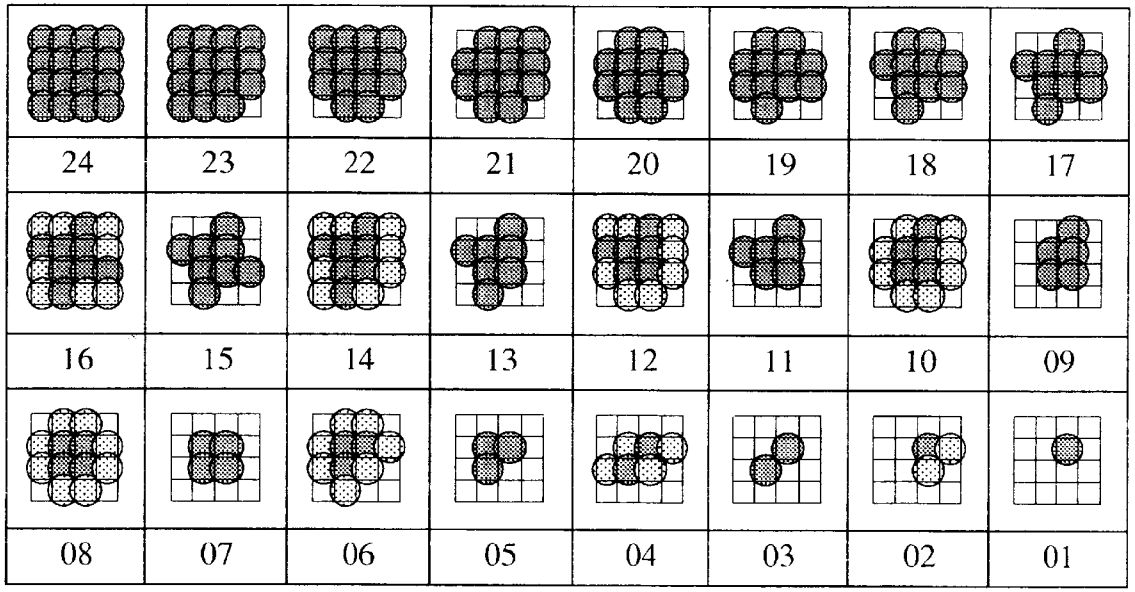
Figure 31A:
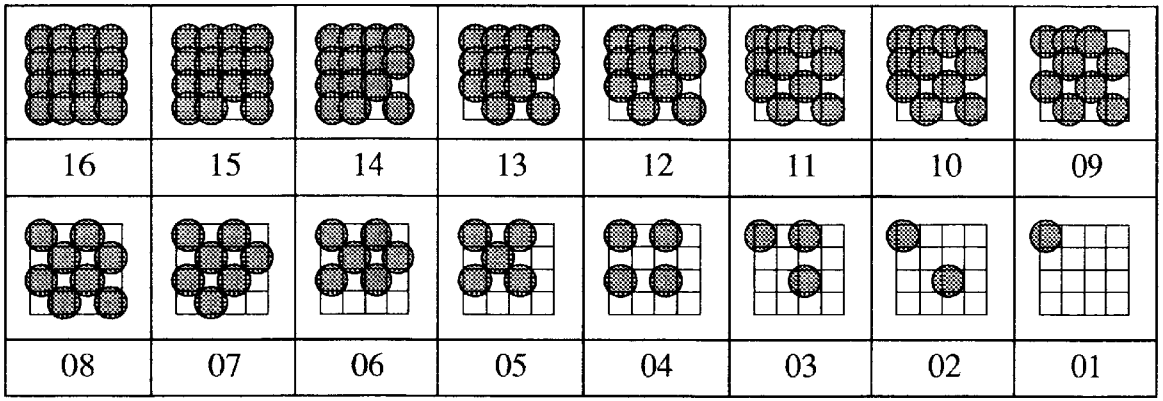
FIGS. 31A and 31B are diagrams illustrating examples of dot patterns representing gradients.
Figure 31B:
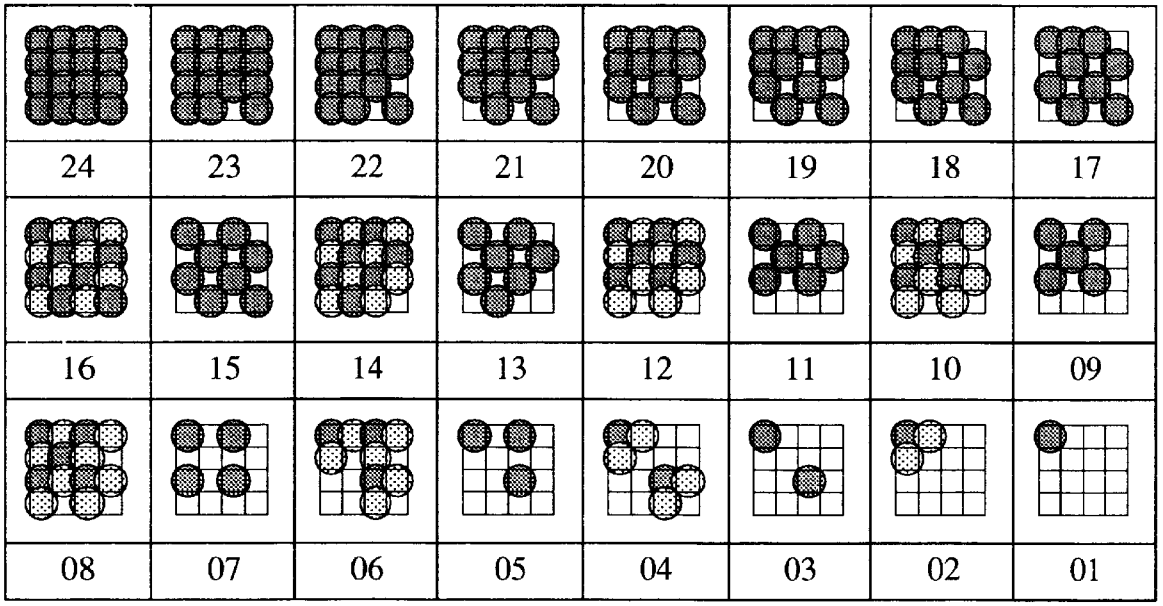

Thus, according to the present embodiment, the number of gradients which can be represented is increased as compared to the gradient representation using recording dots alone, by means of making gradient representations using both recording dots and clear dots. For example, in the event of representing gradient values using a 4×4 dot matrix such as shown in FIGS. 30A through 31B, normally, a system of dot patterns for 16 gradient values can be conceived, as shown in FIGS. 30A and 31A. However, in the event of making gradient representations using both the recording dots and clear ink dots, 25 gradients can be represented as shown in FIGS. 30B and 31B. Note however, the gradients shown in FIGS. 30B and 31B are cases wherein clear ink is applied to dot patterns with gradient values of "16" or below. Using clear ink at the time of recording highlight portions reduces the grainy appearance of the recording dots in the highlight portions. Also, increasing the number of gradients enables smoother gradation representations to be made, thus yielding high-quality images.

Also, in the event of recording dot patterns such as shown in FIGS. 30A through 31B using the recording head according to the present invention such as shown in FIG. 1, these dot patterns such as shown in FIGS. 30A through 31B cannot be recorded with a single main scan of the recording head (one-pass), due to the dot placement of the recording dots and clear ink dots. Accordingly, the dot patterns shown in FIGS. 30A through 31B are recorded using the multi-pass method. However, the dot patterns usable with the present embodiment are not restricted to those shown in FIGS. 30A through 31B, and it is needless to say that dot patterns with dot placement of the recording dots and clear ink dots other than those shown in FIGS. 30A through 31B can be used. In such cases, one-pass recording can be realized by using dot patterns arranged such that one-pass recording can be made.

Figure 32:
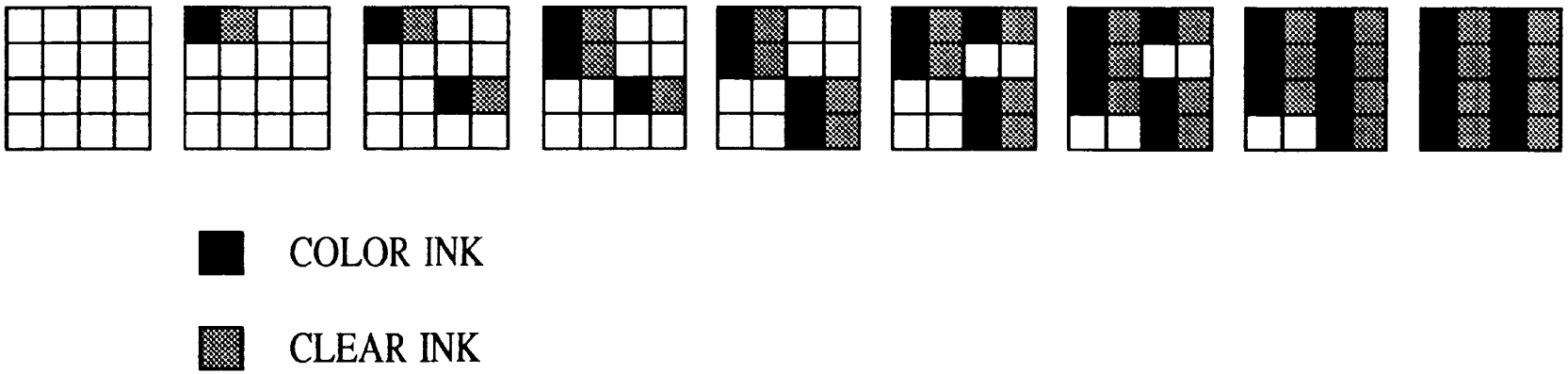
FIG. 32 is a diagram illustrating examples of dot patterns representing gradients.
Figure 33:
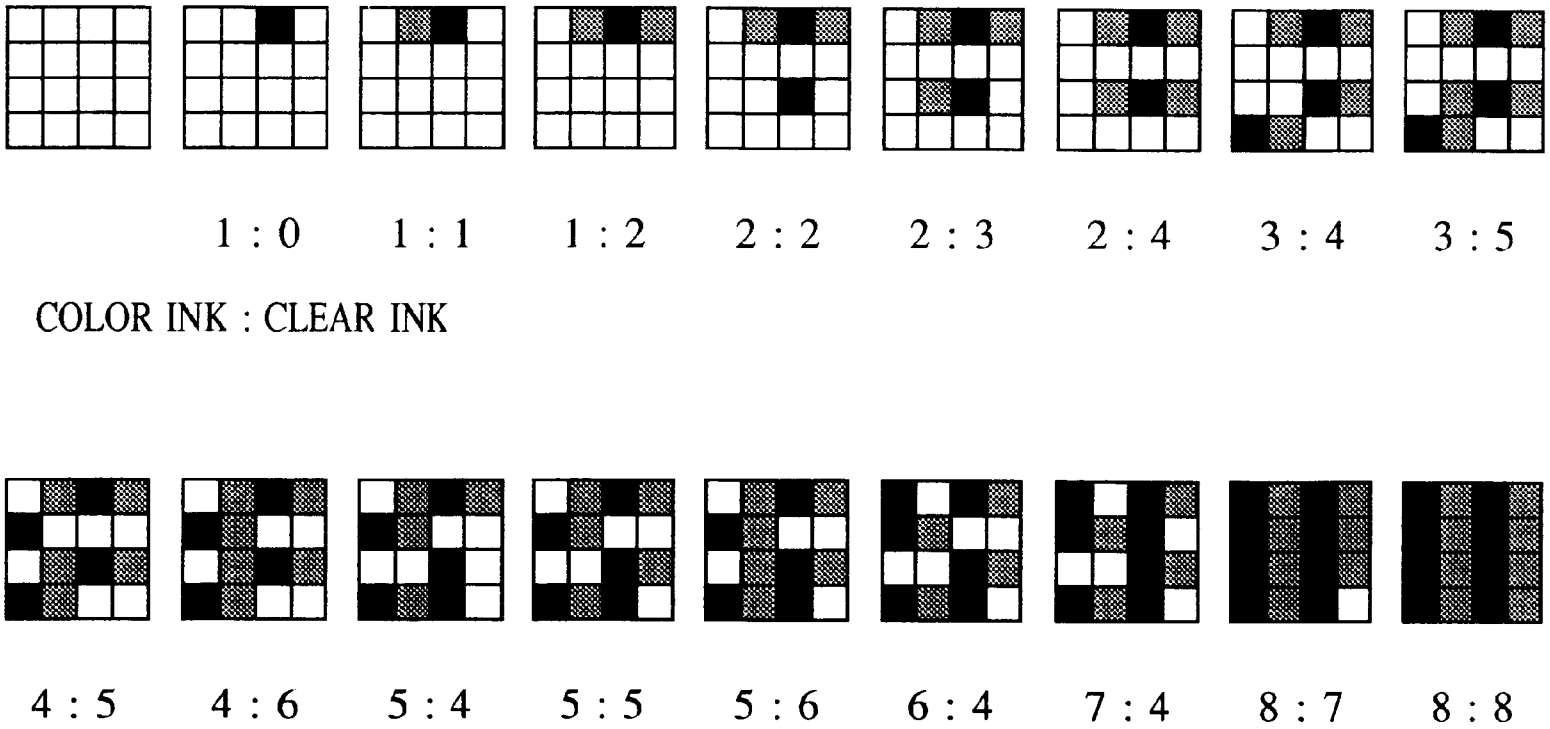
FIG. 33 is a diagram illustrating examples of dot patterns representing gradients.

Also, examples of other dot patterns are shown in FIGS. 32 and 33. FIG. 32 shows dot patterns for 9 gradient values, with the ratio of the recording ink dots and the clear ink dots constantly being 1:1. Also, FIG. 33 shows dot patterns for 18 gradient values, with the ratio of the recording ink dots and the clear ink dots changing in the manner of 1:1, 1:2, 2:3, 3:4, and so forth. Thus, the ratio of the recording ink dots and the clear ink dots may be constant as shown in FIG. 32 or may change as shown in FIG. 33, but in the event that representation of a greater number of gradients is desired, the arrangement shown in FIG. 33 is preferable. Note that all dot patterns shown in both FIG. 32 and FIG. 33 can be made with one-pass recording.

Thus, according to the present embodiment, the number of gradients can be increased without changing the size of the dot matrix corresponding to one pixel, i.e., without reducing the output resolution, and thus picture areas with excellent gradation can be formed. Also, the recording ink and clear ink are mixed so the difference in concentration between the gradients is reduced, and the problem with using concentration ink, i.e., the problem that great difference in concentration between the gradients with concentration ink leads to the switchover portion (border portion) between the high concentration ink and low concentration ink in the recorded image becoming conspicuous, thereby causing deterioration of image quality, does not occur.

With the present embodiment, a first recording mode and second recording mode are set according to whether an area is a character area or a picture area. Specifically, in the event that the area is a character area, the first recording mode is set, and in the event that the area is a picture area, the second recording mode is set. The reason that the settings are made thus is due to the fact that generally, there is no gradation in character areas, and on the other hand, there is gradation in picture areas, as described above. In this light, the second embodiment can be viewed as an arrangement wherein the recording mode settings are made according to whether or not there are gradients. Accordingly, the second embodiment can be based on the state of gradients, and the recording mode is set according to whether there are gradients or not. In this case, the gradient levels of the image data are focused upon, and in the event that the gradient level is constant the recording is made with the first recording mode, and in the event that there is change in the gradient level the recording is made with the second recording mode. Specifically, first, the gradient level for each pixel in the input multi-value RGB image data is detected. Next, judgement is made regarding whether or not the same gradient level is continuous in the X and Y directions for a predetermined number of pixels. Then, in the event that judgement is made that the level is continuous, that area is judged as being a non-gradient area, and so the first recording mode is set for recording with the recording ink alone. On the other hand, in the event that judgement is made that the level is not continuous, that area is judged as being a gradient area, and so the second recording mode is set for recording with both the recording ink and clear ink. Thus, recording modes can be set according to whether or not there are gradients. Now, examples of image with no gradients may be, e.g., text, charts, tables, poster-tone images, and so forth.

Also, though this second embodiment states that the above processing such as detecting the character areas and setting the recording modes, etc., is performed at the side of the host computer 1710, an arrangement may be made wherein programs for executing these various types of processing are stored in the memory unit of the printer, thereby executing the processing on the printer side. Further, this second embodiment states that this processing is performed based on software by programs, by the MPU 1700 stored in the ROM 1701 shown in FIG. 17, but dedicated circuits for performing this processing may be provided at the printer side and carried out by hardware.

Also, the flowchart shown in FIG. 22 relating to the second embodiment of the present invention shows the host computer automatically setting the first recording mode and the second recording mode according to the input image data (i.e., whether character area or picture area), but the present embodiment is not restricted to this. Rather, an arrangement may be made wherein the user sets the first recording mode and the second recording mode. In this case, an arrangement may be conceived wherein switches or panels are provided in the ink-jet recording apparatus, thereby setting the mode. Or, the user may make the settings from a printer driver which processes within the host computer. In the event of the user making the settings in this way, there is the advantage that the image can be output according to the usage and preferences of the user. On the other hand, in the event that the host computer automatically makes the settings, the user does not have to do anything, so there is the advantage that user operations are simple.

Also, the above description has been made regarding a case of recording an image wherein character areas and picture areas are mixed, but the present embodiment is by no means restricted to this, and can be applied to recording of images consisting of text alone or images consisting of pictures alone, as a matter of course.

According to the present embodiment as described above, at the time of recording an image using a high-density head wherein recording ink discharging nozzles and clear ink discharging nozzles are alternately arrayed, non-character areas (picture areas) which require gradients are recorded with both recording ink and clear ink, and character areas which do not require gradients are recorded with recording ink alone, thereby forming picture areas with excellent gradients, and also forming clear characters with a constant gradient level. Accordingly, even in the event of recording images wherein picture areas and character areas are mixed, using the present embodiment allows high-quality images having picture areas with excellent gradients and clear characters to be obtained.

Third Embodiment

With the above first embodiment and second embodiment, one-pass recording is made by selecting either the first recording mode or the second recording mode. According to the first embodiment and second embodiment, one-pass recording is often sufficient since images with sufficiently high quality can be formed in a short time. However, depending on the usage and preference of the user or according to the image to be recorded, there are cases wherein it is preferable that an image with higher quality be formed even if the recording time is longer. In such cases, multi-pass recording is preferable. That is, a third recording mode and a fourth recording mode are set and used for recording. Note that in the event that the third recording mode is set, the area of concern is recorded multiple times using the recording ink alone, and in the event that the fourth recording mode is set, the area of concern is recorded multiple times using both the recording ink and clear ink. Setting of the third recording mode and fourth recording mode may be made by a user making the settings from switches or panels provided in the ink-jet recording apparatus, or the user may make the settings from a printer driver which processes within the host computer. Also, as with the first embodiment and second embodiment, the host computer or ink-jet recording apparatus may automatically made the settings, according to the image data. In this case, an arrangement may be made wherein either one of the third recording mode and fourth recording mode is always selected, or an arrangement may be made wherein one of the first, second, third, or fourth recording modes is set according to the image data.

According to the present embodiment as described above, using the third recording mode or fourth recording mode which records using the multi-pass method allow an image with higher quality than that formed by the first embodiment and second embodiment, even though the recording time is longer than that of the first embodiment and second embodiment.

Fourth Embodiment

Next, the fourth embodiment of the present invention will be described. With this fourth embodiment, the user selects the mode for the type of image to be recorded (i.e., document, photograph, mixed, etc.) and the image quality and recording time (high-quality mode or high-speed mode) according to the usage and preferences of the user, and the first, second, third, or fourth recording modes are set according to the selection results.

Figure 34:
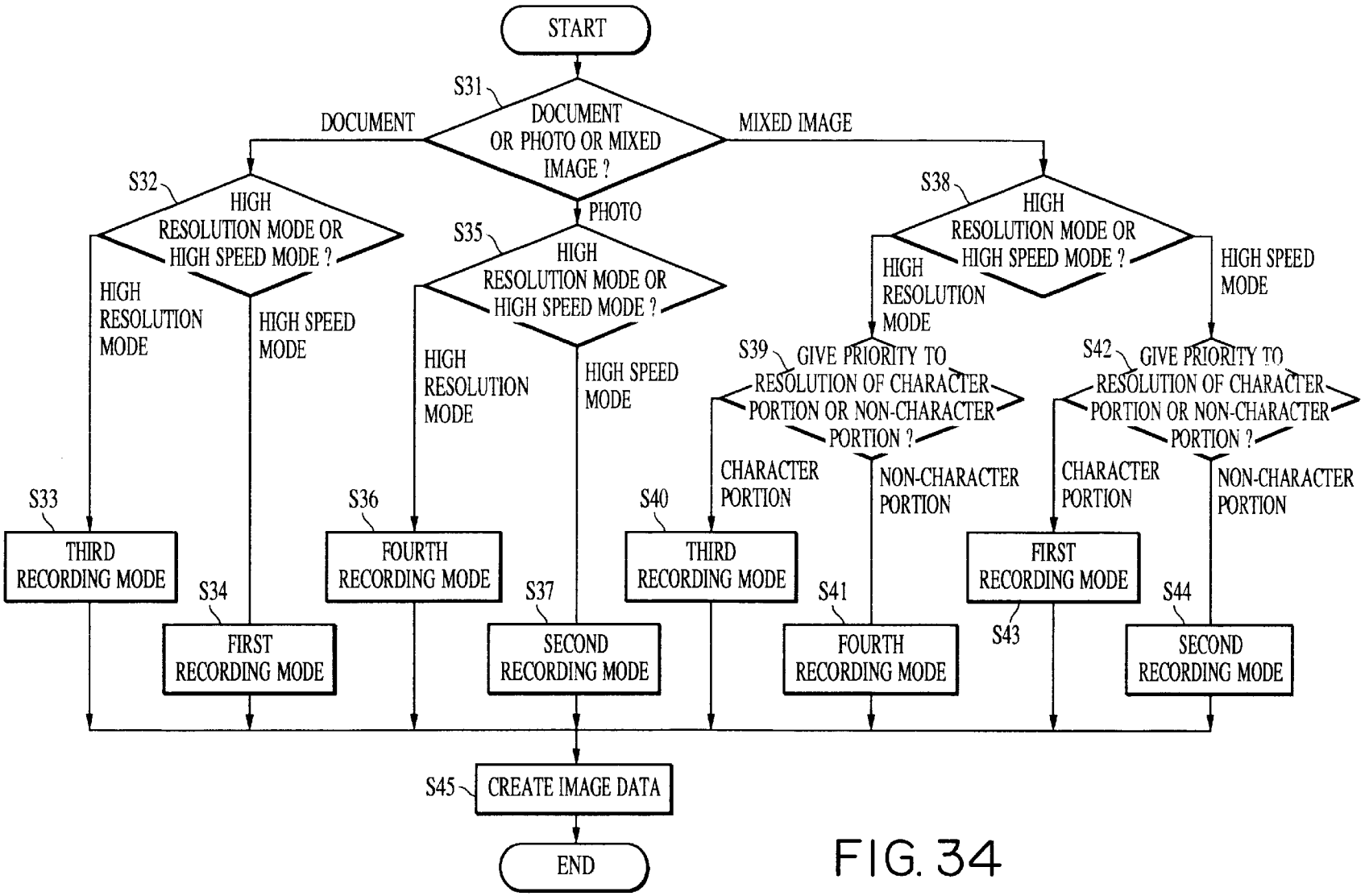
FIG. 34 is a flowchart illustrating a fourth embodiment.

FIG. 34 is a flowchart illustrating the fourth embodiment, and the present embodiment will be described with reference to FIG. 34. Here, the type of images listed as examples will be the three of documents, photographs, and mixed images (i.e., images wherein characters, illustrations, tables, photographs, etc., exist in a mixed manner).

First, in step S31, the user selects the image mode indicating the type of image such as documents, photographs, or mixed images, according to the image to be recorded. In the event that "document" is selected, the flow proceeds to step S32. In step S32, selection is made between whether to perform recording with the high-quality mode which gives priority to quality, or whether to perform recording with the high-speed mode which gives priority to speed. In the event that the high-quality mode is selected, the flow proceeds to step S33, and the third recording mode is set. That is, in the event that the user desires to record a high-quality document, recording is performed with the recording ink alone and with the multi-pass method. On the other hand, in the event that the user has selected the high-speed mode, the flow proceeds to step S34, and the first recording mode is set. That is, in the event that the user desires to record a document quickly, recording is performed with the recording ink alone and with the one-pass method.

Also, in step S31, in the event that "photograph" is selected, the flow proceeds to step S35. In step S35, selection is made between whether to perform recording with the high-quality mode which gives priority to quality, or whether to perform recording with the high-speed mode which gives priority to speed. In the event that the high-quality mode is selected, the flow proceeds to step S36, and the fourth recording mode is set. That is, in the event that the user desires to record a high-quality photograph, recording is performed with both the recording ink and clear ink and with the multi-pass method. On the other hand, in the event that the user has selected the high-speed mode, the flow proceeds to step S37, and the second recording mode is set. That is, in the event that the user desires to record a document quickly, recording is performed with both the recording ink and clear ink and with the one-pass method.

In the event that "mixed image" is selected in step S31, the flow proceeds to step S38. In step S38, selection is made between whether to perform recording with the high-quality mode which gives priority to quality, or whether to perform recording with the high-speed mode which gives priority to speed. In the event that the high-quality mode is selected, the flow proceeds to step S39, and in step S39 selection is made whether to give priority to the quality of the character portion or the non-character portion in the mixed image. In the event that selection is made to give priority to the quality of the character portion, the flow proceeds to step S40, and the third recording mode is set. That is, in the event that the user desires to give priority to the quality of the character portion in the case of high-quality recording of a mixed image with character portions and non-character portions, recording is performed with the recording ink alone and with the multi-pass method. On the other hand, in the event that selection is made to give priority to the quality of the non-character portion, the flow proceeds to step S41, and the fourth recording mode is set. That is, in the event that the user desires to give priority to the quality of the non-character portion in the case of high-quality recording of a mixed image with character portions and non-character portions, recording is performed with both the recording ink and clear ink, and with the multi-pass method.

On the other hand, in the event that the high-speed mode is selected in step S38, the flow proceeds to step S42, and in step S42 selection is made whether to give priority to the quality of the character portion or the non-character portion in the mixed image. In the event that selection is made to give priority to the quality of the character portion, the flow proceeds to step S43, and the first recording mode is set. That is, in the event that the user desires to give priority to the quality of the character portion in the case of quickly recording a mixed image with character portions and non-character portions, recording is performed with the recording ink alone and with the one-pass method. Also, in the event that selection is made to give priority to the quality of the non-character portion, the flow proceeds to step S44, and the second recording mode is set. That is, in the event that the user desires to give priority to the quality of the non-character portion in the even of quickly recording a mixed image with character portions and non-character portions, recording is performed with both the recording ink and clear ink, and with the one-pass method.

After the recording mode is set in one of the above steps S33, S34, S36, S37, S40, S41, S43, and S44, the flow proceeds to step S45, and image data is created. Then, recording based on that image data is executed by the ink-jet recording apparatus.

Thus, according to the present embodiment, the user can select the image quality, recording time, etc., so image recording can be performed according to the requests of the user.

Fifth Embodiment

Figure 48A:
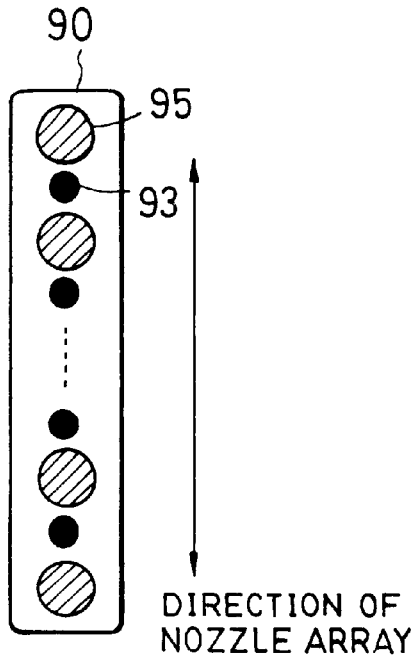
Figure 48B:
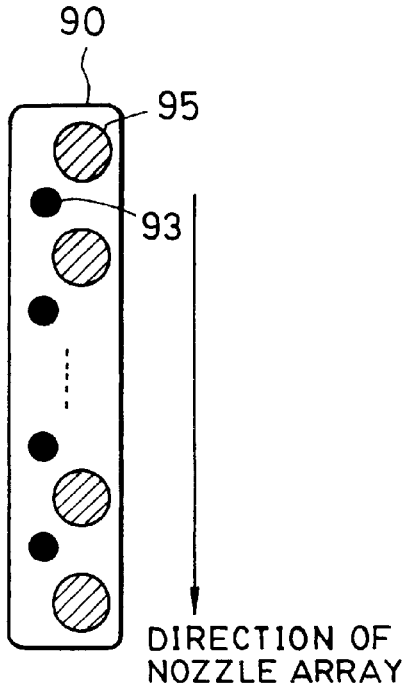
Figure 49A:
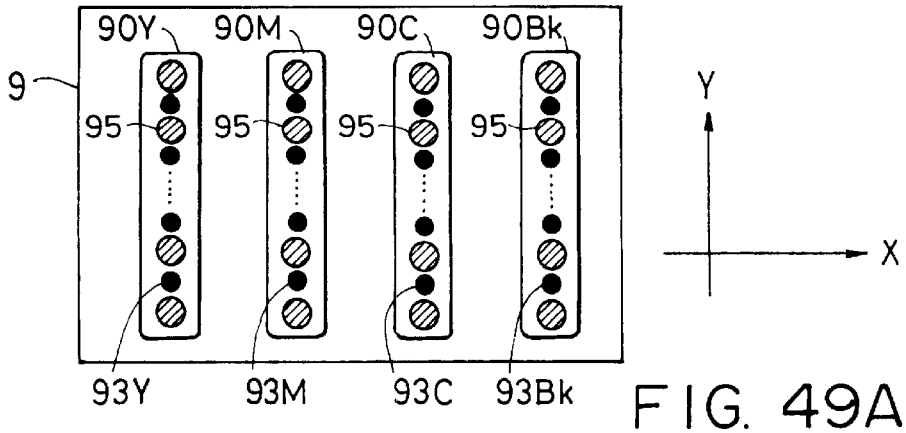
Figure 49B:
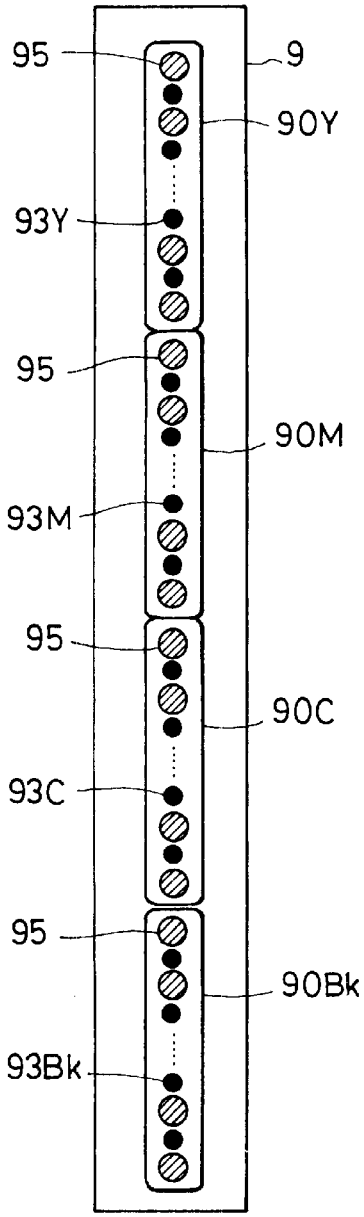
Figure 50A:
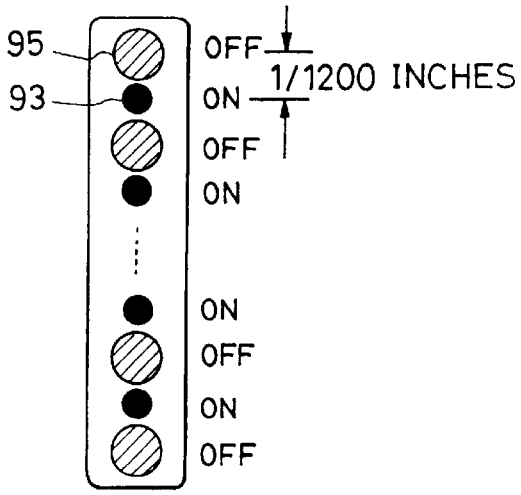
FIGS. 50A through 50D are diagrams illustrating use of a head applicable to the fifth embodiment, demonstrating a case wherein recording is performed based on a recording mode using only recording ink, and a case wherein recording is performed based on a recording mode using both recording ink and clear ink.
Figure 50B:
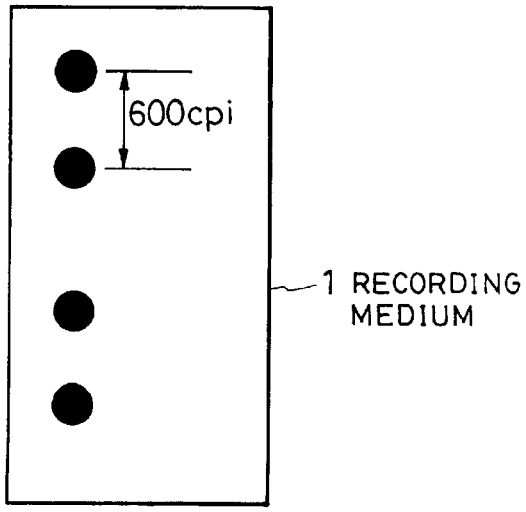
Figure 50C:
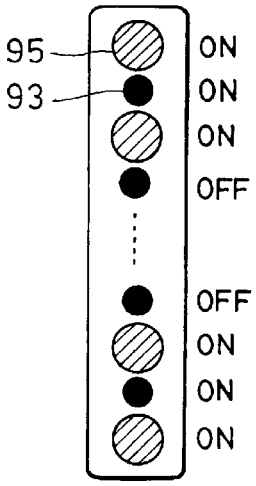
Figure 50D:
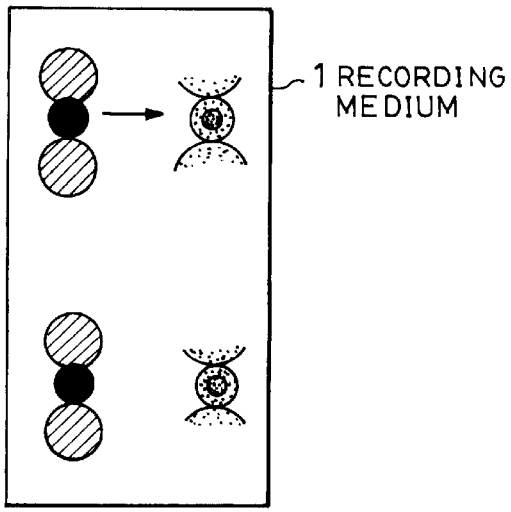

Next, the fifth embodiment of the present invention will be described. The fifth embodiment is characterized in that the amount of ink discharged from the recording ink discharging nozzles is less than the amount of ink discharged from the clear ink discharging nozzles. The present embodiment will now be described with reference to FIGS. 48A through 50D. FIGS. 48A and 48B are schematic configuration diagrams of the recording head applicable to the fifth embodiment, wherein FIG. 48A is a recording head wherein recording ink discharging nozzles with a relatively small diameter and clear ink discharging nozzles with a relatively large diameter have been linearly arrayed (linear array recording head), and FIG. 48B is a recording head wherein these nozzles are arrayed in a staggered array (staggered array recording head). FIGS. 49A and 49B are diagrams illustrating the configuration of a recording head unit 9 having multiple recording heads 90 shown in FIG. 48A, wherein FIG. 49A illustrates an arrangement wherein the linear array recording heads 90 shown in FIG. 48A are arrayed sideways in one line, and FIG. 49B illustrates an arrangement wherein the linear array recording heads 90 shown in FIG. 48A are arrayed vertically in one line. FIGS. 50A through 50D are diagrams illustrating use of a head applicable to the fifth embodiment, demonstrating a recording mode using only recording ink (FIGS. 50A and 50B), and a recording mode using both recording ink and clear ink (FIGS. 50C and 50D). In more detail, FIG. 50A illustrates a case of driving only the recording ink discharging nozzles alone which have a relatively smaller diameter, and FIG. 50B illustrates the recording ink dots which have landed on the recording medium. Also, FIG. 50C illustrates a case of driving both the recording ink discharging nozzles which have a relatively smaller diameter and the clear ink discharging nozzles which have a relatively larger diameter, and FIG. 50D illustrates the manner in which the recording ink dots which have landed on the recording medium and the clear ink dots come into contact and both dots mix.

With the present embodiment, as shown in FIGS. 48A and 48B, the diameter of the recording ink discharging nozzles is formed to be relatively smaller than the diameter of the clear ink discharging nozzles, thereby making the amount of ink discharged from the recording ink discharging nozzles to be relatively less than the amount of ink discharged from the clear ink discharging nozzles. Specifically, the configuration is set such that the radius r of the clear ink discharging nozzles and the radius R of the recording ink discharging nozzles satisfy $R \leqq 0.9\ r$. The reason that the radius R of the recording ink discharging nozzles is formed to be at least 10% smaller than the radius r of the clear ink discharging nozzles is that irregularities in the dot diameter occur on an order of several % (there are irregularities in the volume of the ink droplets discharged from the same nozzle on an order of several %, due to change in discharging power and surface tension, and effects of ink refilling according to whether a discharge has been made from that nozzle immediately prior to this discharge, and so forth, there are differences in the scattering state of the ink droplets due to the volume and the positional relation between the ink droplet and the satellite droplets which break off in mid-air, and further due to non-uniformity on the surface of the recording paper). That is, within the range of irregularities ($R>0.9\ r$), effects of relatively reducing the recording ink discharging nozzles are hardly observed at all, so the nozzle diameter is made be different to an extent exceeding the range of irregularities. Accordingly, the configuration of the present embodiment is such that $R \leqq 0.9\ r$ holds. On the other hand, the configuration is such that the lower limit of R is $0.7\ r \leqq R$. The reason that $0.7\ r \leqq R$ is used is that in the event that the diameter of the recording ink discharging nozzles is made to be any smaller than the diameter of the clear ink discharging nozzles, the clear ink dots become too great as compared to the recording ink dots, making accurate gradient representation difficult. Thus, with the present embodiment, with the radius of the clear ink discharging nozzles as r, and with the radius of the recording ink discharging nozzles as R, the configuration is made to satisfy $0.7\ r \leqq R \leqq 0.9\ r$.

Also, the above description involves relatively differing the diameter of the recording ink discharging nozzles and the diameter of the clear ink discharging nozzles so as to relatively differ the amount discharged by each, but the present embodiment is not restricted to this; rather an arrangement may be made wherein the nozzle diameters do not differ, and that the discharging amounts of the nozzles simply differ. An example of a method for differing the discharging amounts of the nozzles is realized by changing the pulse width, driving voltage, etc., of the driving pulses applied to the discharging nozzles. Here, according to the present embodiment, the discharging amount per droplet of recording ink is made to be smaller than the discharging amount per droplet of clear ink. Specifically, with the discharging amount of clear ink as $V_1$, control is made of the discharging amount of recording ink $V_2$ such that $V_2 \leqq 0.8\ V_1$. The reason that $V_2 \leqq 0.8\ V_1$ is used is that, as described above, irregularities in the dot diameter occur on an order of several %. On the other hand, the control is made such that the lower limit of $V_2$ is $0.5\ V_1 \leqq V_2$. The reason that $0.5\ V_1 \leqq V_2$ is used is that in the event that the discharging amount of the recording ink is made to be any smaller than the discharging amount of the clear ink, the clear ink dots become too great as compared to the recording ink dots, making accurate gradient representation difficult. Thus, with the present embodiment, with the discharging amount of the clear ink as $V_1$, and with the discharging amount of the recording ink as $V_2$, control is made so as to satisfy $0.5\ V_1 \leqq V_2 \leqq 0.8\ V_1$.

Also, the diameter of the recording ink discharging nozzles and the diameter of the clear ink discharging nozzles according to the present embodiment are set such that the sum of the discharging amount per droplet of recording ink from a recording ink discharging nozzle and the discharging amount per droplet of clear ink from a clear ink discharging nozzle according to the present embodiment is the approximately same as the sum of the discharging amount per droplet of recording ink from a recording ink discharging nozzle and the discharging amount per droplet of clear ink from a clear ink discharging nozzle according to the first embodiment. For example, in the event that the discharging amount of recording ink and the discharging amount of clear ink according to the first embodiment are both X, the diameter of the recording ink discharging nozzles and the diameter of the clear ink discharging nozzles according to the present embodiment are set such that the discharging amount of recording ink is 0.8 X and the discharging amount of clear ink 1.2 X, for example.

Thus, according to the present embodiment as described above, the droplets of recording ink become smaller, so image recording with higher precision than that of the first embodiment can be made in the event of recording an area with recording ink alone. Also, in the event of recording a solid area with one pass, the recording ink and clear ink are mixed, so the concentration can be raised as compared to recording only with recording ink.

Sixth Embodiment

Figure 51A:
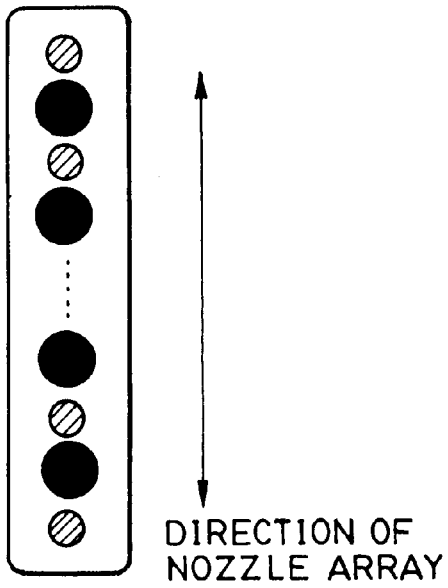
Figure 51B:
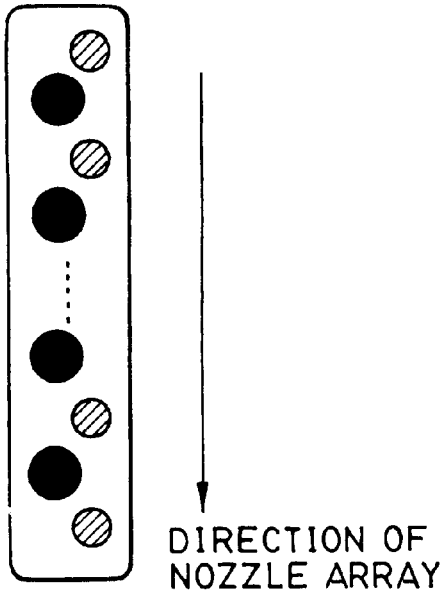
Figure 52A:
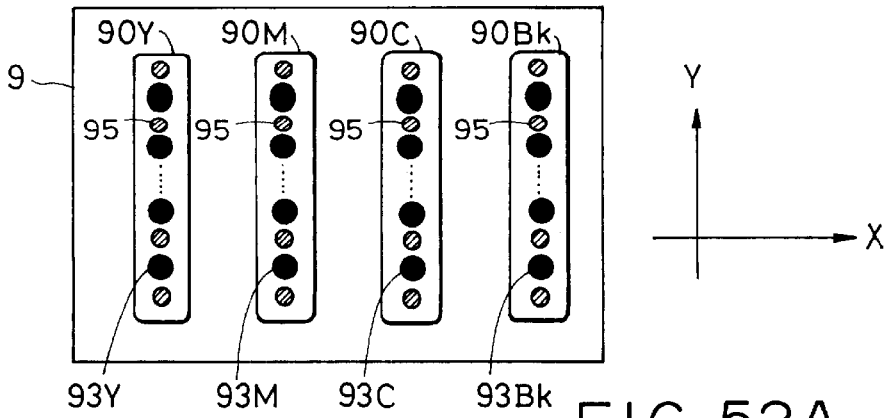
Figure 52B:
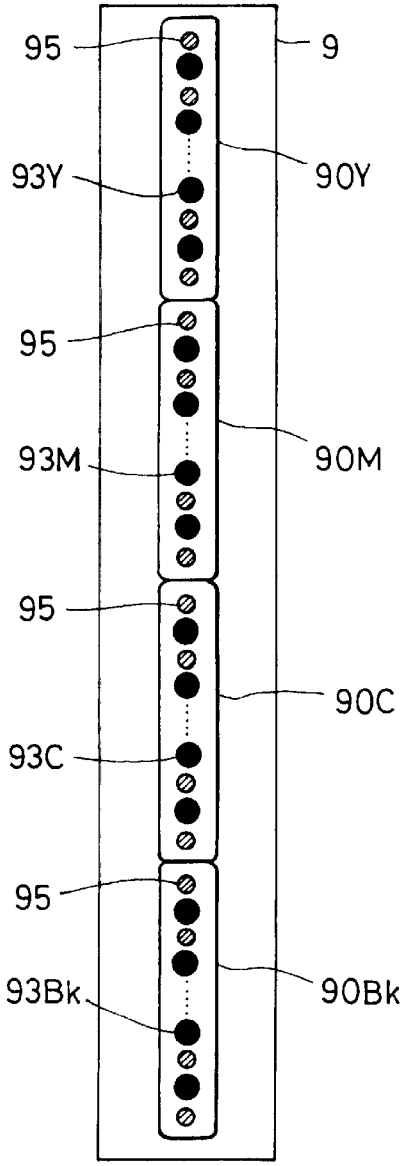
Figure 53A:
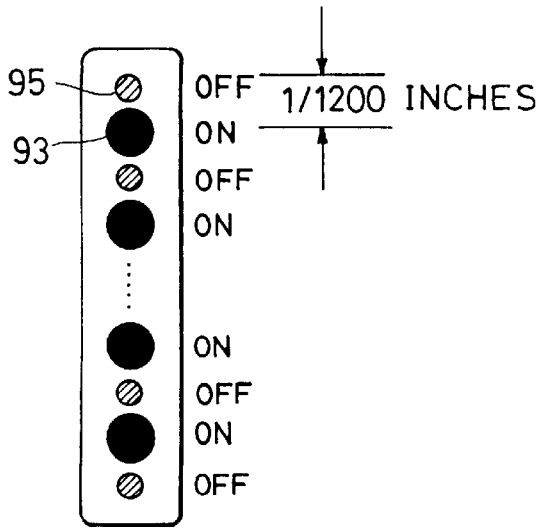
FIGS. 53A through 53D are diagrams illustrating use of a head applicable to the sixth embodiment, demonstrating a case wherein recording is performed based on a recording mode using only recording ink, and a case wherein recording is performed based on a recording mode using both recording ink and clear ink.
Figure 53B:
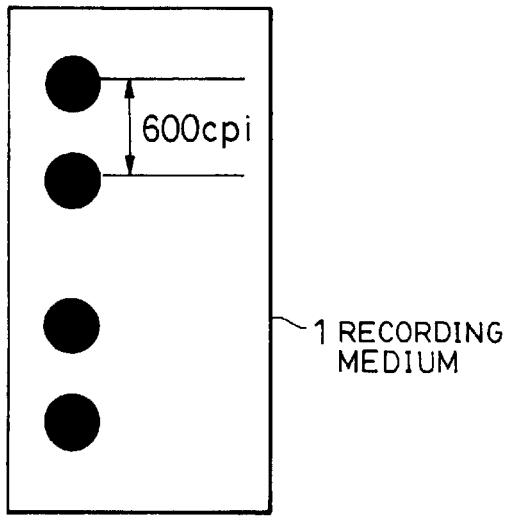
Figure 53C:
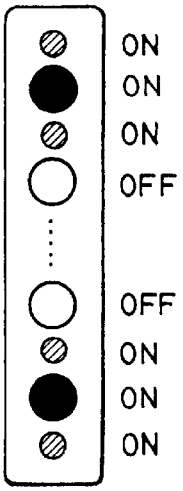
Figure 53D:
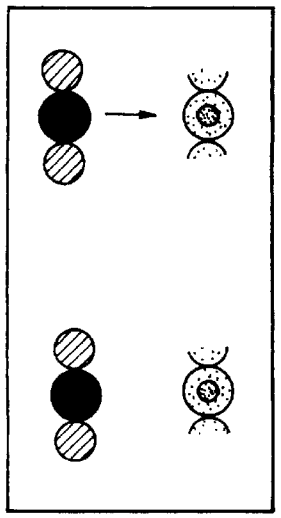

Next, the sixth embodiment of the present invention will be described. The sixth embodiment is characterized in that the amount of ink discharged from the clear ink discharging nozzles is less than the amount of ink discharged from the recording ink discharging nozzles. The present embodiment will now be described with reference to FIGS. 51A through 53D. FIGS. 51A and 51B are schematic configuration diagrams of the recording head applicable to the sixth embodiment, wherein FIG. 51A is a recording head wherein clear ink discharging nozzles with a relatively small diameter and recording ink discharging nozzles with a relatively large diameter have been linearly arrayed (linear array recording head), and FIG. 51B is a recording head wherein these nozzles are arrayed in a staggered array (staggered array recording head). FIGS. 52A and 52B are diagrams illustrating the configuration of a recording head unit 9 having multiple recording heads 90 shown in FIG. 51A, wherein FIG. 52A illustrates an arrangement wherein the linear array recording heads 90 shown in FIG. 51A are arrayed sideways in one line, and FIG. 52B illustrates an arrangement wherein the linear array recording heads 90 shown in FIG. 51A are arrayed vertically in one line. FIGS. 53A through 53D are diagrams demonstrating a recording mode using only recording ink (FIGS. 53A and 53B), and a recording mode using both recording ink and clear ink (FIGS. 53C and 53D). In more detail, FIG. 53A illustrates a case of driving only the recording ink discharging nozzles alone which have a relatively greater diameter, and 53B illustrates the recording ink dots which have landed on the recording medium. Also, FIG. 53C illustrates a case of driving both the clear ink discharging nozzles which have a relatively smaller diameter and the recording ink discharging nozzles which have a relatively larger diameter, and 53D illustrates the manner in which the recording ink dots which have landed on the recording medium and the clear ink dots come into contact and both dots mix.

With the present embodiment, the diameter of the clear ink discharging nozzles is formed to be relatively smaller than the diameter of the recording ink discharging nozzles as shown in FIGS. 51A and 51B, thereby making the amount of ink discharged from the clear ink discharging nozzles to be relatively less than the amount of ink discharged from the recording ink discharging nozzles. Specifically, the configuration is set such that the radius s of the recording ink discharging nozzles and the radius S of the clear ink discharging nozzles satisfy $S \leqq 0.9$ s. The reason that the radius S of the clear ink discharging nozzles is formed to be at least 10% smaller than the radius s of the recording ink discharging nozzles is that irregularities in the dot diameter occur on an order of several %. That is, within the range of irregularities ($S>0.9$ s), effects of relatively reducing the clear ink discharging nozzles is hardly observed at all, so the nozzle diameter is made to be different to an extent exceeding the range of irregularities. Accordingly, the configuration of the present embodiment is such that $S \leqq 0.9$ s holds. On the other hand, the configuration is such that the lower limit of S is 0.7 $s \leqq S$. The reason that $0.7\ s \leqq S$ is used is that in the event that the diameter of the clear ink discharging nozzles is made to be any smaller than the diameter of the recording ink discharging nozzles, the clear ink dots become too small as compared to the recording ink dots, resulting in the gradient not changing readily even in the event that clear dots are provided to the recording ink, consequently making accurate gradient representation difficult. Thus, with the present invention, with the radius of the clear ink discharging nozzles as s, and with the radius of the recording ink discharging nozzles as S, the configuration is made to satisfy $0.7\ s \leqq S \leqq 0.9$ s.

Also, though the above description involves relatively differing the diameter of the recording ink discharging nozzles and the diameter of the clear ink discharging nozzles, thereby differing the amount of discharge of each, the present embodiment is not restricted to this; rather, an arrangement may be made wherein the nozzle diameters do not differ, and that the discharging amounts of the nozzles simply differ. An example of a method for differing the discharging amounts of the nozzles is realized by changing the pulse width, driving voltage, etc., of the driving pulses applied to the discharging nozzles. Here, according to the present embodiment, the discharging amount per droplet of clear ink is made to be smaller than the discharging amount per droplet of recording ink. Specifically, with the discharging amount of recording ink as $N_1$, control is made of the discharging amount of clear ink $N_2$ such that $N_2 \leqq 0.8\ N_1$. The reason that $N_2 \leqq 0.8\ N_1$ is used is that, as described above, irregularities in the dot diameter occur on an order of several %. On the other hand, the control is made such that the lower limit of $N_2$ is $0.5\ N_1 \leqq N_2$. The reason that $0.5\ N_1 \leqq N_2$ is used is that in the event that the discharging amount of the clear ink is made to be any smaller than the discharging amount of the recording ink, the clear ink dots become too small as compared to the recording ink dots, resulting in the gradient not changing readily even in the event that clear dots are provided to the recording ink, consequently making accurate gradient representation difficult. Thus, with the present embodiment, with the discharging amount of the clear ink as $N_1$, and with the discharging amount of the recording ink as $N_2$, control is performed so as to satisfy $0.5\ N_1 \leqq N_2 \leqq 0.8\ N_1$.

Also, the diameter of the recording ink discharging nozzles and the diameter of the clear ink discharging nozzles according to the present embodiment are set such that the sum of the discharging amount per droplet of recording ink from a recording ink discharging nozzle and the discharging amount per droplet of clear ink from a clear ink discharging nozzle according to the present embodiment is the approximately same as the sum of the discharging amount per droplet of recording ink from a recording ink discharging nozzle and the discharging amount per droplet of clear ink from a clear ink discharging nozzle according to the first embodiment. For example in the event that the discharging amount of recording ink and the discharging amount of clear ink according to the first embodiment are both X, the diameter of the recording ink discharging nozzles and the diameter of the clear ink discharging nozzles according to the present embodiment are set such that the discharging amount of clear ink is 0.8 X and the discharging amount of recording ink is 1.2 X.

Thus, according to the present embodiment as described above, the amount of discharged recording ink increases, so image recording with higher concentration than that of the first embodiment can be made.

Seventh Embodiment

Next, the seventh embodiment of the present invention will be described. This seventh embodiment is characterized in that clear ink is discharged at the border portion between scans or the area thereabout, in order to reduce concentration irregularities (border streaks) which occur at such portions. The following is a description of the present embodiment, with reference to FIGS. 54A through 59.

Figure 54A:
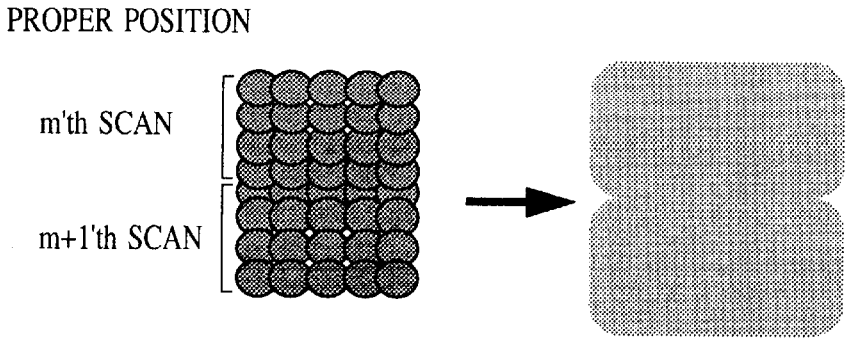
FIGS. 54A through 54C are diagrams illustrating recording images with a conventional recording method, with two scans.
Figure 54B:
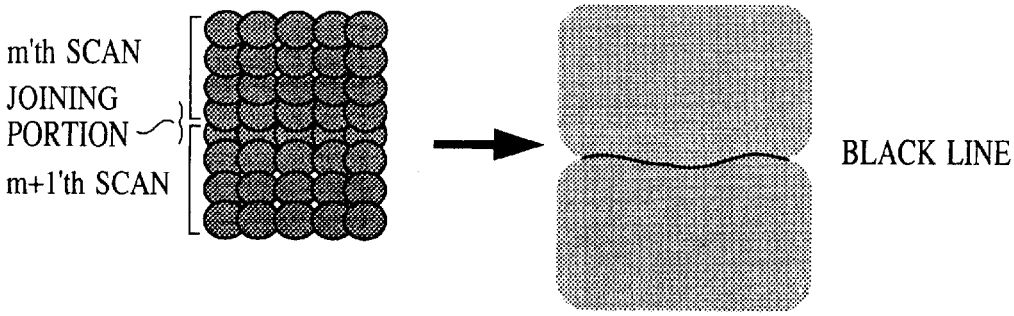
Figure 54C:
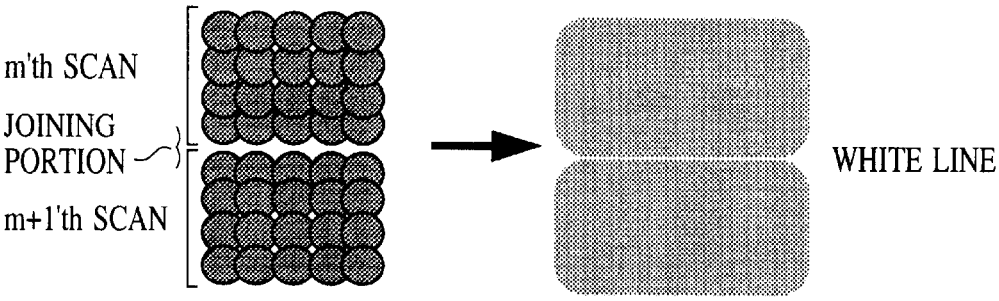

First, before describing the present embodiment, the conventional art will be described. FIGS. 54A through 54C are diagrams illustrating recording with a conventional recording method, with two scans. FIG. 54A illustrates the state wherein the recording dot has landed at the proper position, so there are no image defects such as streaks or irregularities at the border portion between scans, and the overall image is also uniform without concentration irregularities. The dots ideally should land at the proper positions as shown in FIG. 54A, but in reality, discharge shifting occurs and the paper feeding precision is insufficient, so the landing positions of the ink become irregular. FIGS. 54B and 54C illustrate states wherein image defects have occurred at the border potions due to irregularities in the landing positions. In FIG. 54B, at the border between the m'th scan and the m+1'th scan, adjacent dots have overlapped excessively, thereby forming a black streak at the border portion thereof. On the other hand, in FIG. 54C, at the border between m'th scan and the m+1'th scan, adjacent dots have opened excessively, thereby forming a white streak at the border portion thereof. In this way, the conventional method sometimes had problems in black streaks or white streaks occurring at the border portion between scans.

Figures 1, 2, 3, 55A:
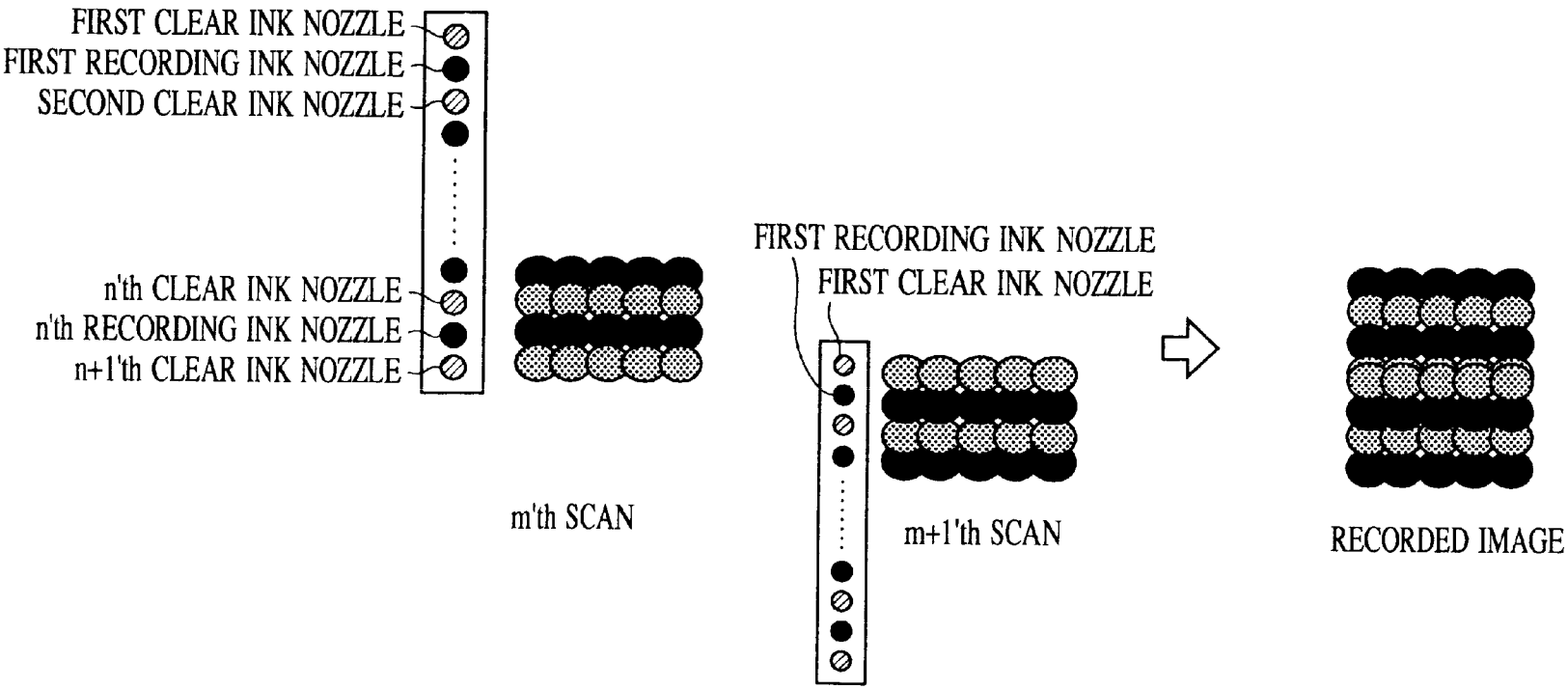

Accordingly, with the present embodiment, clear ink is discharged at the border portion between the scans, as shown in FIGS. 55A-1 through 55C-3. FIGS. 55A-1 through 55A-3 illustrate a case wherein there is no occurrence of ink shifting or the like, and the ink has landed at the proper position (target position). Here, the clear ink dot discharged from the n+1'th clear ink nozzle in the m'th scan and the clear ink dot discharged from the 1st clear ink nozzle in the m+1'th scan overlap. FIG. 55A-3 illustrates an image recorded by the recording ink and clear ink landing at the target positions. In this case, both the recording ink and clear ink have landed at the target positions, so there are no image defects such as streaks or irregularities.

Figures 1, 55B:
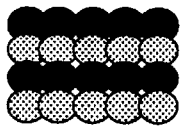
Figures 2, 55B:
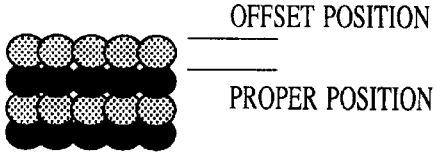
Figures 3, 55B:
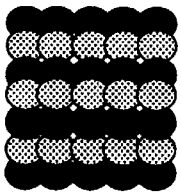

FIGS. 55B-1 through 55B-3 illustrate a case wherein, at the border between the m'th scan and the m+1'th scan, the recording ink and clear ink discharged in the m'th scan and the recording ink and clear ink discharged in the m+1'th scan have come together, such that the recording ink and clear ink overlap excessively at this border portion. Here, not only does the clear ink dot discharged from the 1st clear ink nozzle in the m+1'th scan overlap with the clear ink dot discharged from the n+1'th clear ink nozzle in the m'th scan, it also overlaps with the recording ink dot discharged from the n'th recording ink nozzle in the m'th scan, as well. FIG. 55B-3 illustrates an image recorded by the recording ink and clear ink overlapping excessively at the border portion. In conventional arrangements, in the event that the recording ink dots landing in the m'th scan and the m+1'th scan were too close, this resulted in the concentration at this portion becoming too high which caused irregularities in concentration such as black streaks, but with the present embodiment shown in FIGS. 55B-1 through 55B-3, clear ink has landed between the recording ink dots which are thus blurred by the clear ink, thereby lowering the concentration at the border portion, so irregularities in concentration due to excessive overlapping of the recording ink dots can be suppressed.

Figures 1, 55C:
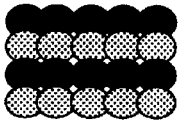
Figures 2, 55C:
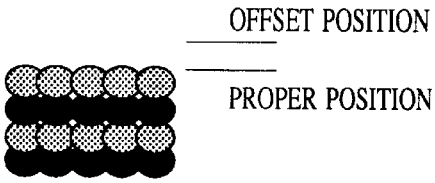
Figures 3, 55C:
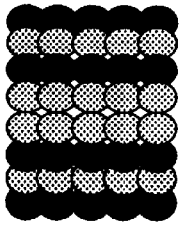

FIGS. 55C-1 through 55C-3 illustrate a case wherein, at the border between the m'th scan and the m+1'th scan, the clear ink discharged in the m'th scan and the clear ink discharged in the m+1'th do not overlap. Specifically, the clear ink dot discharged from the 1st clear ink nozzle in the m+1'th scan does not overlap with the clear ink dot discharged from the n+1'th clear ink nozzle in the m'th scan. Also, the distance between the recording ink dot discharged from the lst recording ink nozzle in the m+1'th scan and the recording ink dot discharged from the n'th recording ink nozzle in the m'th scan is farther than the stipulated distance, and the recording ink dots are distanced one from another. In conventional arrangements, gaps between the dots resulted in irregularities in concentration such as white streaks, but with the present embodiment shown in FIGS. 55C-1 through 55C-3, clear ink has landed between the recording ink dots thereby blurring the recording ink with the clear ink and enlarging the diameter of the recording ink dots, and gaps do not readily occur between the recording ink dots even if distanced, so irregularities in concentration can be suppressed.

Figure 56:
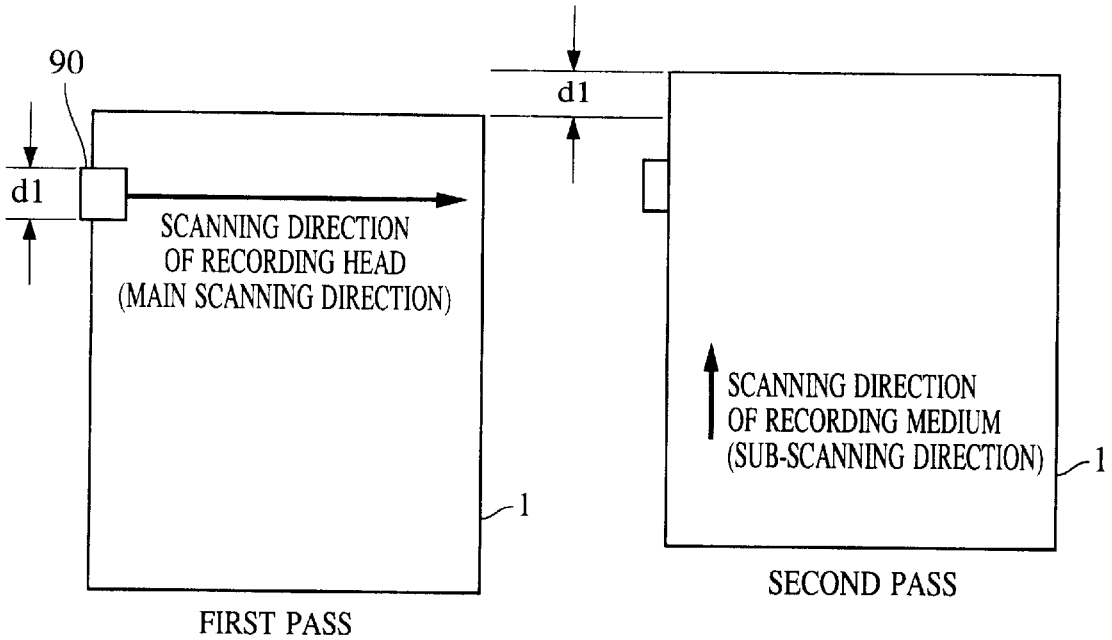
FIG. 56 is a diagram for describing one-pass recording wherein the recording head is relatively scanned only once as to the areas other than the border areas between the scans, thereby performing image recording.
Figure 56:
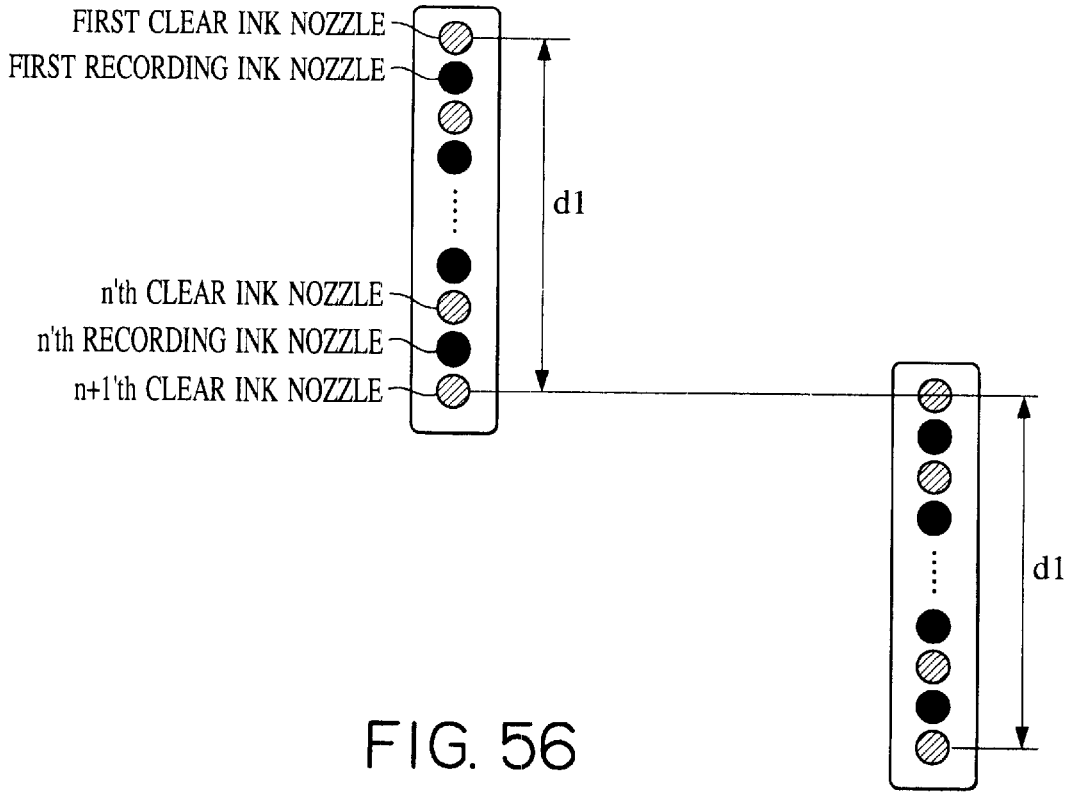
Figure 57:
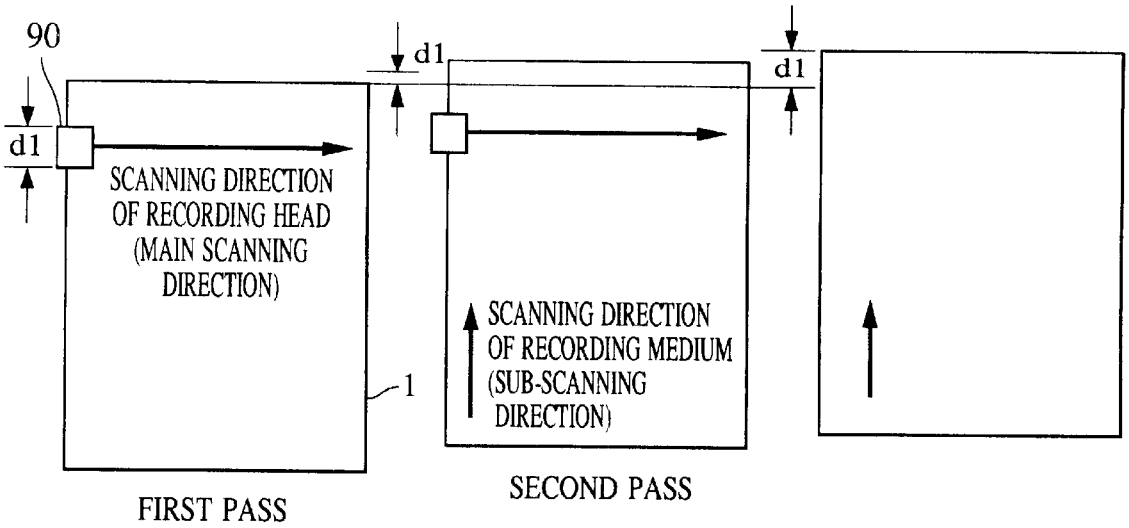
FIG. 57 is a diagram for describing two-pass recording wherein the recording head is relatively scanned twice as to the areas other than the border areas between the scans, thereby performing image recording.
Figure 57:
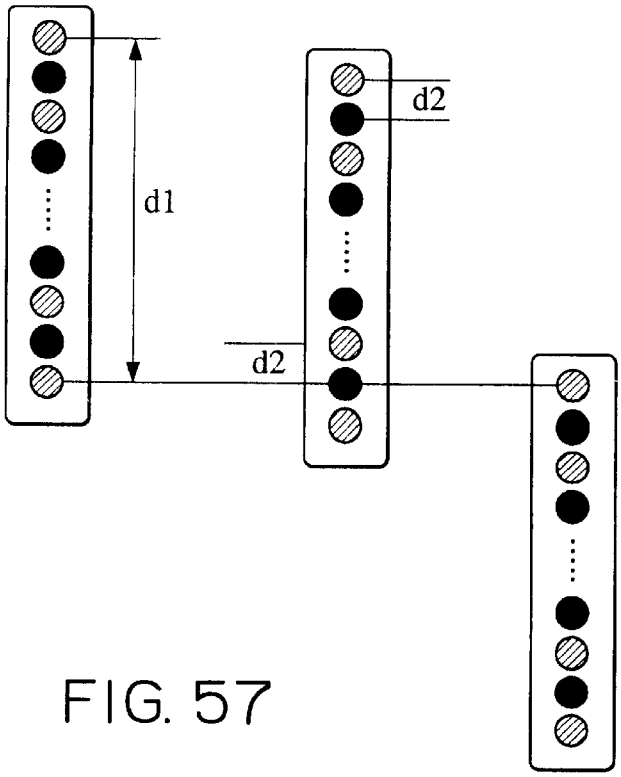

Next, a case of performing one-pass recording with the recording method of the present embodiment and a case of performing two-pass recording therewith, will be described. FIG. 56 is a diagram for describing one-pass recording wherein the recording head is relatively scanned only once as to the areas other than the border areas between the scans, thereby performing image recording. FIG. 57 is a diagram for describing two-pass recording wherein the recording head is relatively scanned twice as to the areas other than the border areas between the scans, thereby performing image recording. As shown in FIG. 56, in the event of one-pass recording, the recording medium is sub-scanned by a first amount in a direction generally orthogonal to the main scanning direction, each time the recording head performs one main scan. This first amount is the same as the distance between the centers of the discharge openings of the clear ink nozzles positioned at both edges of the recording head (i.e., the first clear ink nozzle and the n+1'th clear ink nozzle). That is to say, each time the recording head performs one main scan, the recording medium is sub-scanned by the amount d1 shown in the Figure. The reason that the sub-scanning amount is set at d1 in the Figure is in order to make the area scanned by the n+1'th clear ink nozzle in the previous main scan and the area to be scanned by the 1st clear ink nozzle in the next main scan to be the same. In other words, the sub-scanning amount is set at d1 in order to make the clear ink nozzle at one edge of the recording head and the clear ink nozzle at the other edge thereof scan the same area in previous and successive main scans. Setting the sub-scanning amount to d1 allows the clear ink dots to be overlapped at the border portion, thereby reducing irregularities in concentration at the border in one-pass recording as well. Also, in the event of two-pass recording, as shown in FIG. 57, the recording head makes one main scan, following which the recording medium is sub-scanned by a second amount (d2), and the then recording head makes another main scan, following which the recording medium is sub-scanned by a third amount (d1–d2). This is repeated to record the image. This d2 is the distance between the centers of the discharge openings of adjacent ink nozzles and clear ink nozzles. That is, here, the recording medium is sub-scanned by only the distance of one nozzle. Setting the sub-scanning amount thus means that recording ink nozzles and clear ink nozzles each scan once at areas other than the border portion, and consequently, the overall concentration of the image can be improved. Also, the recording ink and clear ink can be overlapped at the border portion as well, so reduction in irregularities in concentration can be made at the border portion. Incidentally, while the above arrangement involves sub-scanning of only one nozzle, the present embodiment is not restricted to this; rather, sub-scanning of multiple nozzles may be made instead. Also, the present embodiment is not restricted to one-pass recording and two-pass recording, multiple pass recording such as three-pass recording, four-pass recording, etc., may be performed.

Thus, according to the present embodiment, control is performed so as to discharge clear ink at the border portion between scans or the area thereabout, thereby reducing concentration irregularities which readily occur at such portions.

Eighth Embodiment

The present embodiment is characterized in that image recording is performed with recording ink alone in the event of recording image edge portions requiring high resolution, and image recording is performed with both recording ink and clear ink in the event of recording non-edge portions or solid portions not requiring high resolution.

First, the first recording mode which uses only recording ink will be described with reference to FIGS. 13A and 13B. This first recording mode is applied in the event that the edge portions of an image which require high resolution, such as characters or fine lines or the like, are to be recorded. This is realized by driving only the recording ink discharging nozzles and not driving the clear ink discharging nozzles. Thus, recording dots alone are formed on the recording medium, as shown in FIG. 13B. This image formed of recording dots alone has little probability of the adjacent dots overlapping, so there is little effect of dot blurring or shifting, and further the resolution is high, so this can be called a high-quality image. Also, this is advantageous, since the dots exist in an independent state and the edge is emphasized.

Next, the second recording mode which uses both recording ink and clear ink will be described with reference to FIGS. 10A and 10B, and FIGS. 14A and 14B. This second recording mode is particularly advantageous in the event of recording the solid areas of images wherein high resolution is not necessary or non-edge portions wherein there are no gradients (i.e., the gradient level is constant). Recording a non-edge portion with the above second recording mode is realized by driving all nozzles of the head shown in FIG. 10A and FIG. 14A. Then, in order to allow the discharged recording ink and clear ink to mix in a liquid state, the recording ink and clear ink are preferably discharged in the same scan of the recording head. Thus, the recording ink and the clear ink mix in a liquid state on the recording medium, so the recording ink dot is spread by the clear ink, and the covering area of the recording ink dot becomes greater. Hence, solid images and non-edge portions can be recorded in a short time.

Now, the reason why it is advantageous to allow the recording ink and the clear ink to mix in the event of recording solid areas and non-edge portions will be described. Firstly, the recording time can be reduced. As described above, the adjacent recording ink dots themselves do not overlap according to the present embodiment, so covering a particular area on the recording medium completely with recording ink dots cannot be performed with one scan of the recording head alone. That is, only one main scan (one pass) will leave gaps between the recording ink dots, so solid images and non-edge portions cannot be recorded. In the event that the head according to the present embodiment is used and solid areas or non-edge portions are to be recorded using only the recording dots, a multi-pass method must be used for recording, meaning a longer recording time. Now, mixing the recording ink and the clear ink so as to allow the covering area of the recording ink to expand permits the solid area or non-edge portion to be recorded with a single main scan of the recording head. Secondly, this is advantageous since the recording concentration can be improved. In the event that the head according to the present embodiment is used and a solid area or non-edge portion is to be recorded using only the recording ink dots, only one scan of the recording head will leave gaps between the adjacent dots, resulting in a lower recording concentration. Thus, mixing the recording ink and the clear ink so as to allow the covering area of the recording ink to expand realizes higher recording concentration. As described above, the present embodiment involves mixing of recording ink and clear ink, in order to record solid areas and non-edge portions with sufficient recording concentration, and in a short time.

The above first recording mode gives priority to recording speed in particular and this enables one-pass recording, but there are cases wherein one-pass recording creates gaps within dots since the adjacent dots are not in contact, and thus the image quality appears lower. Thus, in the event that an image with higher quality is desired, a recording method wherein multi-passing is applied to the first recording mode can be used. Specifically, first, as with the first recording mode, an image is formed wherein the adjacent dots are not in contact, by discharging recording ink alone for the first pass. Next, after the recording medium has been transported in the sub-scanning direction, recording ink alone is discharged in the second pass in a manner filling in between the dots recorded in the first pass. Thus, a high-resolution image with no gaps between the dots can be recorded, and a higher quality image than that achieved by recording with the first recording mode can be achieved. This recording method using the multi-pass method will be referred to as the third recording mode. Now, using this third recording mode enables higher quality images than with the first recording mode, but also leads to lower recording speed. For example, using two passes more than doubles the recording time, and using three passes more than triples the recording time. As described above, the first recording mode and the third recording mode each have advantages, so an arrangement should be made wherein this is taken into consideration and the modes are used according to whether recording speed is to be given priority or recording quality is to be given priority. Also, a recording method wherein the multi-pass method is applied to the second recording mode will be referred to as the fourth recording mode. The fourth recording mode is used along with the third recording mode. This is because both modes are multi-pass methods, and thus the number of passes can be matched. Note that even in the event that recording is performed in the fourth recording mode, the recording ink and clear ink discharged from adjacent nozzles are discharged in the same main scan of the recording head.

Thus, with the present embodiment, recording can be made with the first recording mode, the second recording mode, the third recording mode, and the fourth recording mode. Whether to set the first recording mode (or third mode) which uses only recording ink, or to set the second recording mode (or fourth mode) which uses both recording ink and clear ink, is determined according to whether the edge portions of the image are to be recorded or the non-edge portions are to be recorded. Also, whether to perform one-pass recording (i.e., to use the first recording mode and second recording mode) or to perform multi-pass recording (i.e., to use the third recording mode and fourth recording mode), is preferably determined by selection made by the user.

With the eighth embodiment according to the present invention, the first recording mode is used for edge portions for which high resolution is required, and the second recording mode is used for non-edge portions of the image for which high resolution is not required. This will be described below with reference to FIGS. 58 through 63.

First, the control configuration for executing control of the units of the ink-jet recording apparatus according to the eighth embodiment will be described with reference to the block diagram shown in FIG. 58. In this Figure illustrating the control circuit, reference numeral 2010 denotes an interface for inputting recording signals, 2011 denotes an MPU, 2012 denotes a program ROM for storing control programs to be executed by the MPU 11, and 2013 denotes a dynamic RAM for storing various types of data (the above recording signals and recording data to be supplied to the head, etc.), and printing dot numbers, number of times of replacing ink recording heads, etc., can be stored as well. Reference numeral 2014 denotes a gate array for performing supply control of recording data to the recording head 90, and also for performing transfer control of data between the interface 2010, MPU 2011, and RAM 2013. Reference numeral 7004 denotes the edge portion detecting unit, for detecting edge portions in images. Reference numeral 2020 denotes a carrier motor for transporting the recording head 90, and reference numeral 2019 denotes a transporting motor for transporting the recording paper. Reference numeral 2015 denotes a head driver for driving the head, and 2016 and 2017 respectively denote motor drivers for driving the transporting motor 2019 and carrier motor 2020.

Figure 58:
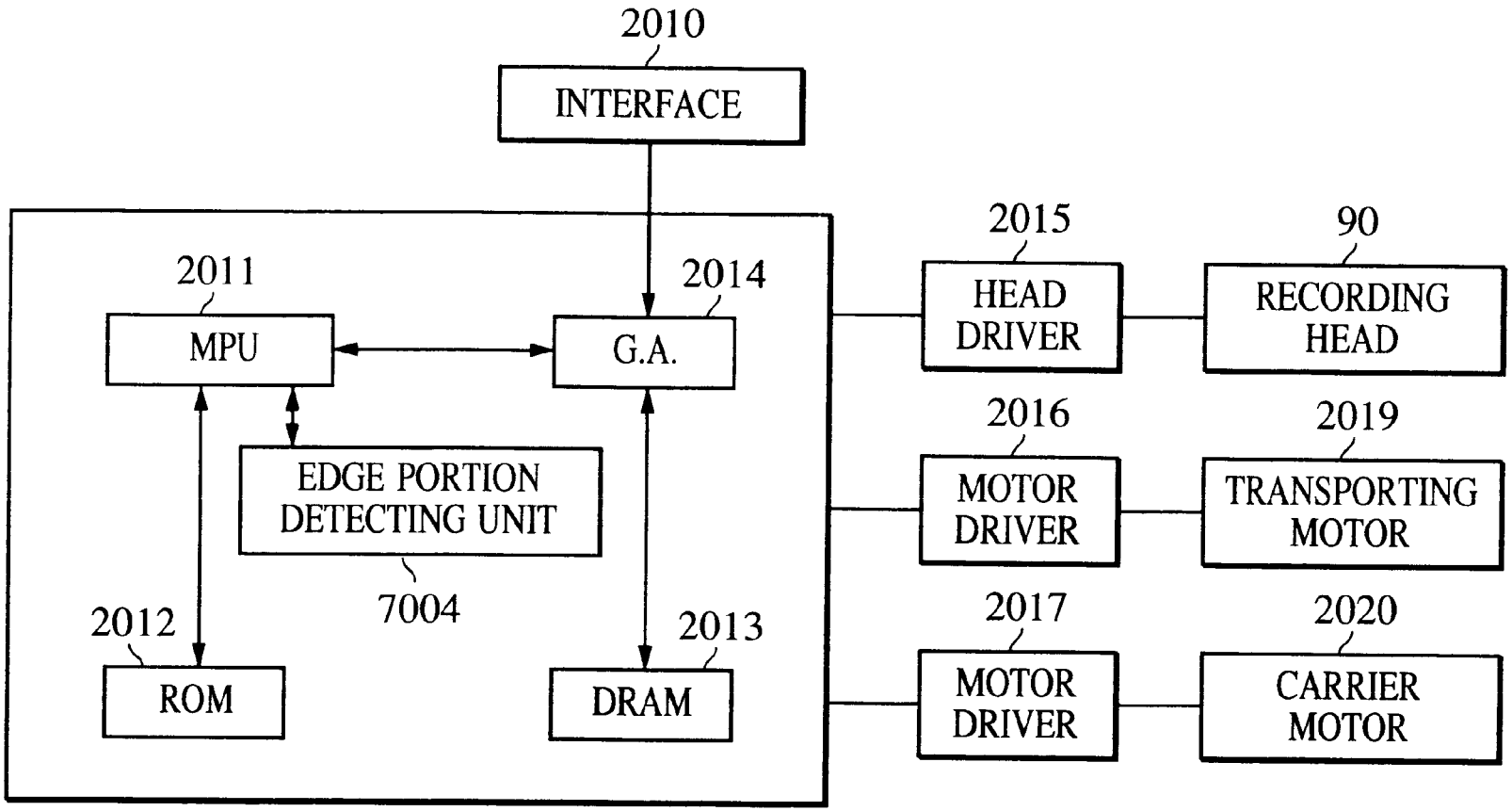
FIG. 58 is a block diagram illustrating the control circuit for executing control of each part of the ink-jet recording apparatus according to an eighth embodiment.
Figure 59:
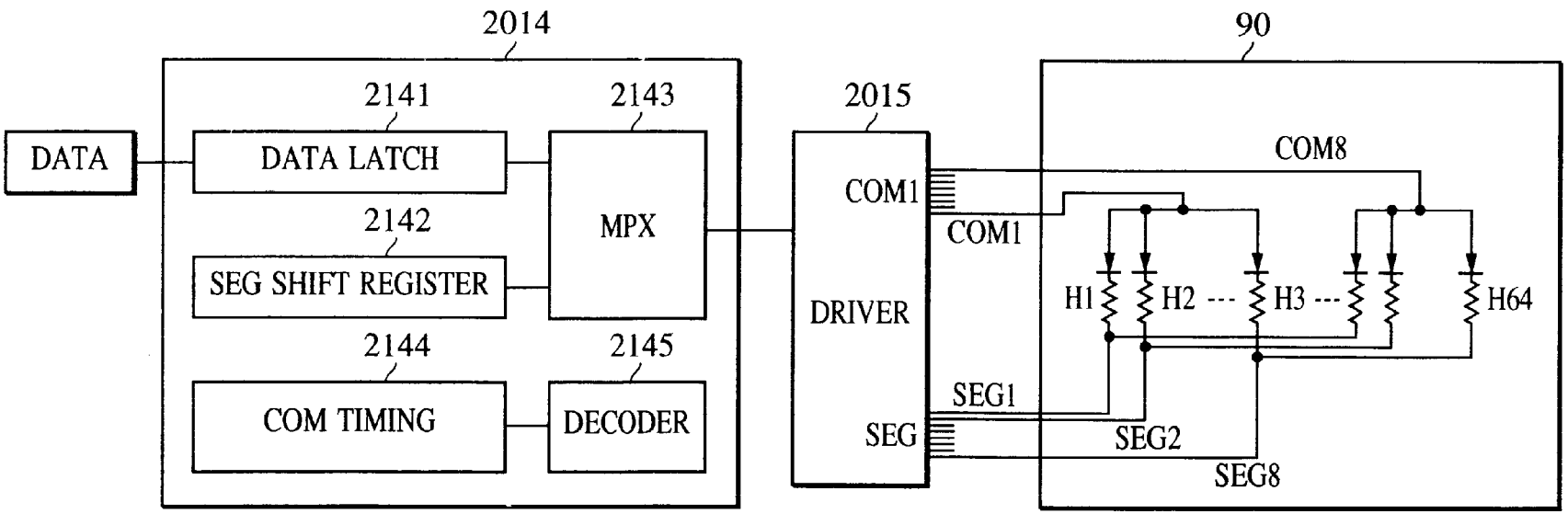
FIG. 59 is a circuit diagram illustrating the details of each part shown in FIG. 58.

FIG. 59 is a circuit diagram illustrating the units shown in FIG. 58 in detail. The gate array 2014 comprises a data latch 2141, a segment (SEG) shift register 2142, multiplexer (MPX) 2143, common (COM) timing generating circuit 2144, and a decoder 2145. A diode matrix configuration is used for the recording head 90, so the driving current flows to discharging heaters (H1 through H64) where the common signal COM and the segment signal SEG match, thereby heating and discharging ink.

The decoder 2145 decodes the timing generated by the common timing generating circuit 2144, and selects one from the common signals COM 1 through 8. The data latch 2141 latches the recording data read out from the RAM 2013 in 8-bit units, and the multiplexer 2143 outputs this recording data as segment signals SEG 1 through 8, following the segment shift register 2142. The output from the multiplexer 2143 can be made to change in various manners according to the contents of the shift register 2142, such as 1-bit units, 2-bit units, all 8-bit units, etc.

Now, to describe the operation of the above control configuration, upon input of recording signals to the interface 2010, the recording signals are converted into printing recording data between the gate array 2014 and the MPU 2011.

Then, the motor drivers 2016 and 2017 are driven, and the recording head is driven according to the recording data sent to the head driver 2015, thereby performing the printing.

Figure 60:
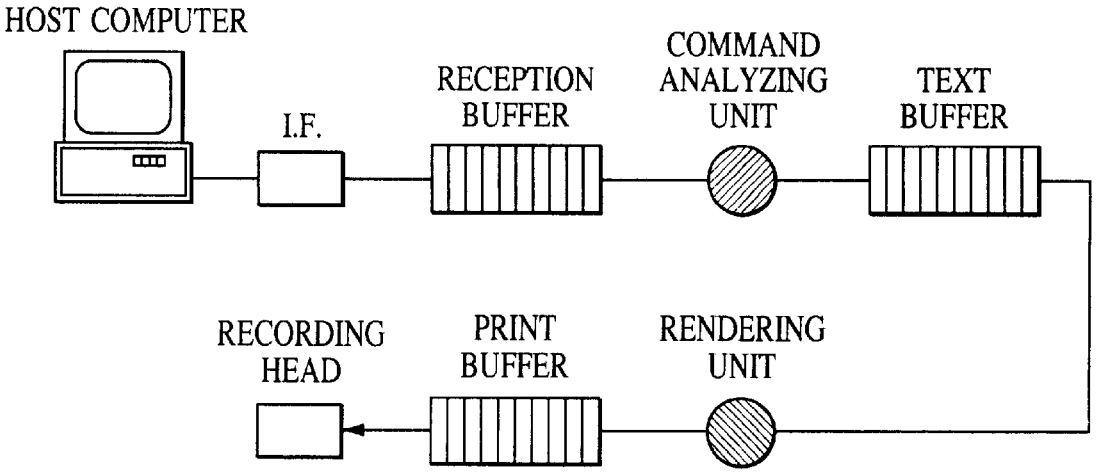
FIG. 60 is a diagram illustrating the flow of printing data.

FIG. 60 is a configuration diagram describing the flow of recording data within the recording apparatus. The recording data sent from the host computer is accumulated within the reception buffer in the recording apparatus, via the interface. The reception buffer has capacity of several kilobytes to several tens of kilobytes. Command analysis is performed regarding the recording data accumulated in the reception buffer, and then it is sent to the text buffer. One line of recording data in an intermediate form is held within the text buffer, and processing is performed for adding the printing position of the characters, type of style, size, character (code), font address, etc. The capacity of the text buffer differs from one model to another, and in the event of a serial printer this would be capacity for several lines, and in the event of a page printer this would be a capacity for one page. Further, the recording data accumulated in the text buffer is rendered and accumulated in the print buffer in a binarized state, and signals are sent to the recording head as recording data, thereby performing recording. Depending on the type of recording apparatus, there may be no text buffer, with the recording data accumulated in the reception buffer being subjected to command analysis and simultaneously rendered and written to the print buffer.

Next, description will be made regarding the edge portion detecting unit 7004. In the present embodiment, the specification is such that in the event that a recording pixel exists within two pixels around a non-recording pixel, this is detected as an edge portion.

At the recording apparatus, the recording data is rendered into bit drawing data of 1 or 0, meaning whether recording is to be performed or not, before the recording (the memory to which the data is to be rendered will be referred to as a "print buffer") .

Now, data created by inverting the data of the recording print buffer is rendered onto a first work buffer, thereby creating a non-recording pixel buffer, in order to detect whether or not recording pixels exist within two pixels around the non-recording pixel. Next, a second work buffer is prepared and data obtained by getting the logical sum of two bits in the left and right direction (i.e., X-direction) of the first buffer is rendered onto the second buffer, thereby forming a pixel buffer holding two pixels worth of non-recording pixel data in the X-direction. Further, a third work buffer is prepared and data obtained by getting the logical sum of two bits in the forward and back direction (i.e., Y-direction) is rendered onto the third buffer, thereby forming a pixel buffer holding two pixels worth of non-recording pixel data in the Y-direction. Thus, pixel data wherein the non-recording pixel data has expanded by two pixels forward and back, left and right, is obtained in the third work buffer.

Next, a fourth work buffer is prepared, and data obtained by taking the logical sum of the third buffer, which stores the non-recording pixel holding data, and the print buffer, which stores the recording pixel data, is rendered onto the fourth buffer. The pixel data remaining in this fourth buffer at this time is the edge portion wherein a recording pixel exists within two pixels around a non-recording pixel. Further, a fifth work buffer is prepared, and data obtained by taking the logical difference between the print buffer, which stores the recording pixel data, and the fourth buffer, which stores the edge portion data, is rendered onto the fifth buffer.

Though the above description has been made using five work buffers to facilitate ease of understanding this method, it is needless to say that all processing may be performed on one buffer.

Regarding the vertical and horizontal dot size (bitmap size) for one unit which forms each, there is no restriction as long as this is the number of dots for border detection (in the present embodiment, this is a size of 5×5 pixels, since the surrounding two pixels are used) or greater, but it often facilitates ease of use to arrange the horizontal size so as to be one line worth of the recording size, and to have the vertical size equivalent to the number of nozzles on the head.

Further, the logical sum and logical product may be processed using the functions of the CPU, or processed with a hardware logic arrangement. In the event that hardware processing is used, both horizontal and vertical expanding can be made simultaneously, thus achieving high-speed processing. Also, processing may be made in units of bits, units of bytes, or units of words, but it goes without saying that processing with greater units allows processing at higher speed.

Regarding the manner of expanding dots, the above description involves taking the logical sum of two dot pixels to the left and right as a method for expanding two dots to the left and right for example, but a method may be used wherein the dot is expanded 8 pixels in one direction, to the right, for example (i.e., the logical sum for eight pixels worth to the right from the dot of interest). In the event that the rendering originating buffer has n pixels worth of data area in the X direction this makes the data area for the work buffer which is the rendering destination work buffer be n+8 pixels worth of data area since it is greater by 8 pixels worth in the right direction. However, data can be obtained similarly by taking the logical sum of four pixels to the left and right by discarding the four edge pixels worth of area in the X direction in this area and extracting data from the position at the No. (n+4) pixel from the position of the fifth pixel in the X direction. Depending on the software algorithms or hardware logic configuration, there are cases wherein restricting reference to only before or after the address is easier than making reference both before and after; in such cases, the present means is effective.

Figure 61:
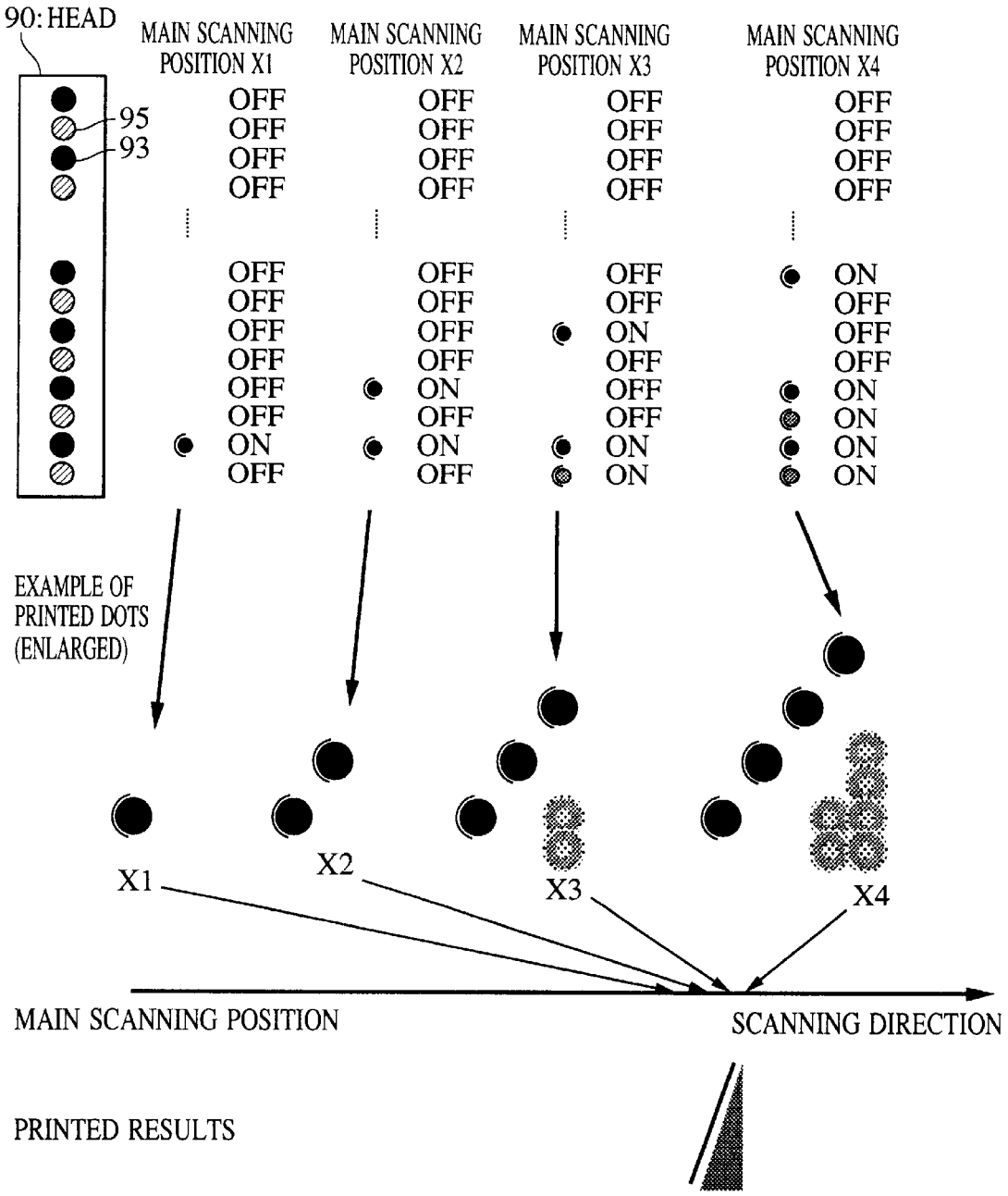
FIG. 61 is a diagram illustrating a case wherein the edge portion is recorded with recording ink alone, and the non-edge portion is recorded with both recording ink and clear ink.
Figure 62:
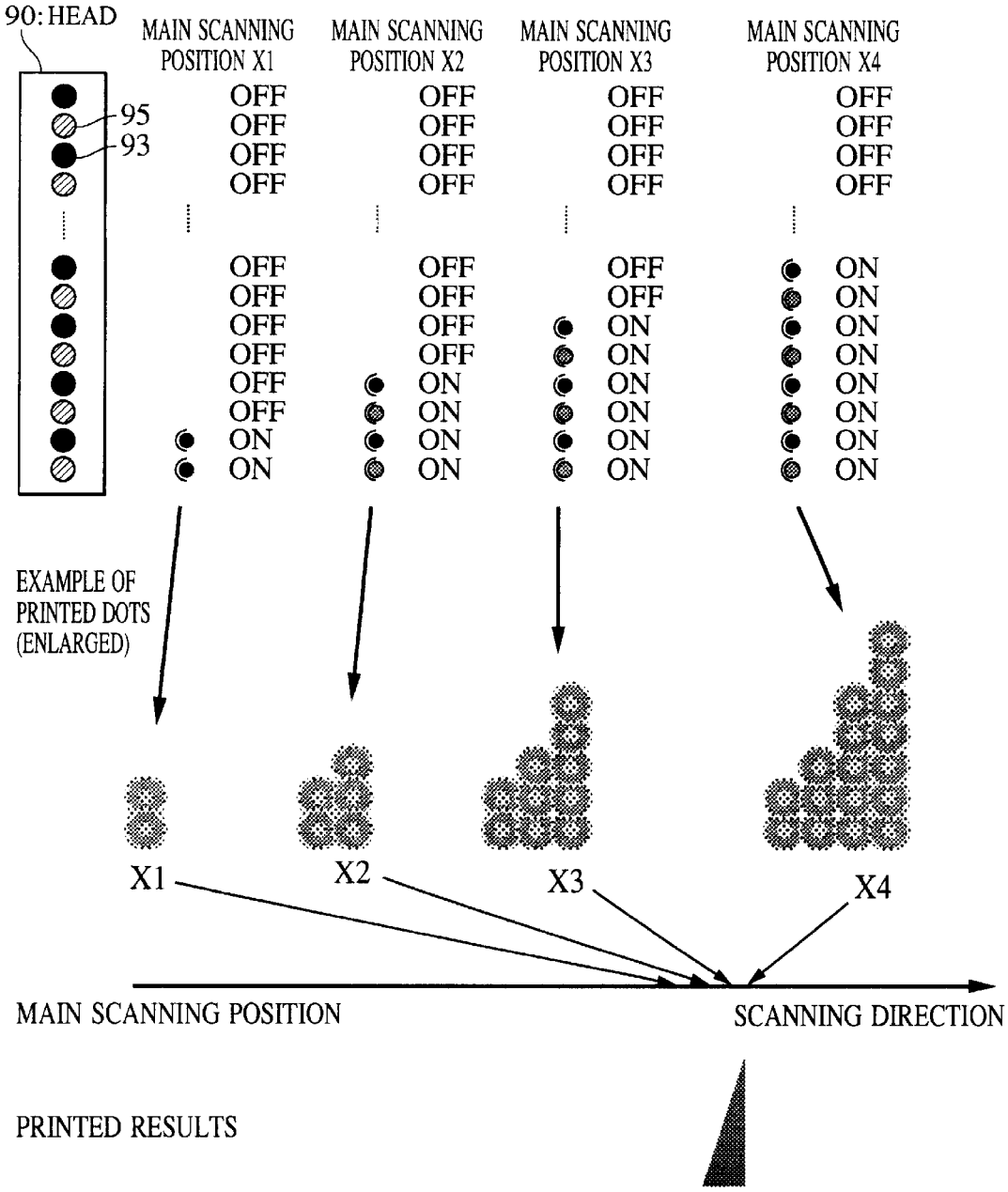
FIG. 62 is a diagram illustrating a case wherein both the edge portion and the non-edge portion are recorded with both recording ink and clear ink.

Detecting the edge portion of the image thus allows separation of the image to be recorded into edge portions and non-edge portions. Following this separation, settings are made so as to record the edge portions with recording ink alone and settings are made so as to record the non-edge portions with both recording ink and clear ink, thereby realizing the present embodiment. Also, with the present embodiment, dots in the non-edge portion which are adjacent to the edge portion are not recorded, as shown in FIG. 61. In other words, a one-dot gap is provided between the edge portion and non-edge portion in forming the image. Providing the one-dot gap in this manner allows the edge portion dots to stand independent, thereby emphasizing the edge of the image even more. Also, providing the one-dot gap reduces the trouble of the edge portion dots and non-edge portion dots mixing and blurring, consequently allowing the edge portion to be formed in a sharp manner. Now, as shown in FIG. 61, providing a gap of one dot between the edge portion and the non-edge portion results in dots which originally were to be recorded being thinned out, but this emphasizes the edge portion and the image quality improves, so there is no problem. On the other hand, as shown in FIG. 62, in the event that both the edge portion and the non-edge portion are printed with both recording ink and clear ink without discrimination, the edge is not emphasized. FIG. 61 is a diagram illustrating a case wherein the edge portion is printed with recording ink alone, and the non-edge portion is printed with both recording ink and clear ink, and FIG. 62 is a diagram illustrating a case wherein both the edge portion and the non-edge portion are printed with both recording ink and clear ink. FIGS. 61 and 62 indicate that recording ink or recording ink and clear ink are discharged at the main scanning positions X1, X2, X3, and X4.

Figure 63:
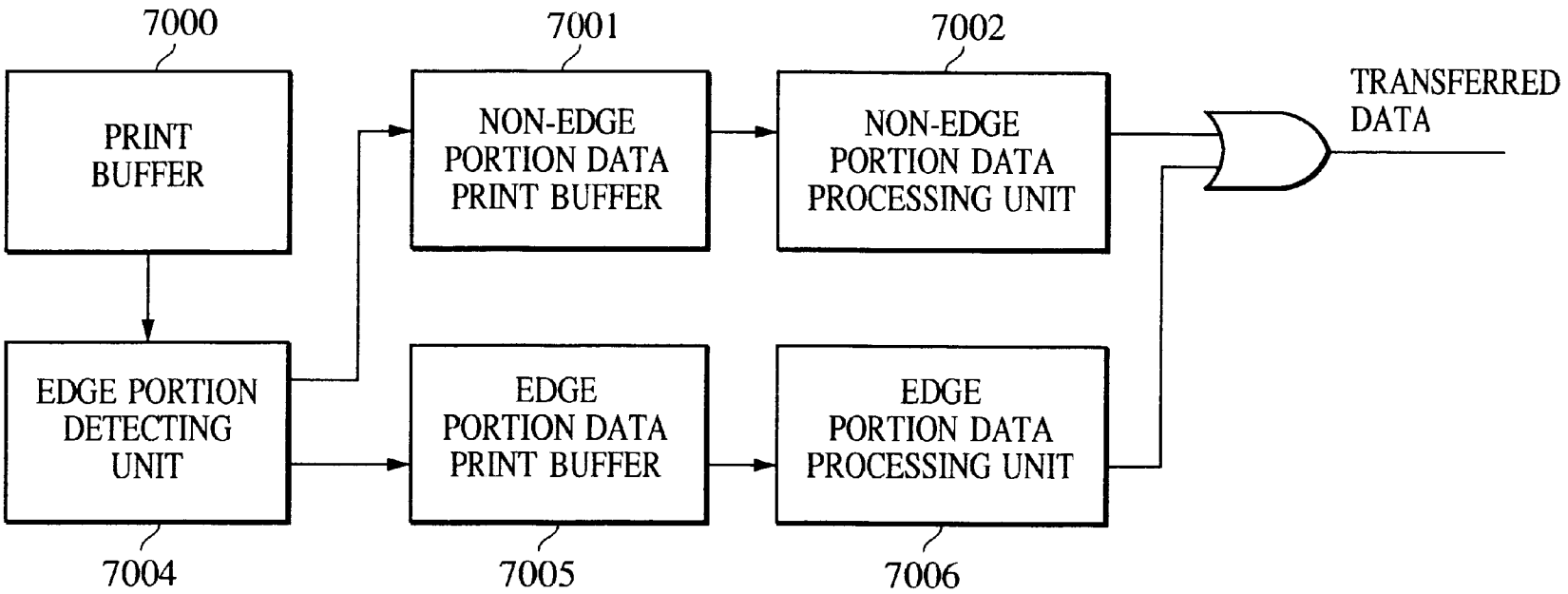
FIG. 63 is a block diagram of image data processing of the ink-jet recording apparatus according to the eighth embodiment.

Now, a case of performing image recording using a 1200 dpi head such as shown in FIG. 10, will be described. FIG. 63 is a block diagram illustrating the image data processing of the ink-jet recording apparatus. As shown in FIG. 63, first, regarding the image data stored in the print buffer 7000, the edge portion data is stored to the edge portion data print buffer 7005 by the above edge portion detecting unit 7004, and the non-edge portion data is stored in the non-edge portion data print buffer 7001. With the present embodiment, the non-edge portion data print buffer 7001 has a capacity capable of storing 128 rasters of data, and on the other hand the edge portion data print buffer 7005 has a capacity capable of storing 64 rasters of data.

Next, processing is performed on the non-edge portion data at the non-edge portion data processing unit 7002, so that the non-edge portion data can be recorded with both recording ink and clear ink. Specifically, the non-edge portion data is subjected to processing such that a clear ink dot is always formed at a position adjacent to a recording ink dot to be recorded. This is carried out by printing half of the non-edge portion data with recording ink, and the other half with clear ink. Further, data equivalent to one dot at the outermost portion is deleted from the non-edge portion data, so that a gap of one dot is opened between the edge portion and the non-edge portion. Thus, the one dot at the outermost portion of the non-edge portion adjacent to the edge portion is not recorded.

Also, in the edge portion data processing unit 7006, the edge portion data is subjected to processing such that the edge portion data can be printed with recording ink alone. Specifically, the edge portion data is subjected to processing such that clear ink dots are not formed at positions adjacent to the recording ink dots to be recorded.

Data formed by taking the logical sum of the thus-processed edge portion data and non-edge portion data is transferred to the recording head as transfer data (recording data). Then, the image is formed with one pass based on this recording data.

In the above description, a statement is made that one dot is left open between the edge portion and the non-edge portion, but the edge enhancing according to the present embodiment is not restricted to this method. For example, a predetermined number of dots may be thinned out from the non-edge portion dots adjacent to the edge portion. This also can reduce the blurring at the border between the edge portion and non-edge portion. Also, the edge can be emphasized even without thinning out any dots of the non-edge portion adjacent to the edge portion. However, from the perspective of forming a sharp edge portion by reducing blurring at the border between the edge portion and the non-edge portion, these methods are preferable in the following order: first, the method wherein one dot is left open between the edge portion and the non-edge portion, next, the method wherein a certain number dots of the non-edge portion adjacent to the edge portion are thinned out, and finally, the method without thinning out any dots of the non-edge portion adjacent to the edge portion.

Also, the above description involves edge portion detection of the image data being performed at the recording apparatus, but a system can be configured wherein the image data and edge data are sent to the recording apparatus from the host side which sends the image data. In this case, the image data is rendered to the print buffer, and the edge data is directly rendered to the edge data buffer. According to this configuration, the same recording method and advantages as those of the above-described embodiment can be obtained even without the recording apparatus main unit using an edge detecting unit.

According to the present embodiment as described above, at the time of recording an image using a high-density head wherein recording ink discharging nozzles and clear ink discharging nozzles are alternately arrayed, the edge portions are recorded with recording ink alone, and the non-edge portions are recorded with both recording ink and clear ink, thereby emphasizing the edge portion, and allowing the non-edge portion to be formed with sufficient printing concentration without losing recording speed. Accordingly, using the present embodiment enables high-quality images having clear edge portions to be recorded in a short time. Also, not recording the dots of the non-edge portion adjacent to the edge portion enables even more effective edge enhancing to be carried out.

Ninth Embodiment

Next, the ninth embodiment of the present invention will be described. With this ninth embodiment, the edge portions of the character areas are recorded with a first recording mode, the non-edge portions of the character areas are recorded with a second recording mode, and picture areas (non-character areas) are also recorded with the second recording mode. Particularly, a case of recording an image wherein character areas and picture areas both exist in a mixed manner will be described here. The description of the present embodiment will be made with reference to FIGS. 17, 18, and 64.

Figure 64:
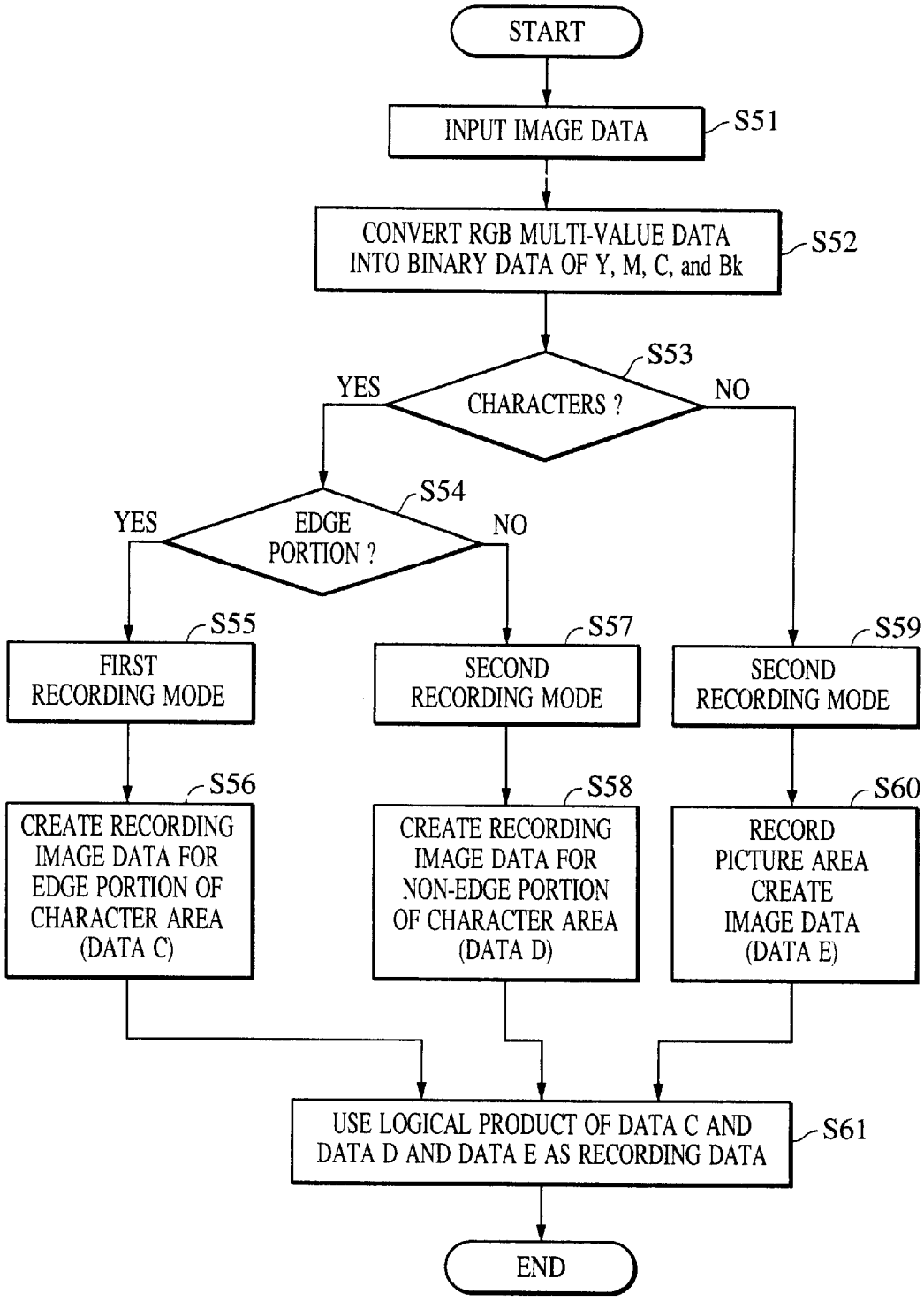
FIG. 64 is a flowchart illustrating the processing procedures relating to a ninth embodiment.

FIG. 64 is a flowchart illustrating the processing procedures of the ninth embodiment, and programs for executing this processing are stored in the ROM 1701 shown in FIG. 17. Also, the flowchart shown in FIG. 64 is executed by the MPU 1710.

First, in step S51, the image input apparatus 150 reads the original, and inputs the image. The original is a full-color image having many colors wherein character areas and picture areas are mixed, such as a photogravure magazine image for example. The full-color image read by the image input apparatus 150 is converted into digital data, and is input to the host computer 1710 as multi-value RGB image data via the interface unit 1703. Next, in step S52, the input multi-value RGB image data is converted into binary Y, M, C, and Bk data, at the image processing unit 1704, which can be output by the ink-jet recording apparatus 100. Subsequently, in step S53, the character judgement is performed for each of the binarized Y, M, C, and Bk data, to determine whether or not the data is character data. That is, the character area is extracted.

In the event the area is a character area with characters, the flow proceeds to step S54, and in step S54 the edge portions of the character area are detected, thereby allowing the character area to be separated into edge portions and non-edge portions. Subsequently, in step S55, settings are made so as to record the edge portions with the first recording mode, and in step S57 settings are made so as to record the non-edge portions with the second recording mode. That is, settings are made so as to record the areas judged to be edge portions of the character area with recording ink alone, and settings are made so as to record the areas judged to be non-edge portions of the character area with both recording ink and clear ink. Once the first recording mode is set in step S55, the recording image data for recording the edge portion of the character area is created in step S56. The data obtained here will be referred to as Data C. Subsequently, the flow proceeds to step S61.

Also, once the second recording mode is set in step S57, the recording image data for recording the non-edge portion of the character area is created in step S58. The data obtained here will be referred to as Data D. Subsequently, the flow proceeds to step S61. Incidentally, the method for separating the edge portion and non-edge portion of the character area in step S54 is performed by using the edge portion detecting unit of the above first embodiment, or the solid area detecting unit of the second embodiment.

On the other hand, in the event the area is a picture area without characters, the flow proceeds to step S59, and settings are made so as to record the picture area with the second recording mode. That is to say, the area judged as being a picture area is recorded with both recording ink and clear ink. Following setting the second recording mode in step S59, the recording image data for recording the picture area is created in step S60. The data obtained here will be referred to as Data E. Subsequently, the flow proceeds to step S61.

In step S61, the edge portion data of the character area, the non-edge portion data of the character area, and the picture area data are joined. Specifically, the logical product of the data C obtained for recording the edge portion data of the character area, the data D obtained for recording the non-edge portion of the character area, and the data E obtained for recording picture areas is obtained, and this is used as recording data.

The recording data thus obtained is transferred to the ink-jet recording apparatus 100 via the interface unit 1603, and recording is performed by the ink-jet recording apparatus. According to the above, a recorded image is formed wherein the edge portion of the character area is recorded with recording ink alone, and the non-edge portion of the character area and the picture areas are recorded with both recording ink and clear ink. For the character judgement (character extracting) performed in step S53 in FIG. 64, the method described in the above second embodiment can be used.

Also, the flowchart shown in FIG. 64 relating to the ninth embodiment shows the host computer automatically setting the first recording mode and the second recording mode according to the input image data (i.e., whether edge portion of the character area, non-edge portion of the character area, or picture area), but the present invention is not restricted to this. Rather, an arrangement may be made wherein the user sets the first recording mode and the second recording mode. In this case, an arrangement may be conceived wherein switches or panels are provided for the ink-jet recording apparatus, thereby setting the mode. Or, the user may make the settings from a printer driver which processes within the host computer. In the event of the user making the settings in this way, there is the advantage that the image can be output according to the usage and preferences of the user. On the other hand, in the event that the host computer automatically makes the settings, the user does not have to do anything, so there is the advantage that user operations are simple.

Also, the above description has been made regarding a case of recording an image wherein character areas and picture areas are mixed, but the present embodiment is by no means restricted to this, and can be applied to recording of images consisting of text alone or images consisting of pictures alone, as a matter of course.

According to the present embodiment as described above, at the time of recording an image using a high-density head wherein recording ink discharging nozzles and clear ink discharging nozzles are alternately arrayed, non-character areas (picture areas) which require gradients are recorded with both recording ink and clear ink, character area edge portions which do not require gradients are recorded with recording ink alone, and character area non-edge portion are recorded with both recording ink and clear ink, thereby forming picture areas with excellent gradients, and also forming clear characters with enhanced edges. Accordingly, even in the event of recording images wherein picture areas and character areas are mixed, using the present embodiment allows high-quality images having picture areas with excellent gradients and clear characters to be obtained.

Tenth Embodiment

With the above eighth embodiment and ninth embodiment, one-pass recording is made by selecting either the first recording mode or the second recording mode. According to the eighth embodiment and ninth embodiment, one-pass recording is often sufficient since images with sufficiently high quality can be formed in a short time. However, depending on the preference of the user or according to the image to be recorded, there are cases wherein it is preferable that an image with higher quality be formed even if the recording time is longer. In such cases, multi-pass recording is preferable. That is, a third recording mode and a fourth recording mode are set and used for recording. Note that in the event that the third recording mode is set, the area of concern is recorded multiple times using the recording ink alone, and in the event that the fourth recording mode is set, the area of concern is recorded multiple times using both the recording ink and clear ink. Setting of the third recording mode and fourth recording mode may be made by a user making the settings from switches or panels provided for the ink-jet recording apparatus, or the user may make the settings from a printer driver which processes within the host computer. Also, as with the eighth embodiment and ninth embodiment, the host computer or ink-jet recording apparatus may automatically make the settings, according to the image data. In this case, an arrangement may be made wherein either one of the third recording mode and fourth recording mode is always set, or an arrangement may be made wherein one of the first, second, third, and fourth recording modes is set according to the image data.

According to the present embodiment as described above, using the third recording mode or fourth recording mode which records using the multi-pass method allows an image with higher quality than that formed by the first through third embodiments to be formed, even though the recording time is longer than that of the first through third embodiments.

Other Embodiments

Though the above first through tenth embodiments involve clear ink landing at a portion adjacent to recording dots, this is not restricted to clear ink. Anything which is capable of changing the covering state of the recording dots without essentially changing the tone is sufficient for realizing the present invention. Accordingly, a liquid which does not contain color material is sufficient. Particularly, in the event that the color material of the recording dot is a dye, a liquid for dissolving the dye is sufficient, and in the event that the color material of the recording dot is a pigment, a liquid for dispersing and uniformly holding the pigment is sufficient. Of the fluids which essentially do not contain color material, clear ink is suitable for the present invention. The reason is that with clear ink, the compatibility with the color material in the recording dots that have landed on the medium readily becomes uniform. Also, this is because clear ink is prepared so as to be suitably discharged from ink discharging openings. Further, clear ink can be used in common for recording ink of various colors, so even in the event that multiple recording inks having color materials such as the three colors of C, M, and Y, or even more, are prepared, only this one type of clear ink needs to be prepared, so gradient expressions can be made more effectively than preparing concentration ink for each color.

Also, the above embodiments involve using heads wherein the ink discharging nozzles and clear ink discharging nozzles are arrayed alternately, but the present invention is not restricted to this; rather, a head may be used wherein the nozzles are arrayed in the order of clear ink discharging nozzle, ink discharging nozzle, clear ink discharging nozzle, clear ink discharging nozzle, ink discharging nozzle, clear ink discharging nozzle, and so forth, i.e., a head wherein two clear ink discharging nozzles are provided between ink discharging nozzles. In this event, the distance between the ink discharging nozzles is longer than that of the heads in the above embodiments, so the image concentration is lighter when the recording results of a single pass are compared. On the other hand, the number of gradients which can be represented can be increased without losing recording speed. Thus, according to the present invention, a recording head having a nozzle array wherein at least one ink discharging nozzle and at least one liquid discharging nozzle are arrayed alternately in an adjacent manner can be used.

Ink-jet heads applicable to the present invention are not restricted to the above-described bubble-jet head; rather, piezoelectric heads provided with piezoelectric elements by be used, as long as the nozzles can be highly integrated. This piezoelectric ink-jet head is such wherein a piezoelectric element is provided at one portion of a wall of a container forming an ink chamber, warping deformation of the piezoelectric element is caused by signals and the resulting pressure is used to cause ink droplets to fly from the nozzle, thereby forming dots on recording paper, as disclosed in Japanese Patent Publication No. 63-252750, Japanese Patent Publication No. 63-247051, or Japanese Patent Laid-Open No. 59-48164. A piezoelectric element can be formed on a substrate and nozzles can be formed using the same process as the manufacturing method for conventional ink-jet heads, for the present embodiment as well.

Figure 35:
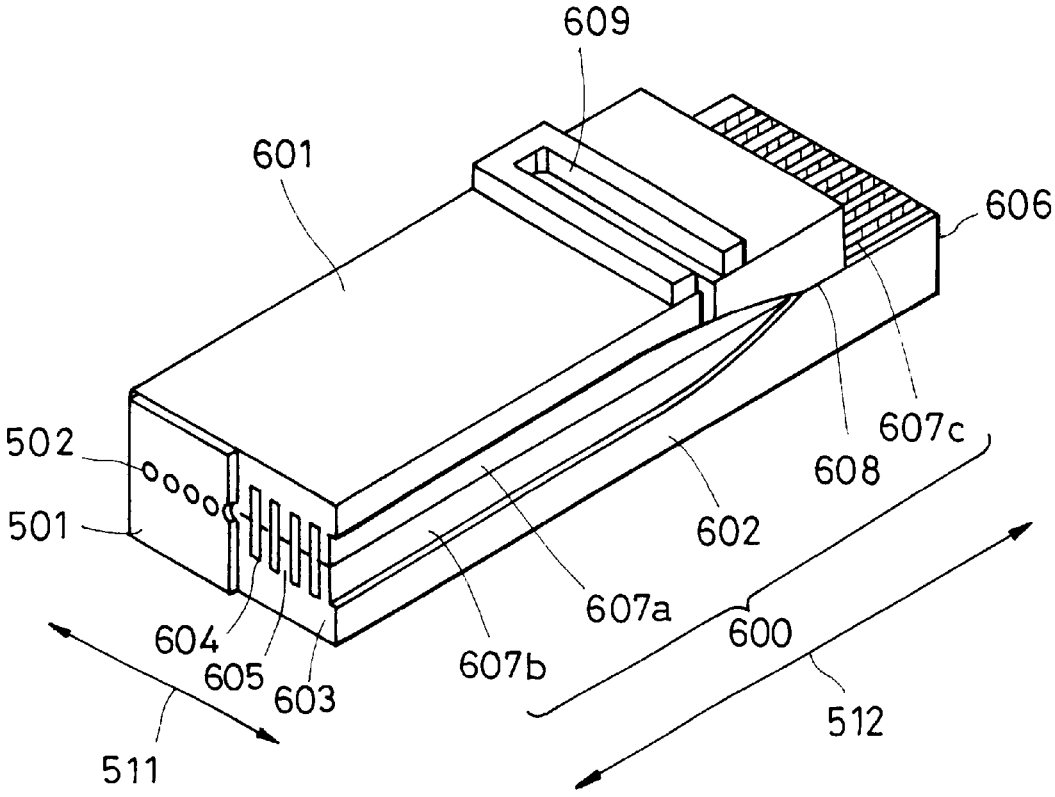
FIG. 35 is a manufacturing process diagram illustrating a conventional piezoelectric ink-jet head and the manufacturing method thereof.

As shown in FIG. 35, these ink-jet heads have multiple parallel channels 604 with spaces in between in the direction 511 of the array of the nozzles, and these channels 604 are sectioned off by side walls 605 extending in the longitudinal direction 512 of the channels 604. One end 603 of these channels 604 is connected to a nozzle substrate 501 having multiple nozzles 502, and the other end is connected to an ink supply channel 609 for supplying ink to the channels. The side walls 605 are partially or completely formed of piezoelectric material, and deformation thereof is induced in the direction parallel to the nozzle array direction 511 such as shearing mode, by electric actuating means (not shown), thereby changing the pressure of the ink with the channel 604 serving as a pressure generating chamber, and discharging ink droplets from the nozzles 502.

Figure 36:
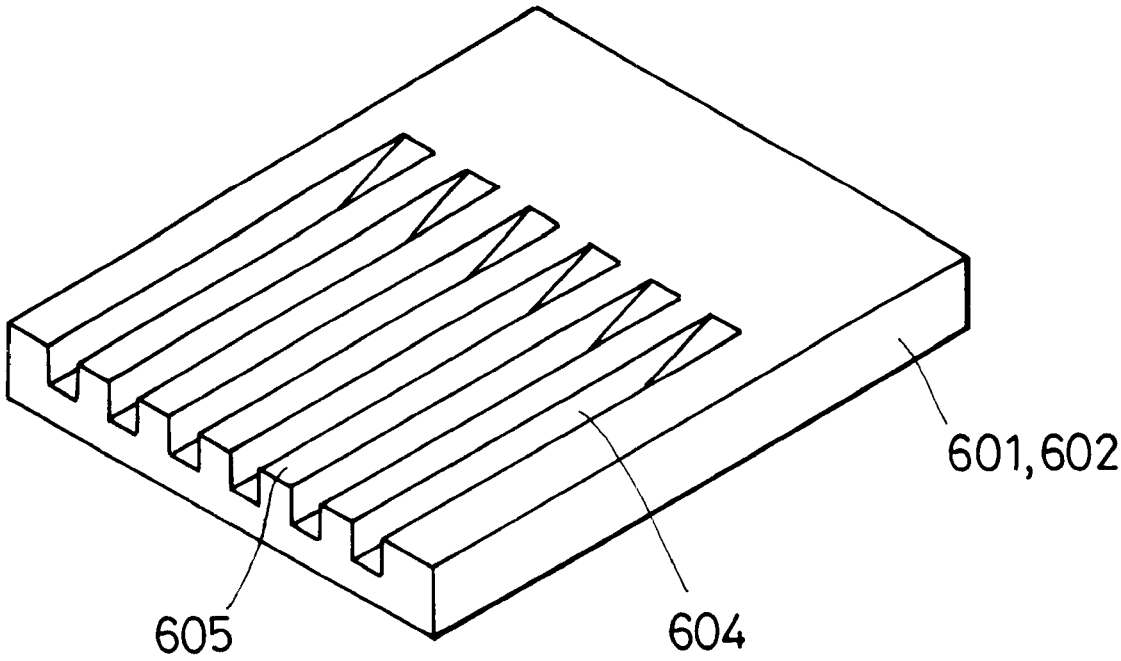
FIG. 36 is a manufacturing process diagram of a piezoelectric ink-jet head.
Figure 37:
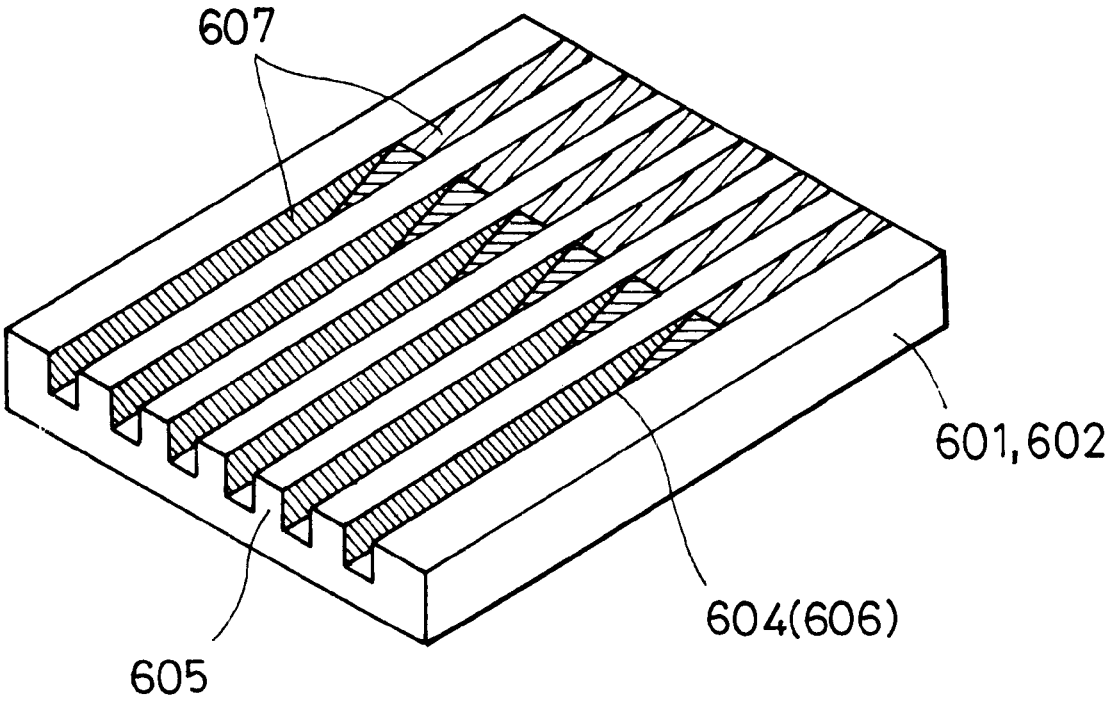
FIG. 37 is a manufacturing process diagram of a piezoelectric ink-jet head.

Also, the manufacturing method thereof comprises: a step for forming multiple parallel channels 604 on an upper substrate (first channel material) 601 and a lower substrate (second channel material) 602 formed of a piezoelectric ceramic polarized in the thickness direction, as shown in FIG. 36; a step for forming electrode layers 607 on the side walls 605 sectioning off the adjacent channels 604, one for each channel 604, as shown in FIG. 37; a step for joining the upper substrate 601 and lower substrate 602 subjected to the above process such that the channels 604 of each opposingly match, and such that the side wall electrode layers 607*a* of the upper substrate 601 and the side wall electrode layers 607*b* of the lower substrate 602 are electrically connected at the surface portions 608 of the substrates, thereby forming a channel forming material 606, as shown in FIG. 35; and a step for joining the nozzle substrate 501 and one end of the channel forming material 606. As with the above bubble-jet head, the channels are configured as shown in FIGS. 9A through 9C.

Figure 38:
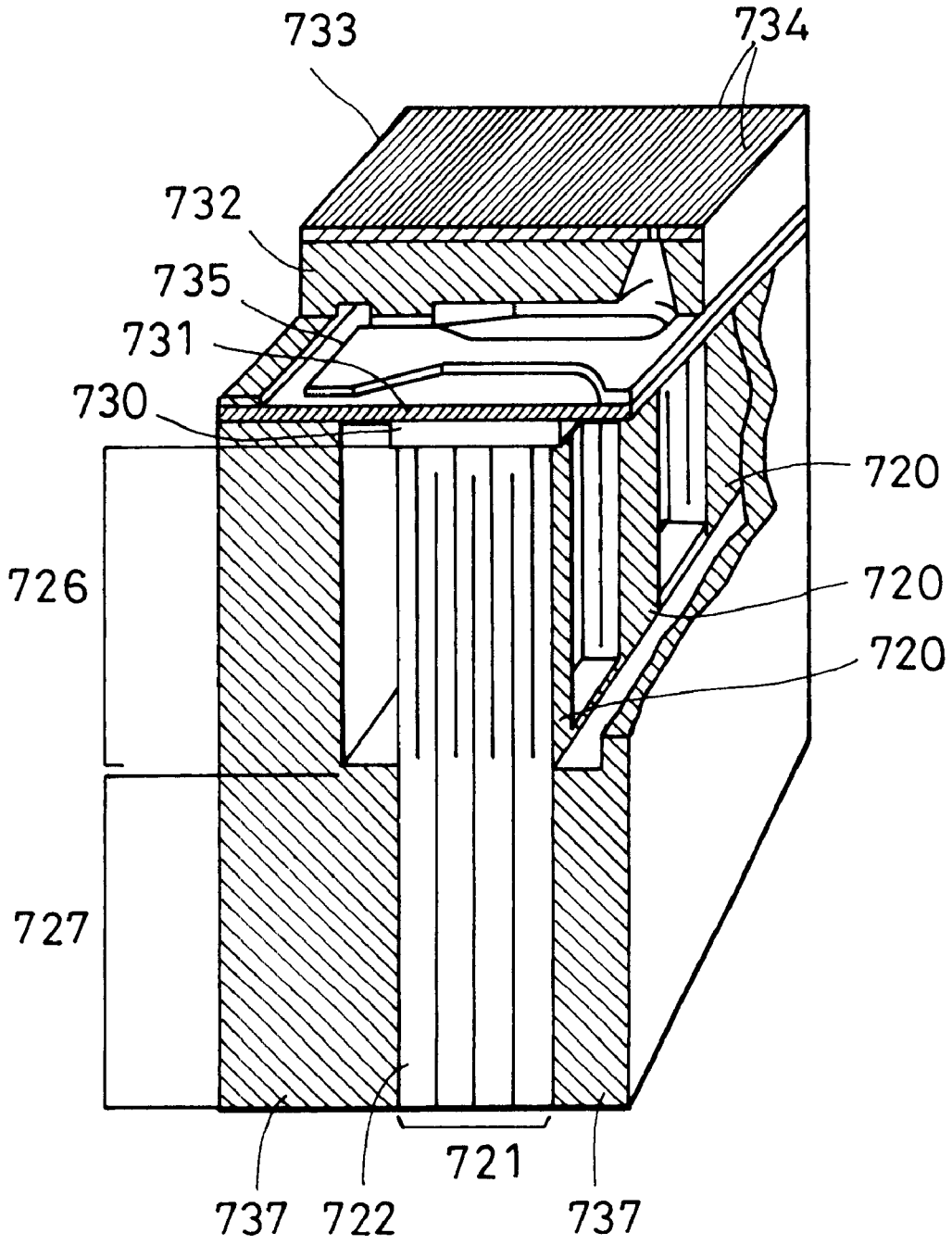
FIG. 38 is a perspective view of an ink-jet head applicable to the present invention.
Figure 39:
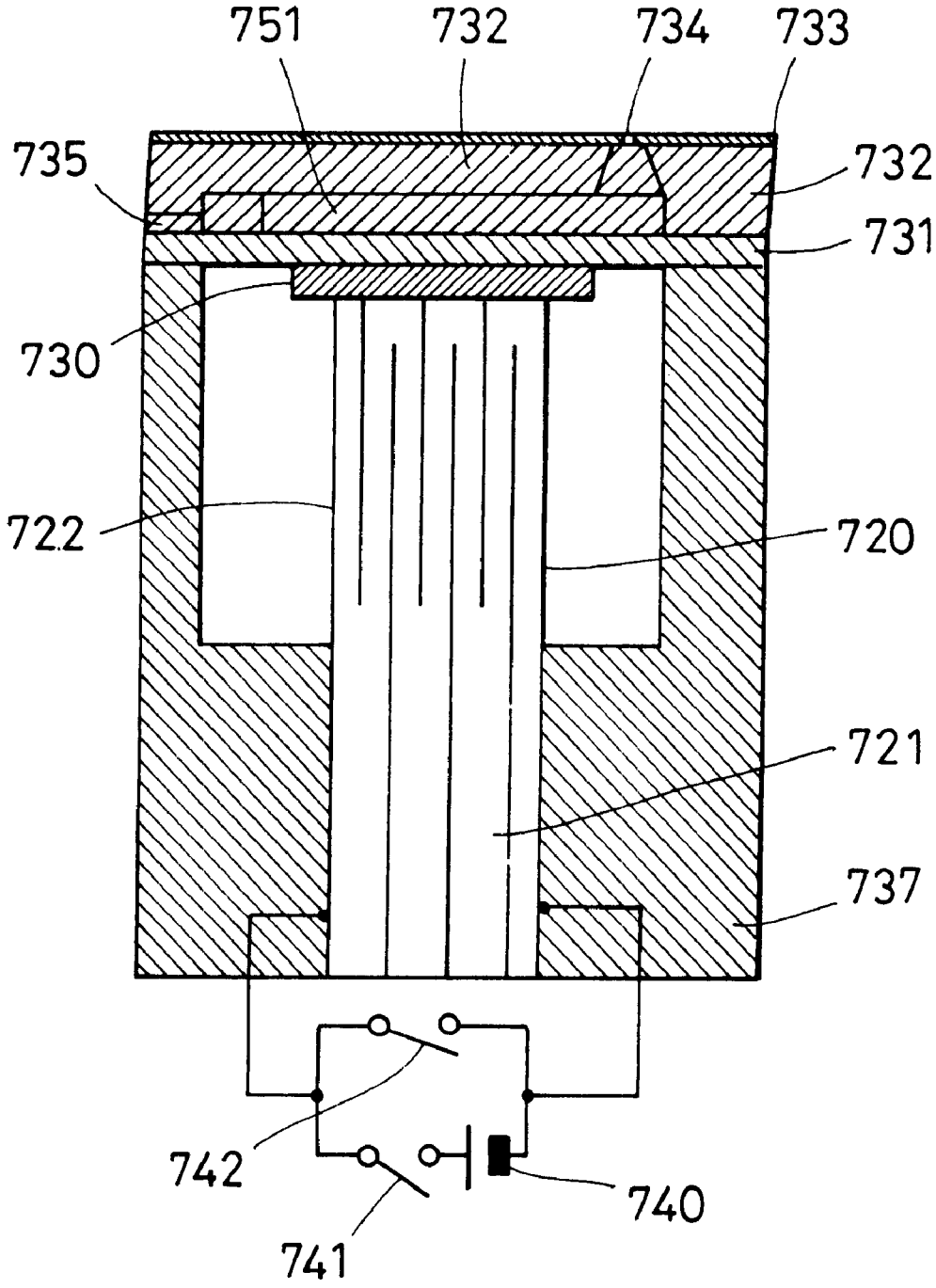
FIG. 39 is a cross-sectional view of an ink-jet head applicable to the present invention.

Now, an overview of the operation of piezoelectric ink-jet heads will be described with reference to FIGS. 38 through 44. FIG. 38 is a perspective view illustrating the entirety of the piezoelectric ink-jet head. The Figure shows the head partially cut away, to describe the interior of the ink-jet head. FIG. 39 is a cross-sectional diagram showing the front edge of the ink-jet head shown in FIG. 38 cut at the position of the nozzles 734.

The overall actions of the piezoelectric ink-jet head are as follows. The configuration of the principal components thereof comprises a nozzle forming substrate 733 in which nozzles 734 are formed, a structure 732 forming an ink chamber 751, a thin film 731 forming the boundary between the ink chamber 751 and the pressure generating material 721, an attachment joint portion 730 for connecting the pressure generating material 721 and the ink chamber 751, an ink supplying opening 735 for supplying ink to the ink chamber 751, and a structure 737 for fixing the entire ink-jet head according to the present invention.

Figure 40:
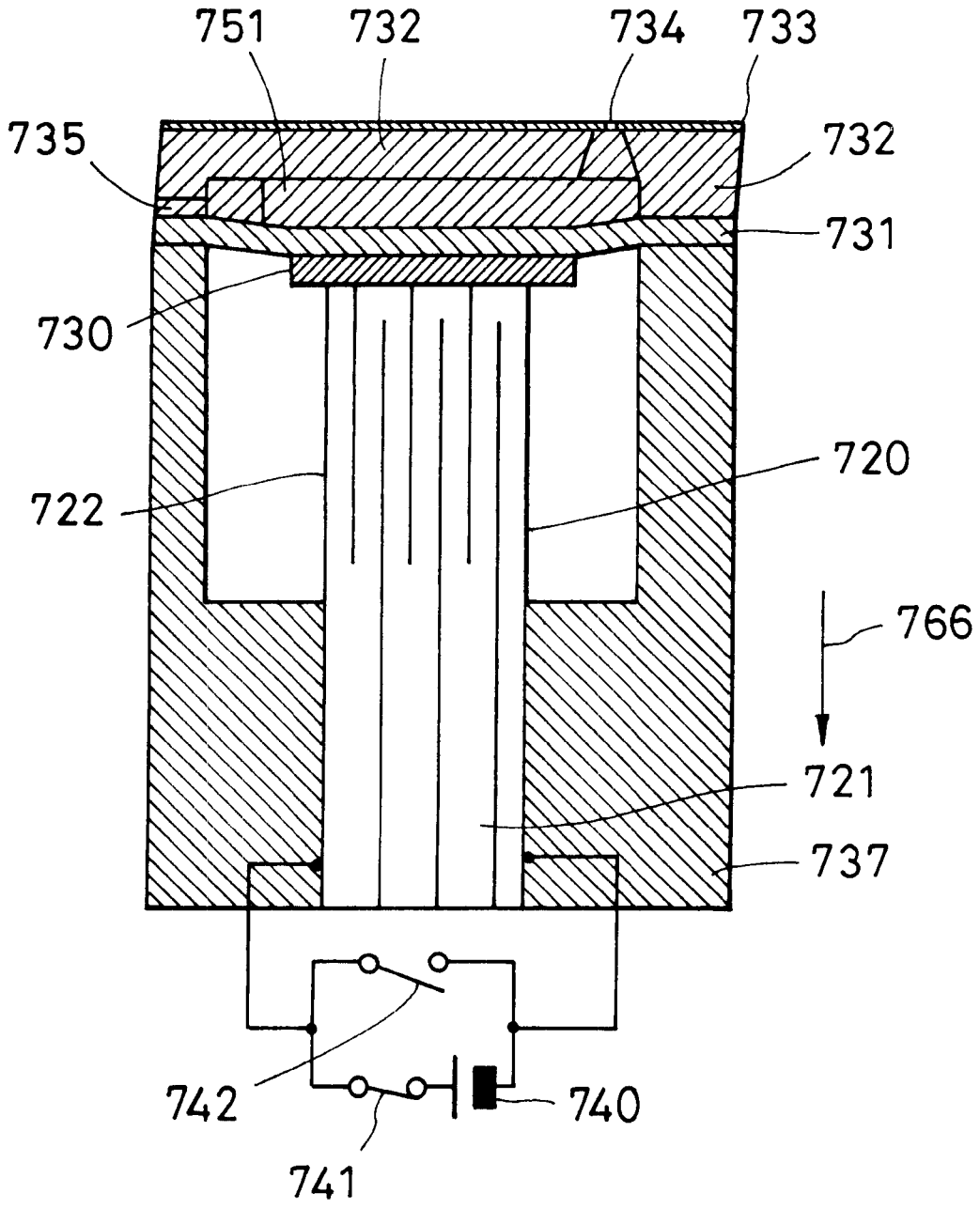
FIG. 40 is a cross-sectional view of an ink-jet head applicable to the present invention, wherein the pressure generating member is contracted.
Figure 41:
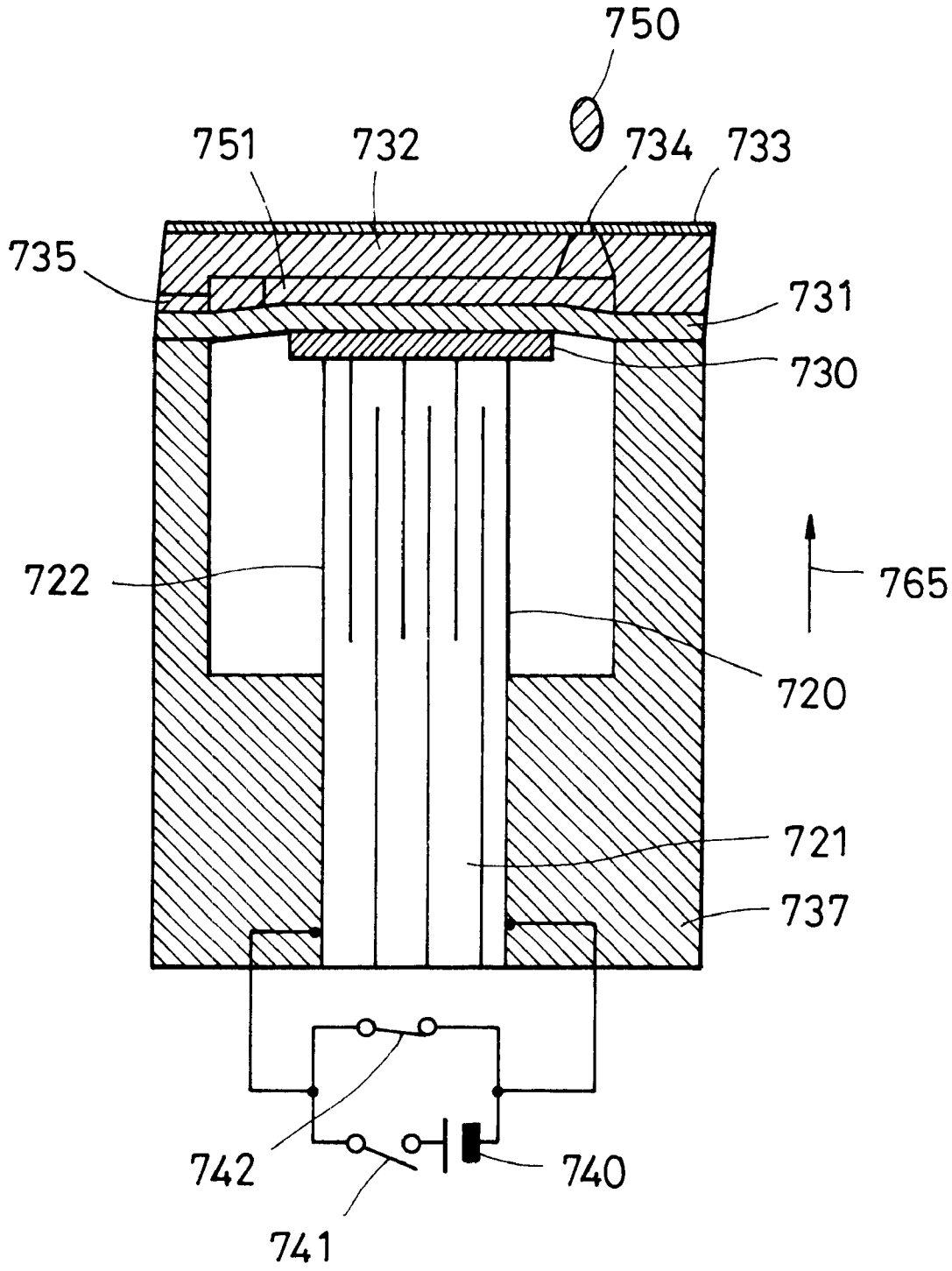
FIG. 41 is a cross-sectional view of an ink-jet head applicable to the present invention, wherein the pressure generating member is extended.

The action for discharging the ink is as shown in FIGS. 40 and 41. Now, reference numeral 740 denotes a driving power switch, 741 denotes a pressure generating material charging switch, 742 denotes a pressure generating material discharging switch, 720 denotes individual electrodes corresponding to each nozzle 734, and 722 denotes a common electrode corresponding to all nozzles. With this embodiment of the present invention, multilayer PZT is used as the pressure generating material. The displacement direction employed is a direction at right angles to the direction of layering.

FIG. 39 shows a normal state wherein no electric field is applied to the pressure generating material 721. Now, closing the charging switch 741 and applying an electric field to the pressure generating material 721 causes displacement of the pressure generating material 721 in the direction of the arrow 766, and simultaneously draws inwardly the connected joint portion 730 so the thin film 731 deforms in the direction of enlarging the ink chamber 751. At this time, an amount of ink equivalent to the increased volume of the ink chamber 751 is supplied from the ink supplying opening 735. Next, as shown in FIG. 41, the charging switch 741 is opened and the discharging switch 742 is closed. At this time, the pressure generating material 721 experiences displacement in the direction of the arrow 765, acting to decrease the volume of the ink chamber 751 instead. The ink which has been thus pressurized flies out from the nozzle 734. The above is the series of actions for discharging ink.

Figure 42:
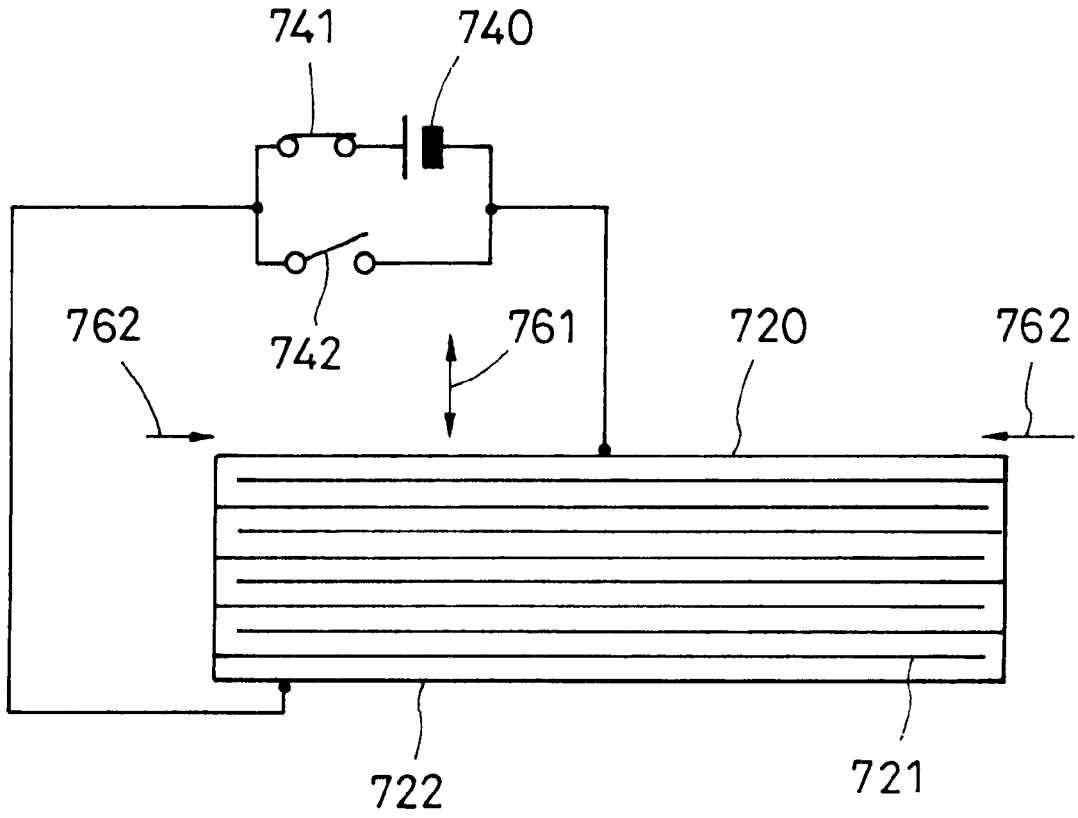
FIG. 42 is an operating explanatory diagram of the contracting of the pressure generating member.
Figure 43:
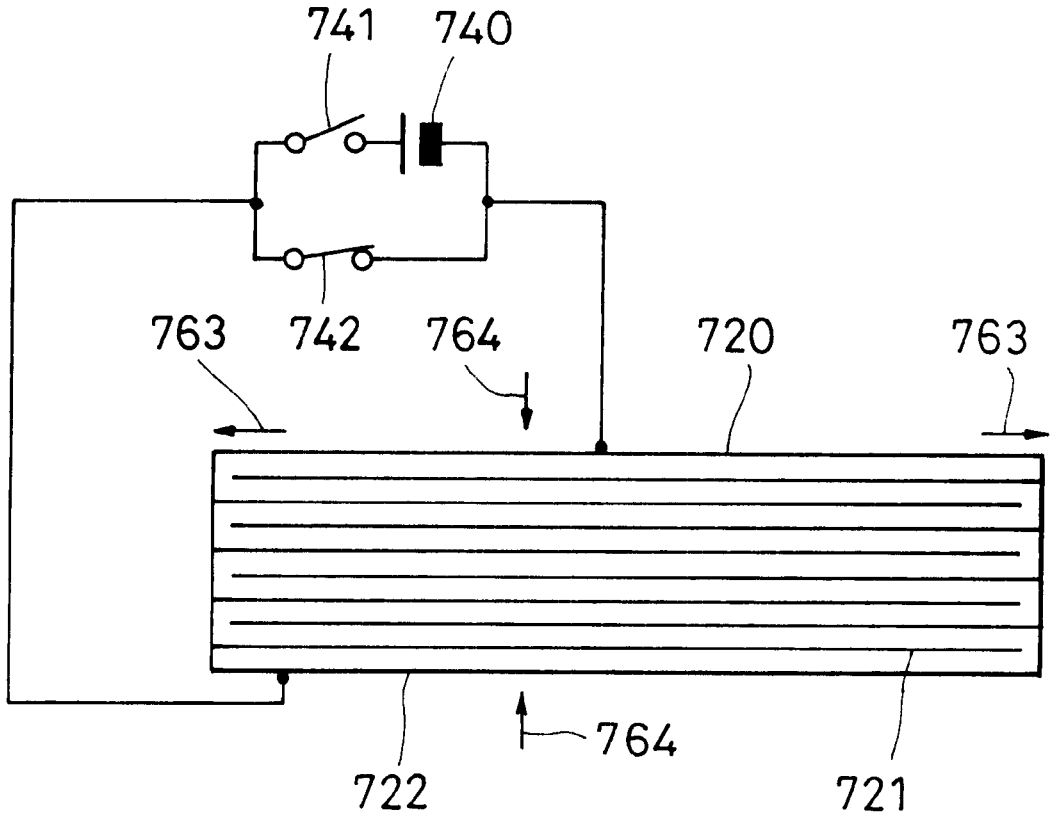
FIG. 43 is an operation explanatory diagram of the extending of the pressure generating member.

FIGS. 42 and 43 are diagrams illustrating the displacement direction of the multilayer PZT used for the pressure generating material 721. FIG. 42 shows a state wherein the pressure generating material 721 is charged. Closing the charging switch 741 and opening the discharging switch 742 connects the driving power source 740 between the individual electrode 720 and common electrode 722. At this time, the pressure generating material 721 deforms to become thicker in the directions of the arrow 761, due to the piezoelectric properties and polarity direction thereof. At this time, there is shrinking deformation in the directions of the arrows 762, at a rate determined by Poisson's ratio. The embodiment of the present invention uses the displacement in the directions of these arrows 762.

Figure 44:
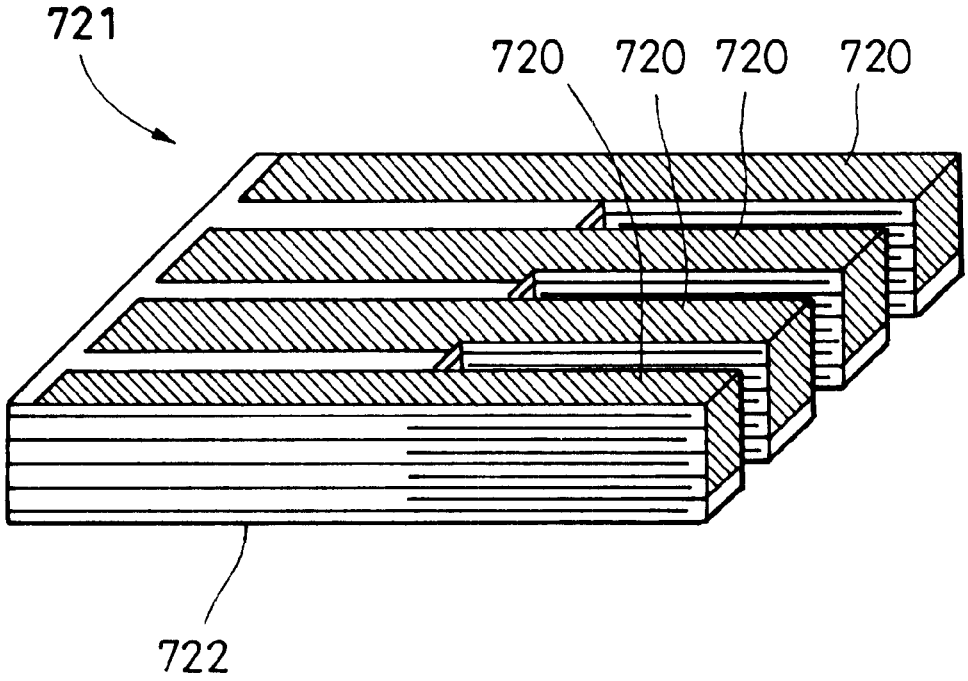
FIG. 44 is a perspective view of the pressure generating member.

FIG. 43 is a diagram illustrating the state of the pressure generating material 721 being discharged. Opening the charging switch 741 and closing the discharging switch 742 connects the individual electrode 720 and the common electrode 722, thereby discharging the charge within the pressure generating material 721. At this time, there is deformation of becoming thinner in the directions of the arrows 764 and simultaneous deformation so as to stretch in the directions of the arrows 763, thereby returning to the original state. FIG. 44 is a perspective view of the pressure generating portion 721 alone extracted.

The present invention may be arranged to use a piezoelectric ink-jet head as described above and discharge recording ink and clear ink from the piezoelectric ink-jet head so as to record images. However, at the current state, it is more difficult to form highly dense nozzles for piezoelectric ink-jet heads as compared to bubble-jet heads, so from the perspective of high density, bubble-jet heads are more preferable for the present invention.

Figure 45:
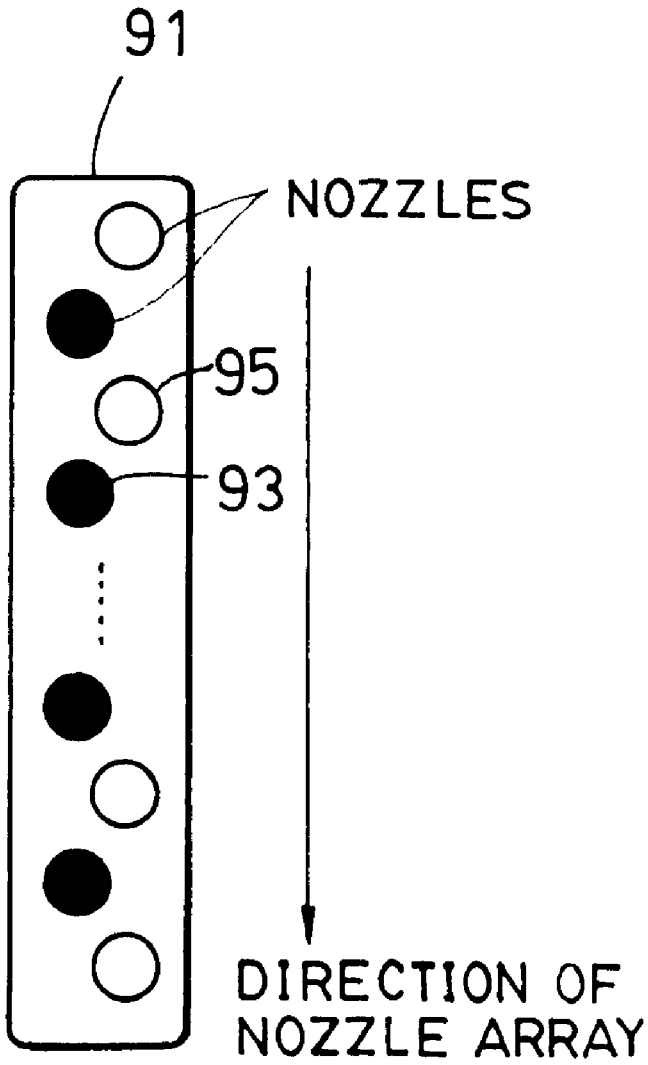
FIG. 45 is a schematic configuration diagram of the recording head to be mounted into the ink-jet recording apparatus applicable to the present invention, wherein the recording head has nozzles arrayed in a staggered array (staggered array recording head)

Also, the present invention may use a recording head 91 wherein the nozzles are arrayed in a staggered array (staggered array recording head), as shown in FIG. 45. This staggered array recording head is also an inline type head, like that shown in FIG. 1, with recording ink discharging nozzles 93 and clear ink discharging nozzles 95 being alternately positioned as to the array direction of the nozzles. A plurality of these staggered array recording heads 91 may be provided in a line horizontally, as shown in FIG. 2A, or in a line vertically, as shown in FIG. 2B. Thus, according to the present invention, a head, wherein ink discharging nozzles and liquid discharging nozzles are positioned in a alternately adjacent manner in a predetermined direction, is used.

Also, it is needless to say that the objects of the present invention can also be achieved by an arrangement wherein a storage medium storing software program code for realizing the functions of the embodiments is supplied to a system or device, and the computer (or CPU or MPU) of the system or the device reads out and executes the program code stored in the storing medium.

Also, in this case, the storage medium storing the program code comprises the present invention, by the program code itself read out from the storage medium realizing the functions of the embodiments.

Examples of storage mediums which can be used for supplying the program code include floppy disks, hard disks, optical disks, magneto-optical disks, CD-ROMS, CD-Rs, magnetic tape, non-volatile memory cards, ROM, and so forth.

Also, it is needless to say that the present invention encompasses cases not only where the computer executing the read program code realizes the functions of the above embodiments, but also where the operating system running on the computer performs all or part of the actual processing, based on the commands of the program code, whereby the functions of the above embodiments are realized.

Further, it is needless to say that the scope of the present invention also encompasses arrangements wherein the program code read out from the storage medium is written to memory provided in function expansion boards inserted to the computer or in function expansion units connected to the computer, following which a CPU or the like provided with the function expansion boards or function storing units performs all or part of the actual processing based on instructions of the program code, so as to realize the functions of the above embodiments thereby.

Also, the present invention is applicable to various ink-jet recording methods, but exhibits particularly excellent advantages with print heads and print apparatuses of the type provided with means (electro-thermal converters, laser beams, etc.) for generating thermal energy to be used as the energy for discharging ink, by causing a change in state of the ink by the thermal energy. This is due to the fact that this method is capable of achieving high printing density and high precision.

As for representative configurations and principles thereof, the basic principle disclosed in U.S. Pat. Nos. 4,723,129 and 4,740,796 is preferable. This method is applicable to both on-demand types and continuous types, but is particularly advantageous with on-demand types, since at least one driving signal providing a rapid rise in temperature which exceeds the boiling point is applied to an electro-thermal converting member positioned corresponding to a sheet or channel holding liquid (ink) in a manner corresponding to printing information, thereby generating thermal energy in the electro-thermal converting member which causes film boiling at the thermal acting surface of the print head, consequently forming bubbles within the liquid (ink) in a manner corresponding to the driving signals, one to one. The liquid (ink) is discharged from the discharging opening due to the growth and contraction of the bubbles, thereby forming at least one droplet. Forming these driving signals into pulse forms is even more preferable, since growth and contraction of the bubbles can be performed instantaneously and appropriately, and discharge of liquid (ink) with particularly excellent response can be achieved. As for the pulse-form driving signals, those disclosed in U.S. Pat. Nos. 4,463,359 and 4,345,262 are suitable. Further, employing the conditions described in U.S. Pat. No. 4,313,124 relating to the rate of temperature rise of the above thermal acting plane allows even more excellent printing to be performed.

As for the configuration of the print head, in addition to the combination configuration of the discharge openings, channels, and electro-thermal converting members (straight channels or right-angle channels) disclosed in the above specifications, the present invention also encompasses the configuration using U.S. Pat. Nos. 4,558,333 and 4,459,600 disclosing the thermal acting portion being positioned at a bent portion. Further, the advantages of the present invention are also effective regarding the configuration disclosed in Japanese Patent Laid-Open No. 59-123670 wherein a common slot is used as the discharge portion for multiple electro-thermal converting members, and the configuration disclosed in Japanese Patent Laid-Open No. 59-138461 wherein apertures for absorbing pressure waves of the thermal energy are made to correspond with the discharge portions. That is to say, regardless of the form of the print head, printing can be effectively carried out in a sure manner according to the present invention.

Further, the present invention can be advantageously applied to full-line type print heads which have a length corresponding to the maximum printing medium width on which the printing apparatus can print. As for such print heads, either configurations wherein multiple print heads are combined to satisfy the length thereof, or wherein the print head is a single integrally-formed print head, can be used.

In addition, with the above serial type arrangements, the present invention is also effective with print heads fixed to the apparatus main unit, exchangeable chip-type print heads which can make electric connection to the apparatus main unit and receive supply of ink from the apparatus main unit by being mounted to the apparatus main unit, and cartridge-type print heads wherein ink tanks are provided integrally with the print head.

Also, restoring means for the print head, auxiliary means, etc., which are provided as configurations of the printing apparatus of the present invention, further stabilize the advantages of the present invention, and thus are preferable. Specific examples of such include capping means for the print heads, cleaning means, pressurizing or suctioning means, pre-heating means of electro-thermal converters or other heating devices or combinations thereof, executing of a preliminary discharge mode wherein discharge other than printing is performed, and these are also advantageous for performing stable printing.

Also, with regard to the type and number of the print heads to be mounted, an arrangement may be made wherein one print head is provided for a single color, or wherein multiple heads are provided for multiple inks with different print colors and concentrations. That is, for the print mode of the printing apparatus for example, in addition to a printing mode of a main color only such as black, the print head may be configured either integrally or multiple print heads may be combined, but in either case, the present invention is extremely advantageous for apparatuses having at least one of multi-color capability with a plurality of colors, and full-color capability with color mixing.

Moreover, the above-described embodiments of the present invention describe the ink as being a liquid, but ink which is solid at room temperature and below but softens or liquefies at room temperature, may be used, or in the case of the ink-jet method, the ink itself is usually subjected to temperature control within a range of 30° C. to 70° C. so as to adjust the viscosity of the ink within a stable discharging range; in any case, the ink being liquid at the point of applying print signals is sufficient. In addition, applicable to the present invention are inks which only liquefy under application of thermal energy, wherein the ink is solid when left standing but liquefies by application of thermal energy according to print signals and liquid ink is discharged, of which some types may begin to solidify by the time of reaching the printing medium, regardless of whether such ink is used in order to prevent rising of temperature due to aggressive thermal energy by using this as energy for changing the state of the ink from the solid state to the liquid state, or in order to prevent evaporation of the ink. Such ink may be of a form held as a liquid or solid in recesses or through holes of a porous sheet and facing an electro-thermal converting member, such as described in Japanese Patent Laid-Open No. 54-56847 and Japanese Patent Laid-Open No. 60-71260. With the present invention, the most advantageous method regarding the above-described inks is the above-described film boiling method.

Moreover, in addition to using the printing apparatus having the printing mechanism using the liquid spraying print head according to the present invention as an image output terminal for information processing devices such as computers, the printing apparatus may take the form of a photocopier combined with a reader or the like, or further, a facsimile device having transmitting and receiving functions.

Thus, according to the present invention, using a high-density recording head wherein ink discharging nozzles and liquid discharging nozzles are positioned in a alternately adjacent manner realizes both high quality and high speed.

Also, using both recording ink and clear ink to form images allows the number of intermediate gradients to be increased without losing output resolution. Thus, smooth gradation can be represented, and also the grainy appearance at highlight portions can be reduced.

Also, using an inline head having a nozzle array wherein ink discharging nozzles and liquid discharging nozzles are arrayed realizes both high quality and high speed, without increasing the size of the apparatus or raising costs.

The individual components shown in outline or designated by blocks in the drawings are all well-known in the image recording art and their specific construction and operation are not critical to the operation or best mode for carrying out the invention.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet recording method which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, the recording method comprising the steps of:

determining whether to record at least one area of the image with the ink alone, or to record the area with both the ink and the liquid; and performing the recording of the area based on the results determined in the determining step, wherein, in the event of recording the area with both the ink and the liquid, in the recording step the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

2. An ink-jet recording method according to claim 1, wherein the ink discharged from the predetermined ink discharging nozzle and the liquid discharged from the predetermined liquid discharging nozzle adjacent to the predetermined ink discharging nozzle are discharged in a same scan.

3. An ink-jet recording method according to claim 1, wherein the ink discharged from the predetermined ink discharging nozzle and the liquid discharged from the predetermined liquid discharging nozzle adjacent to the predetermined ink discharging nozzle mix in a liquid state on the recording medium.

4. An ink-jet recording method according to claim 1, wherein in the determining step, determination is made to record with the ink alone in the event that the area is a non-solid area, and determination is made to record with both the ink and the liquid in the event that the area is a solid area.

5. An ink-jet recording method according to claim 1, wherein in the determining step, determination is made to record with the ink alone in the event that the area is a character area, and determination is made to record with both the ink and the liquid in the event that the area is a non-character area.

6. An ink-jet recording method according to claim 1, wherein in the determining step, determination is made whether to record the area with the ink alone, or with both the ink and the liquid, according to a type of image to be recorded and a recording speed mode.

7. An ink-jet recording method according to claim 6, wherein the type of image to be recorded is one selected from a group of text image, non-text image, and image with mixed text image and non-text image.

8. An ink-jet recording method according to claim 6, wherein the recording speed mode is one of a high-speed mode wherein one line on the recording medium is recorded with one main scan of the recording head, and a high quality mode wherein one line on the recording medium is recorded with a plurality of main scans of the recording head.

9. An ink-jet recording method according to claim 6, wherein a user selects the type of image to be recorded and the recording speed mode.

10. An ink-jet recording method according to claim 1, wherein in the determining step, determination is made to record an edge portion of the image to be recorded with the ink alone, and a non-edge portion thereof with both the ink and the liquid.

11. An ink-jet recording method according to claim 10, further comprising a step of separating the edge portion and the non-edge portion of the image.

12. An ink-jet recording method according to claim 10, wherein, at the time of recording the non-edge portion by both ink dots and liquid dots, the dots of the non-edge portion adjacent to the edge portion are not recorded.

13. An ink-jet recording method according to claim 10, wherein, at the time of recording the non-edge portion by both ink dots and liquid dots, the dots of the non-edge portion adjacent to the edge portion are thinned out.

14. An ink-jet recording method according to claim 10, wherein the image is at least one selected from a group of characters, line-art, and graphs.

15. An ink-jet recording method according to claim 1, further comprising the steps of:

extracting character areas within the image to be recorded; and separating an edge portion and a non-edge portion of an extracted character area, wherein, in the determining step, determination is made to record the edge portion with the ink alone, to record the non-edge portion with both the ink and the liquid, and to record non-character areas other than the extracted character areas with both the ink and the liquid.

16. An ink-jet recording method according to claim 1, wherein the recording head comprises thermal energy generating means wherein bubbles are generated by applying heat to the ink or liquid, and the ink or liquid is discharged based on the generation of the bubbles.

17. An ink-jet recording method according to claim 1, wherein the liquid which essentially does not contain color material is clear ink formed by removing color material from the ink.

18. An ink-jet recording apparatus which uses a recording head having a nozzle array comprised of at least one ink discharging nozzle for discharging ink which contains color material and at least one liquid discharging nozzle for discharging liquid which essentially does not contain color material being alternately adjacently arrayed in a predetermined direction, and the ink and the liquid being discharged on a recording medium while relatively scanning the recording head and the recording medium, thereby recording an image, the recording apparatus comprising:

determining means for determining whether to record at least one area of the image with the ink alone, or to record the area with both the ink and the liquid; and recording control means for controlling the recording head such that recording is performed based on the results determined by the determining means, wherein, in the event of recording the area with both the ink and the liquid, the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

19. An ink-jet recording apparatus according to claim 18, wherein the ink discharged from the predetermined ink discharging nozzle and the liquid discharged from the predetermined liquid discharging nozzle adjacent to the predetermined ink discharging nozzle are discharged in a same scan.

20. An ink-jet recording apparatus according to claim 18, wherein the ink discharged from the predetermined ink discharging nozzle and the liquid discharged from the predetermined liquid discharging nozzle adjacent to the predetermined ink discharging nozzle mix in a liquid state on the recording medium.

21. An ink-jet recording apparatus according to claim 18, wherein the determining means determines to record with the ink alone in the event that the area is a non-solid area, and determines to record with both the ink and the liquid in the event that the area is a solid area.

22. An ink-jet recording apparatus according to claim 18, wherein the determining means determines to record with the ink alone in the event that the area is a character area, and determines to record with both the ink and the liquid in the event that the area is a non-character area.

23. An ink-jet recording apparatus according to claim 18, wherein the determining means determines whether to record the area with the ink alone, or with both the ink and the liquid, according to a type of image to be recorded and a recording speed mode.

24. An ink-jet recording apparatus according to claim 23, wherein the type of image to be recorded is one selected from a group of document image, non-document image, and image with mixed document image and non-document image.

25. An ink-jet recording apparatus according to claim 23, wherein the recording speed mode is one of a high-speed mode wherein one line on the recording medium is recorded with one main scan of the recording head, and a high quality mode wherein one line on the recording medium is recorded with a plurality of main scans of the recording head.

26. An ink-jet recording apparatus according to claim 23, wherein a user selects the type of image to be recorded and the recording speed mode.

27. An ink-jet recording apparatus according to claim 18, wherein the determining means determines to record an edge portion of the image to be recorded with the ink alone, and a non-edge portion thereof with both the ink and the liquid.

28. An ink-jet recording apparatus according to claim 27, further comprising means for separating the edge portion and the non-edge portion of the image.

29. An ink-jet recording apparatus according to claim 27, wherein, a t the time of recording the non-edge portion by both ink dots and liquid dots, the dots of the non-edge portion adjacent to the edge portion are not recorded.

30. An ink-jet recording apparatus according to claim 27, wherein, at the time of recording the non-edge portion by both ink dots and liquid dots, the dots of the non-edge portion adjacent to the edge portion are thinned out.

31. An ink-jet recording apparatus according to claim 27, wherein the image is at least one selected from a group of characters, line-art, and graphs.

32. An ink-jet recording apparatus according to claim 18, further comprising:

extracting means for extracting character areas within the image to be recorded; and separating means for separating an edge portion and a non-edge portion of an extracted character area, wherein, the determining means determines to record the edge portion with the ink alone, to record the non-edge portion with both the ink and the liquid, and to record non-character areas other than the extracted character areas with both the ink and the liquid.

33. An ink-jet recording apparatus according to claim 18, wherein the recording head comprises thermal energy generating means wherein bubbles are generated by applying heat to the ink or liquid, and the ink or liquid is discharged based on the generation of the bubbles.

34. An ink-jet recording apparatus according to claim 18, wherein the liquid which essentially does not contain color material is clear ink formed by removing color material from the ink.

35. A computer-readable storage medium storing a program for executing a recording control step for an ink-jet recording apparatus which uses a recording head having a nozzle array comprised of at least one ink discharging nozzle for discharging ink which contains color material and at least one liquid discharging nozzle for discharging liquid which essentially does not contain color material being alternately adjacently arrayed in a predetermined direction, and the ink and the liquid being discharged on a recording medium while relatively scanning the recording head and the recording medium, thereby recording an image, the program comprising the steps of:

determining whether to record at least one area of the image with the ink alone, or to record the area with both the ink and the liquid; and generating recording data based on the results determined in the determining step, wherein, in the event that recording of the area with both the ink and the liquid has been determined, the generating of the recording data in the generating step is executed such that the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

36. A computer-readable storage medium according to claim 35, wherein in the determining step, determination is made to record with the ink alone in the event that the area is a non-solid area, and determination is made to record with both the ink and the liquid in the event that the area is a solid area.

37. A computer-readable storage medium according to claim 35, wherein in the determining step, determination is made to record with the ink alone in the event that the area is a character area, and determination is made to record with both the ink and the liquid in the event that the area is a non-character area.

38. A computer-readable storage medium according to claim 35, wherein in the determining step, determination is made whether to record the area with the ink alone, or with both the ink and the liquid, according to a type of image to be recorded and a recording speed mode.

39. A computer-readable storage medium according to claim 38, wherein the type of image to be recorded is one selected from a group of document image, non-document image, and image with mixed document image and non-document image.

40. A computer-readable storage medium according to claim 38, wherein the recording speed mode is one of a high-speed mode wherein one line on the recording medium is recorded with one main scan of the recording head, and a high resolution mode wherein one line on the recording medium is recorded with a plurality of main scans of the recording head.

41. A computer-readable storage medium according to claim 35, wherein in the determining step, determination is made to record an edge portion of the image to be recorded with the ink alone, and a non-edge portion thereof with both the ink and the liquid.

42. A computer-readable storage medium according to claim 41, further comprising a step of separating the edge portion and the non-edge portion of the image.

43. A computer-readable storage medium according to claim 41, wherein, at the time of determining recording of the non-edge portion by both ink dots and liquid dots, the recording data is generated such that the dots of the non-edge portion adjacent to the edge portion are not recorded.

44. A computer-readable storage medium according to claim 41, wherein, at the time of determining recording the non-edge portion by both ink dots and liquid dots, the recording data is generated such that the dots of the non-edge portion adjacent to the edge portion are thinned out.

45. A computer-readable storage medium according to claim 41, wherein the image is at least one selected from a group of characters, line-art, and graphs.

46. A computer-readable storage medium according to claim 35, further comprising the steps of:

extracting character areas within the image to be recorded; and separating an edge portion and a non-edge portion of an extracted character area, wherein, in the determining step, determination is made to record the edge portion with the ink alone, to record the non-edge portion with both the ink and the liquid, and to record non-character areas other than the extracted character areas with both the ink and the liquid.

47. A program for controlling an ink-jet recording apparatus which uses a recording head having a nozzle array comprised of at least one ink discharging nozzle for discharging ink which contains color material and at least one liquid discharging nozzle for discharging a liquid which essentially does not contain color material being alternately adjacently arrayed in a predetermined direction, and the ink and the liquid being discharged on a recording medium while relatively scanning the recording head and the recording medium, thereby recording an image, the program comprising the steps of:

determining whether to record at least one area of the image with the ink alone, or to record the area with both the ink and the liquid; and generating recording data based on the results determined in the determining step, wherein, in the event of determining recording of the area with both the ink and the liquid, the generating of the recording data in the generating step is executed such that the ink discharged from a predetermined ink discharging nozzle and the liquid discharged from a predetermined liquid discharging nozzle adjacent to the predetermined ink discharging nozzle each land at different positions on the recording medium, and the landed ink and the landed liquid come into contact on the recording medium.

48. A program according to claim 47, wherein in the determining step, determination is made to record with the ink alone in the event that the area is a non-solid area, and determination is made to record with both the ink and the liquid in the event that the area is a solid area.

49. A program according to claim 47, wherein in the determining step, determination is made to record with the ink alone in the event that the area is a character area, and determination is made to record with both the ink and the liquid in the event that the area is a non-character area.

50. A program according to claim 47, wherein in the determining step, determination is made whether to record the area with the ink alone, or with both the ink and the liquid, according to a type of image to be recorded and a recording speed mode.

51. A program according to claim 50, wherein the type of image to be recorded is one selected from a group of document image, non-document image, and image with mixed document image and non-document image.

52. A program according to claim 50, wherein the recording speed mode is one of a high-speed mode wherein one line on the recording medium is recorded with one main scan of the recording head, and a high quality mode wherein one line on the recording medium is recorded with a plurality of main scans of the recording head.

53. A program according to claim 47, wherein in the determining step, determination is made to record an edge portion of the image to be recorded with the ink alone, and a non-edge portion thereof with both the ink and the liquid.

54. A program according to claim 53, further comprising a step of separating the edge portion and the non-edge portion of the image.

55. A program according to claim 53, wherein, at the time of determining recording of the non-edge portion by both ink dots and liquid dots, the recording data is generated such that the dots of the non-edge portion adjacent to the edge portion are not recorded.

56. A program according to claim 53, wherein, at the time of determining recording of the non-edge portion by both ink dots and liquid dots, the recording data is generated such that the dots of the non-edge portion adjacent to the edge portion are thinned out.

57. A program according to claim 53, wherein the image is at least one selected from a group of characters, line-art, and graphs.

58. A program according to claim 47, further comprising the steps of:

extracting character areas within the image to be recorded; and separating an edge portion and a non-edge portion of an extracted character area, wherein, in the determining step, determination is made to record the edge portion with the ink alone, to record the non-edge portion with both the ink and the liquid, and to record non-character areas other than the extracted character areas with both the ink and the liquid.

* * * * *

UNITED STATES PATENT AND TRADEMARK OFFICE

CERTIFICATE OF CORRECTION

PATENT NO. : 6,533,382 B1
DATED : March 18, 2003
INVENTOR(S) : Tomida et al.

It is certified that error appears in the above-identified patent and that said Letters Patent is hereby corrected as shown below:

Column 4,
Line 14, "⑦," should read -- ③, --.

Column 25,
Line 44, "though" should read -- thought --.

Column 26,
Line 1, "Thus" should read -- Thus, --.

Column 45,
Line 56, "by" should read -- may --.

Column 50,
Line 22, "a" should read -- an --.

Column 53,
Line 27, "a t" should read -- at --.

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,533,382 B1
DATED : March 18, 2003
INVENTOR(S) : Tomida et al.

It is certified that error appears in the above-identified patent and that said Letters Patent is hereby corrected as shown below:

Title page,
Item [*] Notice, should read -- Subject to any disclaimer,the term of this patent is extended or adjusted under 35 U.S.C. 154(b) by 222 days. --

Signed and Sealed this

Twenty-eighth Day of September, 2004

JON W. DUDAS
*Director of the United States Patent and Trademark Office*